United States Patent [19]

Jensen et al.

[11] 4,382,737

[45] May 10, 1983

[54] CAN END MAKING APPARATUS

[75] Inventors: James W. Jensen; Stanley J. Miller; Eugene W. Heniser, all of Hastings, Mich.; Donald P. Dalman, Rutland, Vt.; Garth A. Grevenstuk, Wayland, Mich.

[73] Assignee: Gulf & Western Manufacturing Company, Southfield, Mich.

[21] Appl. No.: 240,788

[22] Filed: Mar. 5, 1981

[51] Int. Cl.[3] ..... B21D 51/00

[52] U.S. Cl. ..... 413/56; 72/348; 72/405; 413/62; 413/65

[58] Field of Search ..... 473/3, 56, 62, 65; 72/348, 356, 405

[56] References Cited

U.S. PATENT DOCUMENTS

| | | | |
|---|---|---|---|
| 1,152,395 | 9/1915 | Butler | 413/65 |
| 1,721,264 | 7/1929 | Taylor | 413/3 |
| 2,343,006 | 2/1944 | Gibbs | 413/56 |
| 3,604,380 | 9/1971 | Schmeltzer | 113/1 F |
| 3,662,640 | 5/1972 | Wrona | 83/530 |
| 3,768,295 | 10/1973 | Cudzik | 72/347 |
| 3,834,213 | 9/1974 | Hengler et al. | 72/405 |
| 3,941,070 | 3/1976 | Kaminski | 72/405 |
| 4,026,226 | 3/1977 | Hahn et al. | 72/405 |

*Primary Examiner*—Leon Gilden

*Attorney, Agent, or Firm*—Body, Vickers & Daniels

[57] ABSTRACT

Apparatus is disclosed for making ends for metal or composite can bodies, which ends are first partially formed in a press to a cup-shaped configuration including a peripheral skirt and are then fed to a curling machine in which the skirt is contoured to facilitate application of the end to a can body. The press has a vertically reciprocable slide or slides which, together with an opposed portion of the press frame, support pairs of cooperable dies for blanking and partially forming can ends from sheet material fed horizontally into the press. Thereafter, the partially formed can ends are displaced into a horizontal plane vertically spaced from the sheet feed line, and a kicker member associated with each die set is operable in coordination with slide movement to impact against and propel the partially formed can end laterally and into a guide chute leading either to a curling machine or to an endless conveyor by which the partially formed can end is delivered to a curling machine.

64 Claims, 38 Drawing Figures

CAN END MAKING APPARATUS

BACKGROUND OF THE INVENTION

This invention relates to the art of can making machinery and, more particularly, to apparatus for making end closures for can bodies.

It is of course well known to form can ends by feeding sheet material between sets of dies in a press which are cooperable during the work stroke of the press to blank and partially form can ends, and then feed the partially formed can ends into a curling mechanism to complete the forming operation. Apparatus for this purpose is disclosed in U.S. Pat. Nos. 984,169 to Swangren issued Feb. 14, 1911 and 2,299,816 to Goebel issued Oct. 27, 1942. It is also known from the latter patents to transfer the partially formed can ends from the press to the curling mechanism by means of guide chutes and/or endless conveyor belt runs associated with the press. Such prior art forming and curling apparatus, as disclosed in the Swangren and Goebel patents, has employed an inclined type press in which the slide axis is inclined relative to vertical, and the partially formed can ends are displaced from the die area and into the guide chutes by the influence of gravity. Such inclined presses and the drive arrangements for the slides thereof present a number of problems which effect production rates, product quality and compliance with present day industrial noise standards. In this respect, the inclined disposition and the reliance on gravity for discharge of partially formed can ends requires an undesirably slow press operation and thus a less than desirable production rate. While it might be possible to employ arrangements to expedite displacement of partially formed can ends from the die areas, the overhead drive arrangement still imposes limitations on the speed at which the press can be operated whereby the production rate for the press cannot be increased to the extent desired. In this respect, it is not possible to adequately lubricate and cool the crankshaft bearings without in turn paying the penalty of inadequate collection of lubricant and contamination by lubricant of the die area and eventually the chutes and conveyors leading to the curlers. Such contamination also results from lubrication of standard gibbing between the slide and press frame. Still further, the inclined disposition of the slide imposes limitations on speed as a result of the heat generated by sliding interengagement between the press frame and slide gibbing, and the operation of such an inclined press is extremely noisey and makes it difficult to operate within desired standards for industrial noise levels.

SUMMARY OF THE INVENTION

In accordance with the present invention, improved can end making apparatus is provided which includes an upright press provided with devices for propelling partially formed can ends from the tooling area for conveyance to curling machines in which forming of the ends is completed. The press component of the can end making apparatus enables optimum slide speed without the lubricant circulating and the heating and tool area contamination problems heretofore encountered in can end making apparatus, and enables such high speed operation while reducing noise levels of press operation. Thus, for a given size press, the production rate for can ends is increased with respect to that which could be achieved heretofore, and product quality and uniformity of quality are improved by avoiding the contamination problems. In accordance with one aspect of the invention, such higher production capabilities are enabled by a press in which slide guidance is remote from the tooling area, thus reducing potential contamination by lubrication of the guide components, and in which crankshaft lubrication requirements are achieved in a manner which avoids heating and circulation problems while minimizing potential contamination of the tooling area as a result of such lubrication. More particularly in this respect, in certain embodiments the press is underdriven, thus confining crankshaft lubricant below the tooling area, and in another embodiment the press is overhead driven by a crankshaft associated with sealed cartridge type bearings, thus avoiding forced lubrication requirements therefor and circulation of such lubricant in the area of the press above the tooling.

In accordance with another aspect of the invention, such higher production capabilities are achieved by the use of high speed kicking devices, the energy of which is released in coordination with slide displacement to propel partially formed can ends from the tooling area so as to permit an optimum stroke rate for the slide. Further in connection with the present invention, plural curling machines are associated with the press to receive partially formed can ends propelled from the tooling area and, in accordance with one embodiment of the invention, press operation is optimized by providing conveyor runs along opposite sides of the press, propelling partially formed can ends outwardly of the die area toward the opposite sides of the press and providing two curling machines on each side of the press to receive partially formed can ends from the conveyor runs on the corresponding side of the press.

It is accordingly an outstanding object of the present invention to provide improved apparatus for the production of end closures for can bodies.

Another object is the provision of apparatus for the foregoing purpose which enables achieving a higher production rate for can ends than heretofore possible.

A further object is the provision of apparatus for the foregoing purpose including an upright press having slide supporting, slide driving, and lubricating characteristics which enable high speed operation thereof while avoiding contamination of the tool area with lubricant, thus improving product quality and reducing maintenance requirements with respect to the tooling, and enabling high speed press operation with acceptable noise levels.

Yet another object is the provision of apparatus for the foregoing purpose including tooling for partially forming a can end, and high speed discharge devices for impacting against and propelling partially formed can ends from the tooling area, thus to enable high speed operation of the press.

Still another object is the provision of apparatus of the foregoing character which provides a number of curling machines associated with a given press and tooling arrangement which, together with the discharge devices and conveying arrangements for delivering partially formed can ends to the curling machines enables operating the press at its optimum output capacity.

Another object is the provision of apparatus of the foregoing character providing improved efficiency with respect to the production of can ends from the standpoint of operation of the apparatus at an iptimum output rate and with minimum down time for maintenance purposes and with minimum contamination in the tooling area and, thus, both improved and more uniform product quality during a given period of operation.

BRIEF DESCRIPTION OF THE DRAWINGS

The foregoing objects and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
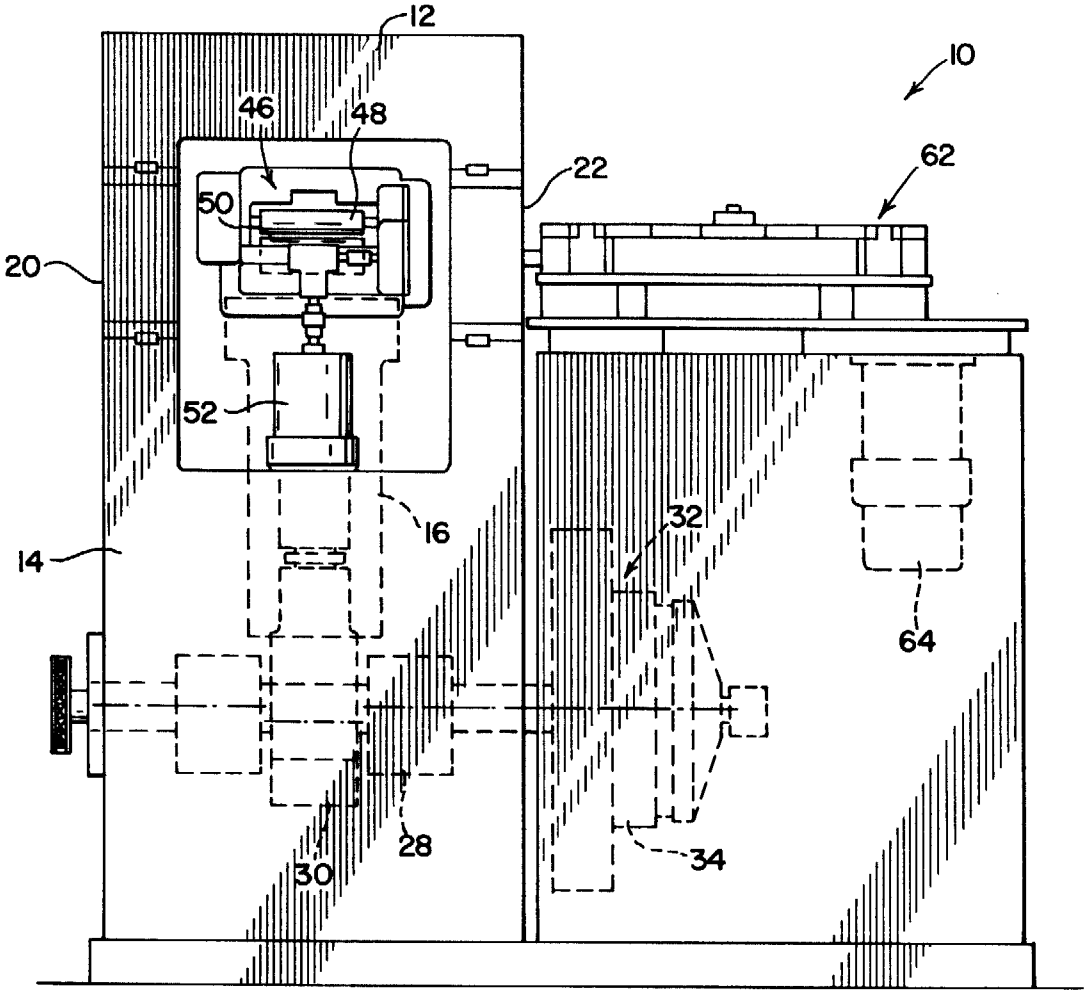
FIG. 1 is a side elevation view of can end making apparatus in accordance with the present invention.
Figure 2:
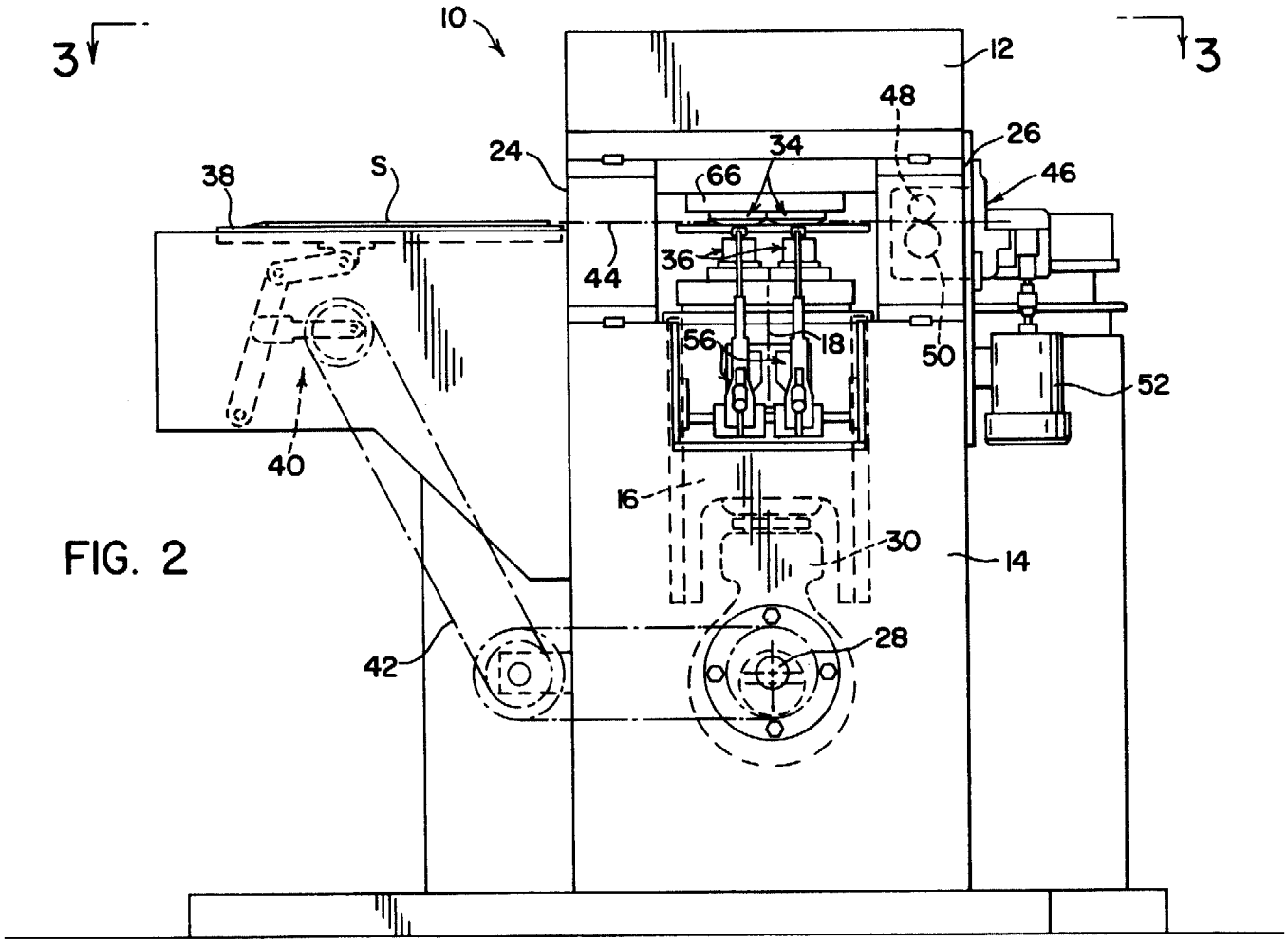
FIG. 2 is an end elevation view of the apparatus looking in the direction from left to right in FIG. 1.
Figure 3:
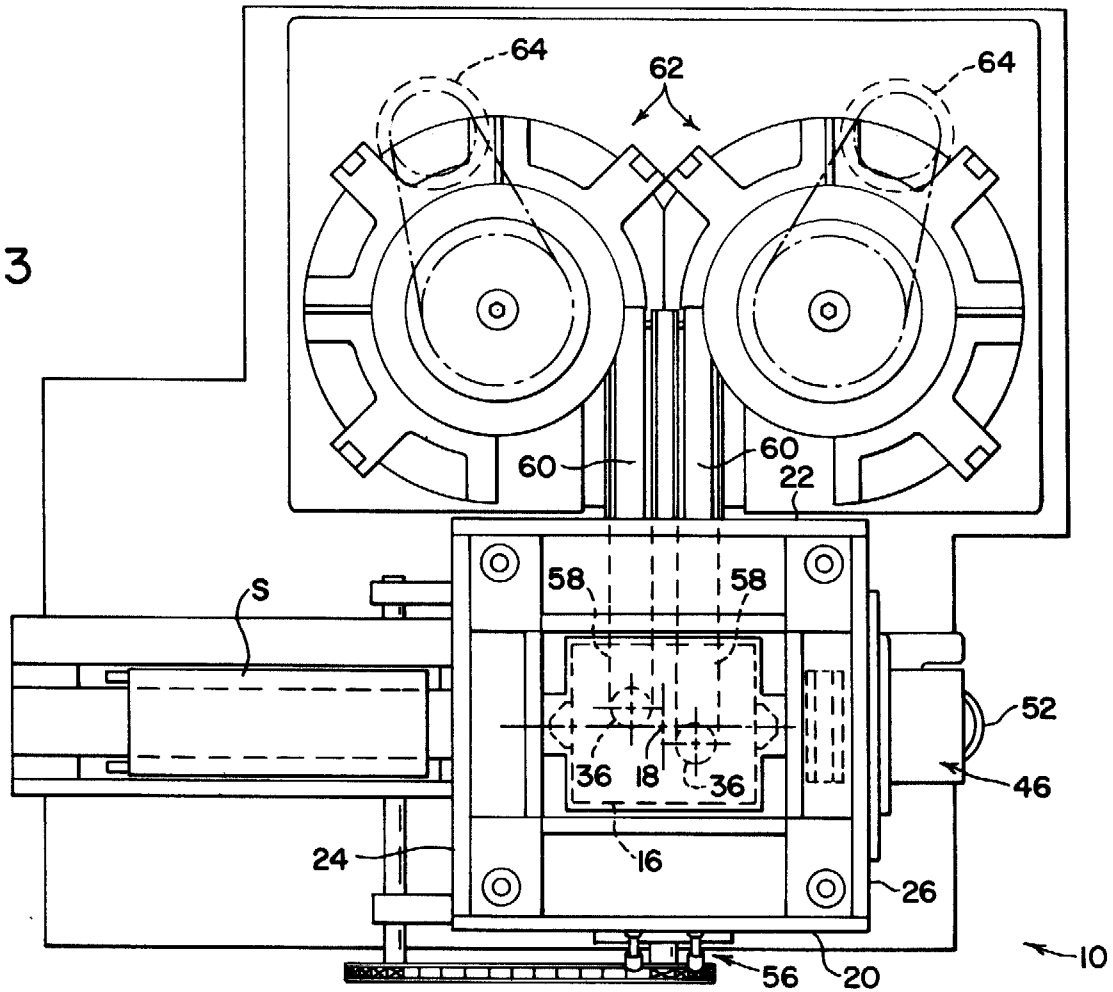
FIG. 3 is a sectional plan view of the apparatus taken along line 3—3 in FIG. 2.

Referring now in greater detail to the drawings wherein the showings are for the purpose of illustrating preferred embodiments of the invention only, and not for the purpose of limiting the invention, FIGS. 1-3 illustrate an underdriven single action press 10 comprising a frame having a crown portion 12 and a base portion 14 which supports a slide 16 for vertical reciprocation along a slide path having an axis 18. Press 10 has opposite sides 20 and 22 and opposite ends 24 and 26, and it will be appreciated that slide 16 has corresponding opposite sides and opposite ends. Base portion 14 of the press frame supports a crankshaft 28 which extends between sides 20 and 22, and a connecting rod 30 is pivotally interconnected with crankshaft 28 and slide 16 for the slide to be reciprocated in response to rotation of the crankshaft. Crankshaft 28 is adapted to be rotated through a flywheel and brake and clutch drive unit 32 mounted on side 22 of the press, the flywheel 34 of which drive unit is adapted to be driven by an endless belt or belts interengaged therewith and with an electric drive motor, not illustrated.

Crown portion 12 of the press frame and slide 16 support two pairs of opposed tooling including upper tooling 34 and lower tooling 36, which pairs are offset relative to one another and to the slide axis in the direction between the opposite sides and ends of the press. Each pair of the tooling is cooperable during operation of the press, as set forth more fully hereinafter, to cut a circular blank from sheet material therebetween and to form the blank to a cup-shaped configuration defining a partially formed can end. Sheet material S to be fed through the press is supported on a feed table 38 adjacent end 24 of the press and is fed through the press step-by-step in coordination with reciprocation of slide 16. Any suitable feed arrangement can be employed to achieve such step-by-step displacement of the sheet S through the press, such as a reciprocating feed finger type mechanism as designated generally by numeral 40. As is well known in the art, such a feed mechanism includes reciprocating feed bars carrying sets of feed fingers which successively engage behind a sheet S to advance the sheet into the press. In the embodiment illustrated, the end of crankshaft 28 opposite drive unit 32 extends through side 20 of the press and is interconnected with feed mechanism 40 by a drive train 42 so as to coordinate reciprocation of the feed bars and thus the feeding of sheet S with the reciprocation of slide 16. While not shown, it will be appreciated that a suitable supply of sheets S can be supported outwardly adjacent the table 38 together with a mechanism for feeding sheets onto the table as the sheet thereon is advanced through the press.

Sheet material S is fed through the press along a horizontal feed path 44, and end 26 of the press is provided with a scrap removal mechanism 46 by which scrap sheet material is discharged from the press after the last blanking and forming operation thereon. Any suitable mechanism can be employed for this purpose and, in the embodiment illustrated, discharge mechanism 46 includes a pair of rollers 48 and 50 driven by a motor 52. As is well known with this type of discharge mechanism, rollers 48 and 50 are spaced apart so that the leading edge of a sheet S is moved therebetween in response to the step-by-step operation of feed mechanism 40 until the last cutting and forming operation has taken place with respect to the sheets. Following the last such operation, rolls 48 and 50 are actuated to engage opposite sides of the sheet and quickly displace the scrap sheet from the press.

As described in greater detail hereinafter, side 20 of the press is provided with a pair of kicker mechanisms 56 each aligned with one of the pairs of tooling and operable in coordination with the displacement of slide 16 to propel a partially formed can end from the lower tooling of the corresponding pair, such propelling being in a horizontal plane spaced below feed path 44 and transverse to the direction of the feed path. Such propelled partially formed can ends enter a corresponding guide chute 58 between the tooling and side 22 of the press which directs the can end onto a corresponding endless belt type conveyor 60. Each conveyor 60 conveys the partially formed can end to the entrance of a corresponding curling machine 62 supported adjacent side 22 of the press. Each of the curling machines 62 is operated by a corresponding electric motor 64, and operates in a well known manner to curl the skirt portion of a partially formed can end received therein to complete the can end forming operation, after which the can end is discharged from the curling machine into a suitable hopper or the like.

Figure 4:
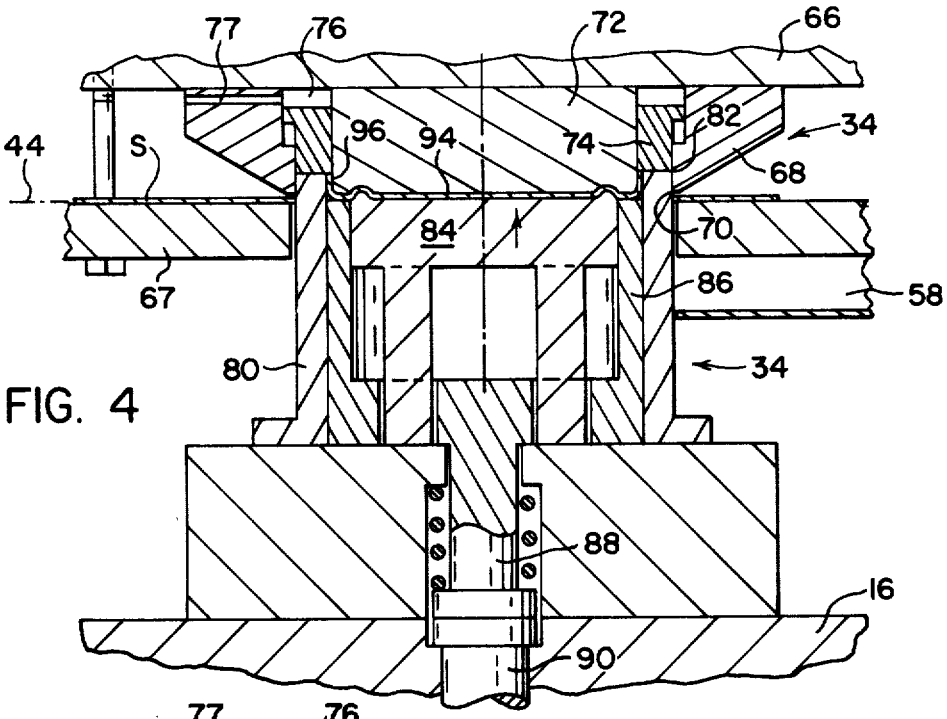
FIG. 4 is a schematic illustration of a die set for partially forming a can end in the press shown in FIGS. 1-3 and illustrating the die components cooperatively interengaged during a forming operation.
Figure 5:
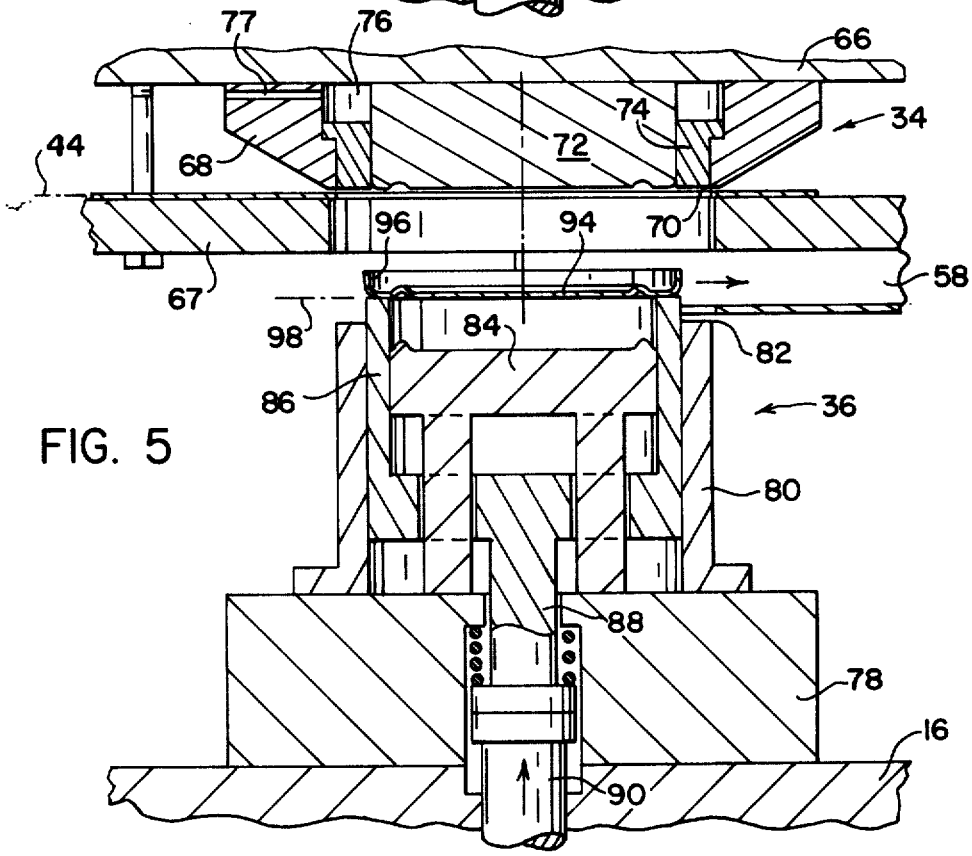
FIG. 5 is a schematic illustration similar to FIG. 4 and illustrating the die components in positions thereof following the forming operation.

As mentioned hereinabove, the tooling area of the press is provided with two pairs of cooperable tooling each including upper tooling 34 and corresponding lower tooling 36. It will be appreciated that the stroke of slide 16 provides for the corresponding upper and lower tooling to be spaced apart when the slide is in its lowermost position and to cooperatively interengage upon upward movement of slide 16 toward crown 12 to blank and partially form a can end from sheet material S therebetween. One set of upper and lower tooling is somewhat schematically illustrated in FIGS. 4 and 5 of the drawing, respectively in the cooperable and spaced apart positions thereof, and the operation thereof in connection with partially forming a can end and then supporting the latter for displacement into guide chutes 58 will be understood from reference to the latter Figures. It will be appreciated of course that the description of the pair of tooling shown in FIGS. 4 and 5 is applicable to both sets of tooling in the press. Upper tooling 34 is mounted on a bolster plate 66 attached to crown 12 of the press frame, whereby the upper tooling is fixed relative to slide 16. Further, a cover plate 67 is attached to bolster plate 66 to support sheet S in the plane of feed path 44 which is just below the lowermost portion of upper tooling 34. The upper tooling includes an annular outer portion 68 providing a cutting edge 70, a central die component 72, and an annular hold down component 74 between components 68 and 72. Hold down component 74 is suitably biased downwardly relative to members 68 and 72, such as by air under pressure introduced into chamber 76 therebehind through a passageway 77 connected to a source of air, not illustrated. Lower tooling 36 is mounted on slide 16 for displacement therewith by a tooling support component 78 and includes an annular outer member 80 providing a cutting edge 82 which cooperates with cutting edge 70 on the upper tooling, a central die member 84, and an annular lift out member 86 between members 80 and 84. Lift out member 86 is vertically reciprocable relative to components 80 and 84 and includes an operating stem 88 extending through support component 78 for engagement with a corresponding lift out pin 90 associated with slide 16 as set forth more fully hereinafter.

As will be further seen in FIGS. 4 and 5, feed path 44 for sheet material S is disposed just below upper tooling 34, and it will be appreciated that the sheet material is stepped inwardly of the press between the upper and lower tooling when the slide is in its lowermost position and the tooling is spaced apart in the positions thereof shown in FIG. 5. It will be further appreciated that during upward movement of slide 16 cutting edges 70 and 82 of the tooling cooperably interengage to sever a circular blank from sheet material S between the tooling after which central die portions 72 and 84 cooperatively interengage to form the circular blank to the cross-section configuration illustrated in FIG. 4. In this respect, the tooling shapes the circular blank into a cup-shaped configuration defining a partially formed can end having a central panel 94 and an upwardly extending peripheral skirt 96. Following the forming operation, slide 16 descends and the partially formed can end is carried downwardly with lower tooling 36 below feed path 44, and lift out pin 90 is actuated during descent of the slide as set forth hereinafter to displace lift out member 86 upwardly relative to die member 80 to position the partially formed can end in a horizontal plane 98 which is spaced below feed path 44 a distance to provide clearance between the feed path and skirt 96. At this time, and in the manner set forth more fully hereinafter, the partially formed can end is propelled in horizontal plane 98 from lower die member 86 into the corresponding guide chute 58.

Figure 6:
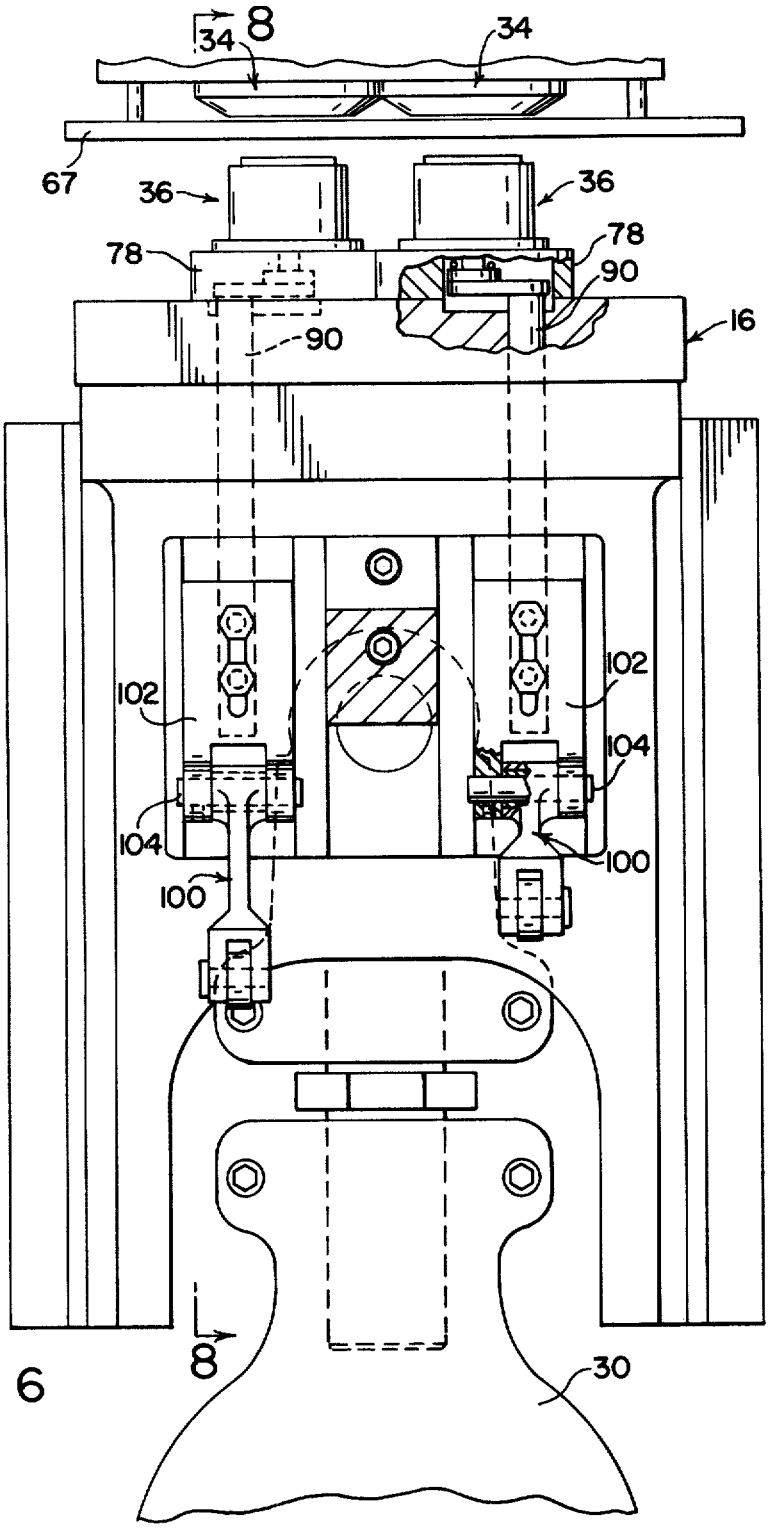
FIG. 6 is an end elevation view, partially in section, of a portion of the slide and press frame showing the lift out mechanism for a partially formed can end.
Figure 7:
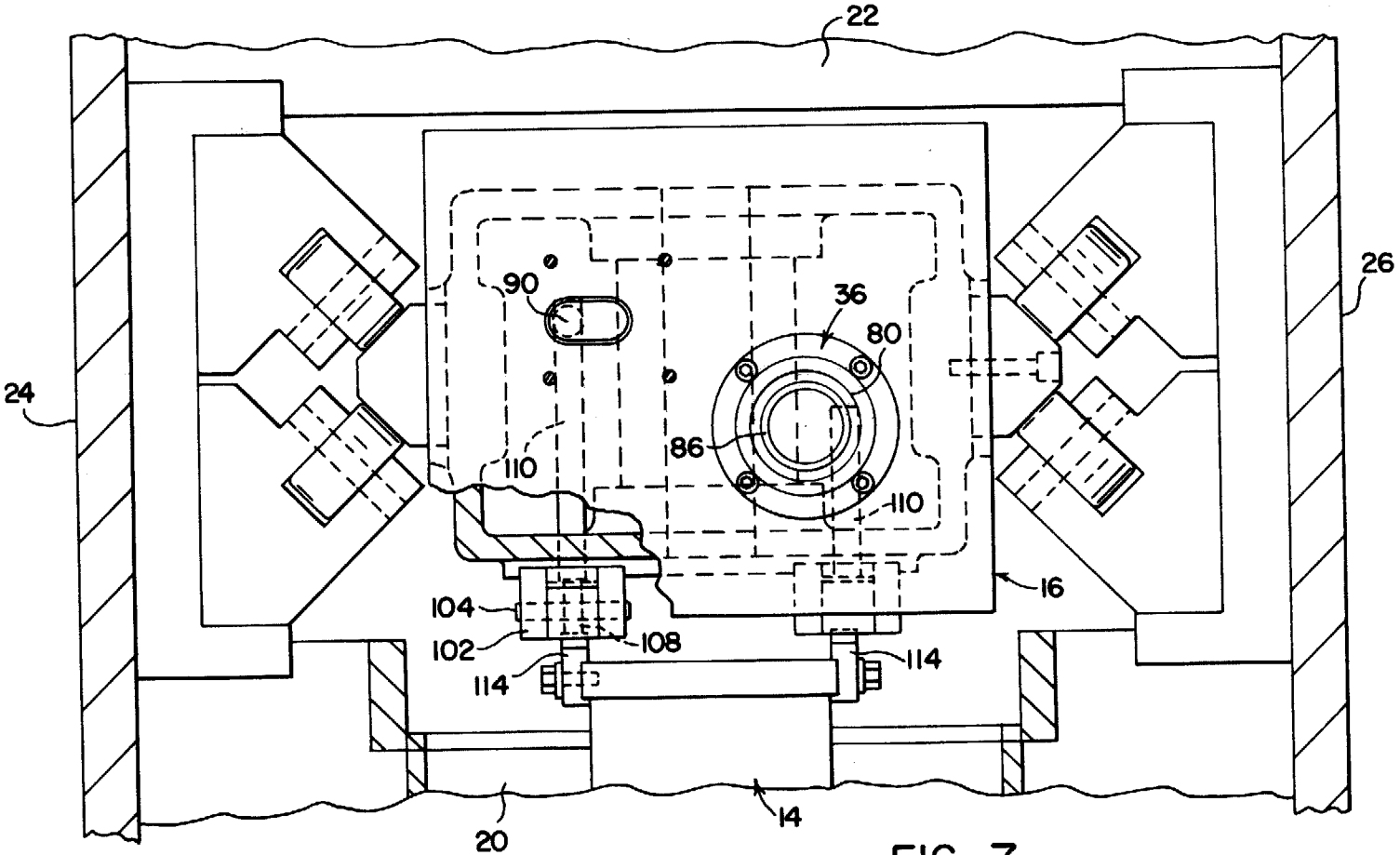
FIG. 7 is a plan view, partially in section, of the slide and press frame showing the knockout mechanism.
Figure 8:
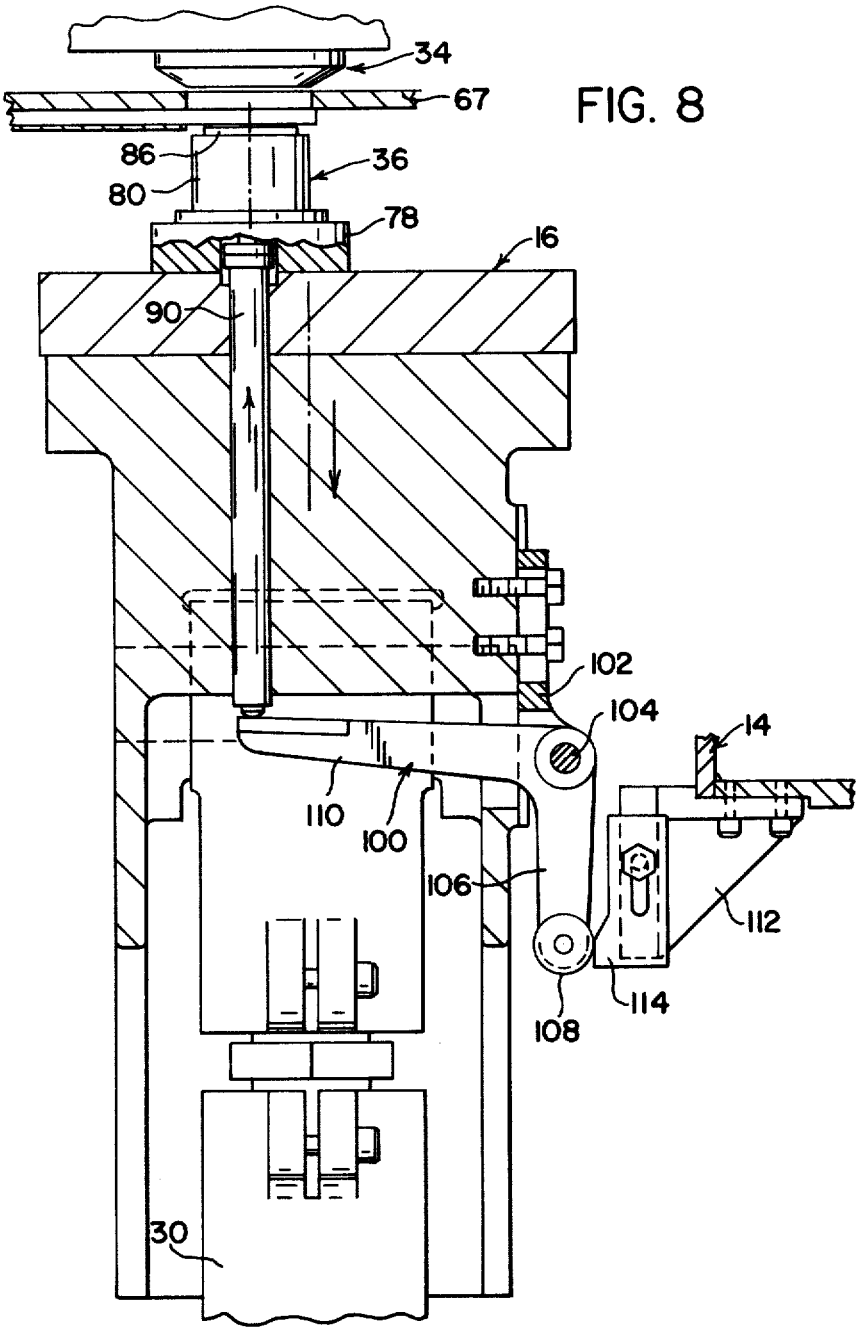
FIG. 8 is a sectional elevation view of one of the lift out mechanisms taken along line 8—8 in FIG. 6.

The manner in which lift out pins 90 of slide 16 are operated to achieve support of a partially formed can end in horizontal plane 98 will be best understood with reference to FIGS. 6–8 of the drawing. In this respect, slide 16 is provided with a pair of lift out levers 100, each associated with one of the lower tooling 36. Levers 100 differ from one another only in dimension and to take into account the offset relationship of the pairs of tooling with respect to the slide axis. Levers 100 are mounted on slide 16 by means of a support bracket 102 on which the levers are each pivotally supported by means of a corresponding pivot pin 104. Each lever includes a leg 106 depending downwardly from pin 104 and having a cam follower roller 108 on the lower end thereof, and a leg 110 extending inwardly of the slide and having an inner end engaging beneath the corresponding lift out pin 90 which is vertically reciprocable in a corresponding bore therefor in slide 16. Lower portion 14 of the press frame is provided with a mounting bracket 112 supporting a pair of lift out cams 114 which, like levers 100, differ only in the relative positions thereof to achieve the desired displacement of the corresponding lift out pin 90. Cam follower rollers 108 of levers 100 engage the corresponding cam 114 during downward movement of slide 16 to pivot levers 100 about pins 104 to achieve displacement of lift out pins 90 relative to slide 16, and thus displacement of the corresponding lift out component 86 of lower tooling 36 relative to tooling components 80 and 84, whereby the partially formed can end is supported in horizontal plane 98. After the partially formed can end has been propelled from lift out component 86, upward movement of slide 16 results in pivotal displacement of levers 100 in the direction to achieve retraction of lift out pins 90 relative to the slide and thus return of lift out component 86 of lower tooling 36 to the position shown in FIG. 4 of the drawing.

Figure 10:
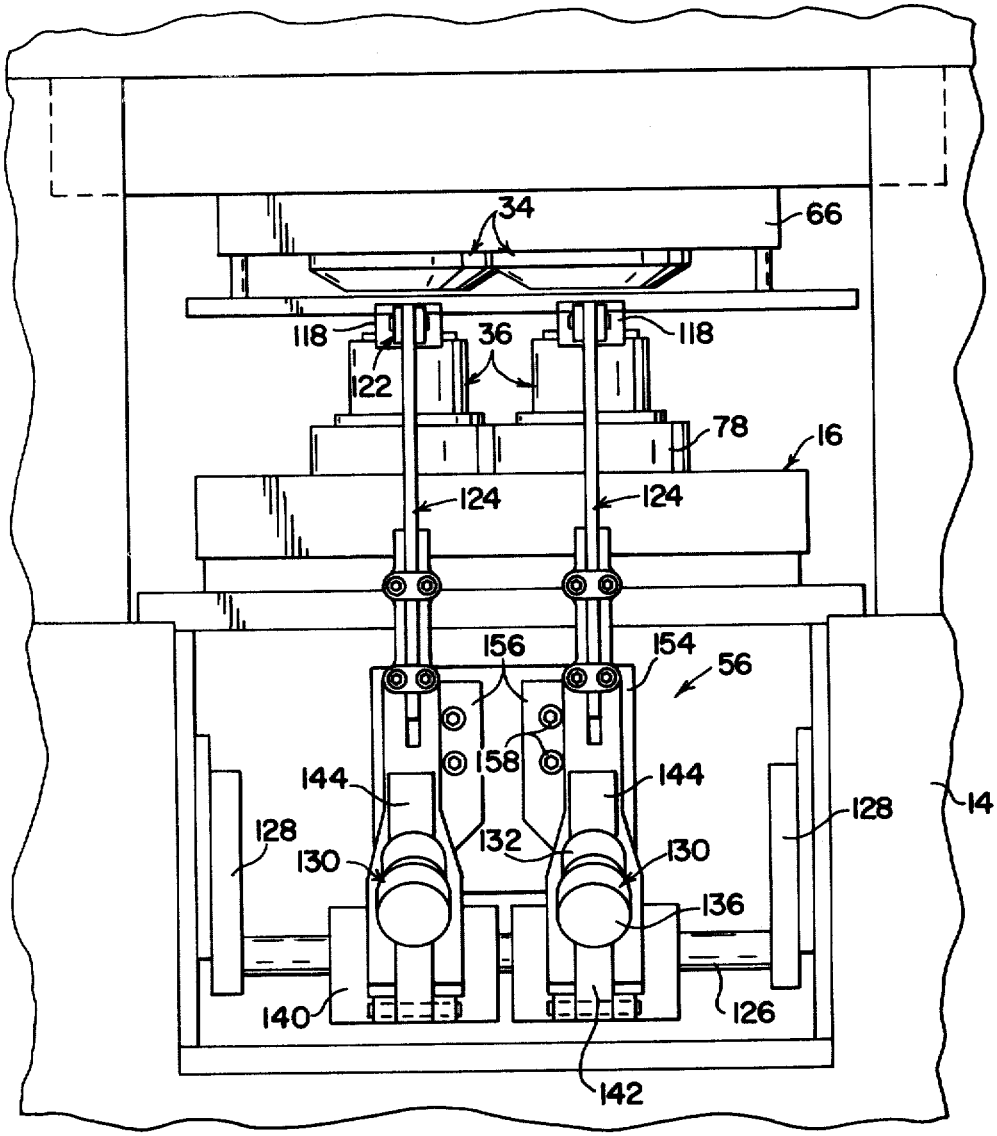
FIG. 10 is an end elevation view of the kicker mechanism taken along line 10—10 in FIG. 9.
Figure 11:
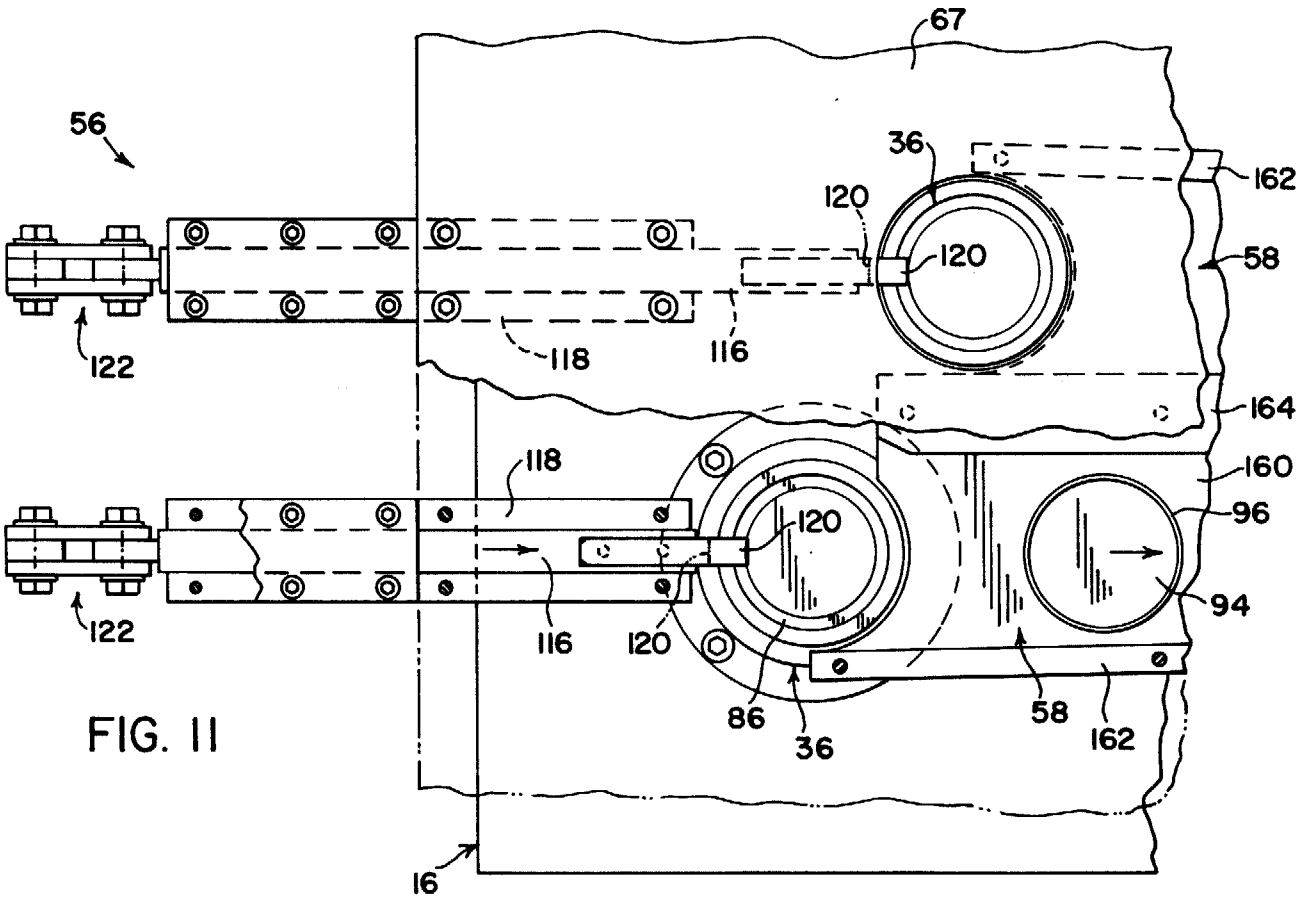
FIG. 11 is a plan view of the kicker mechanisms taken along line 11—11 in FIG. 9.

As mentioned hereinabove, partially formed can ends are displaced from the lower tooling in horizontal plane 98 by kicker mechanisms 56 which are high speed type mechanisms adapted to be actuated when the tooling is in the position shown in FIG. 5 of the drawing to impact against and thus propel the partially formed can end from the corresponding tooling. The structure of kicker mechanisms 56 and the operation thereof in the foregoing manner will be best understood with reference to FIGS. 9–11 of the drawing. As seen in these Figures, each kicker mechanism includes a kicker bar member 116 supported for reciprocation in horizontal plane 98 by means of a corresponding guide assembly 118 mounted on cover plate 67. It will be appreciated that kicker bar members 116 are of a different axial length to take into account the lateral offset between the pairs of tooling in the direction between sides 20 and 22 of the press. Each kicker bar member 116 is aligned with the axis of a corresponding one of the tooling sets, transverse to the direction of feed of sheet S between the upper and lower tooling. Further, each kicker bar has an inner end 120 of nylon or the like which, when in the actuated position as shown in FIGS. 9 and 11, extends radially inwardly across the adjacent side of lift out component 86 of the corresponding die set.

Each kicker bar member 116 has an outer end pivotally interconnected by means of a linkage assembly 122 with the upper end of a corresponding actuating lever assembly 124. The lower ends of lever assemblies 124 are pivotal on a rod 126 mounted on lower portion 14 of the press frame against rotation by means of pin support plates 128 at opposite ends thereof. Each actuating levering assembly 124 has a biasing mechanism 130 associated therewith which includes a housing 132 supporting a reciprocable plunger 134 biased toward the corresponding lever assembly 124 by a coil spring within housing 132, and the biasing force of which spring is adapted to be adjusted by means of a rotatable adjusting knob 136 mounted on housing 132. Housing 132 includes a support arm 138 pivotally interengaged with rod 126 to supported the biasing mechanism relative to actuating lever assembly 124. A pawl support 140 is clamped on rod 126 and supports a pivotal pawl member 142 which is adapted to engage a shoulder 143 on support arm 138 to facilitate releasing the biasing mechanism and lever assembly for pivotal movement about rod 126 outwardly of the press. The outer end of plunger member 134 has a nose portion 134*a* engaging against a plate 144 on the actuating lever assembly, and it will be appreciated that the biasing mechanism exerts a biasing force against the actuating lever assembly in the direction to bias the corresponding kicker bar member 116 radially inwardly of the press tooling.

Each actuating lever assembly 124 is provided with a cam block 146 having a cam track including a steep ramp portion 148, and a corresponding cam follower roller 150 is mounted on slide 16 by means of a support bracket arrangement 152 for movement along the cam track in response to reciprocation of the slide. Bracket assembly 152 includes a bracket plate 154 and a support plate 156 on which the corresponding roller 150 is mounted. Plate 156 is mounted on plate 154 by means of fasteners 158 extending through a vertical slot in plate 156, whereby plate 156 and thus the corresponding roller 150 is vertically adjustable relative to slide 16 in order to coordinate operation of the kicker member assembly therewith.

Figure 9:
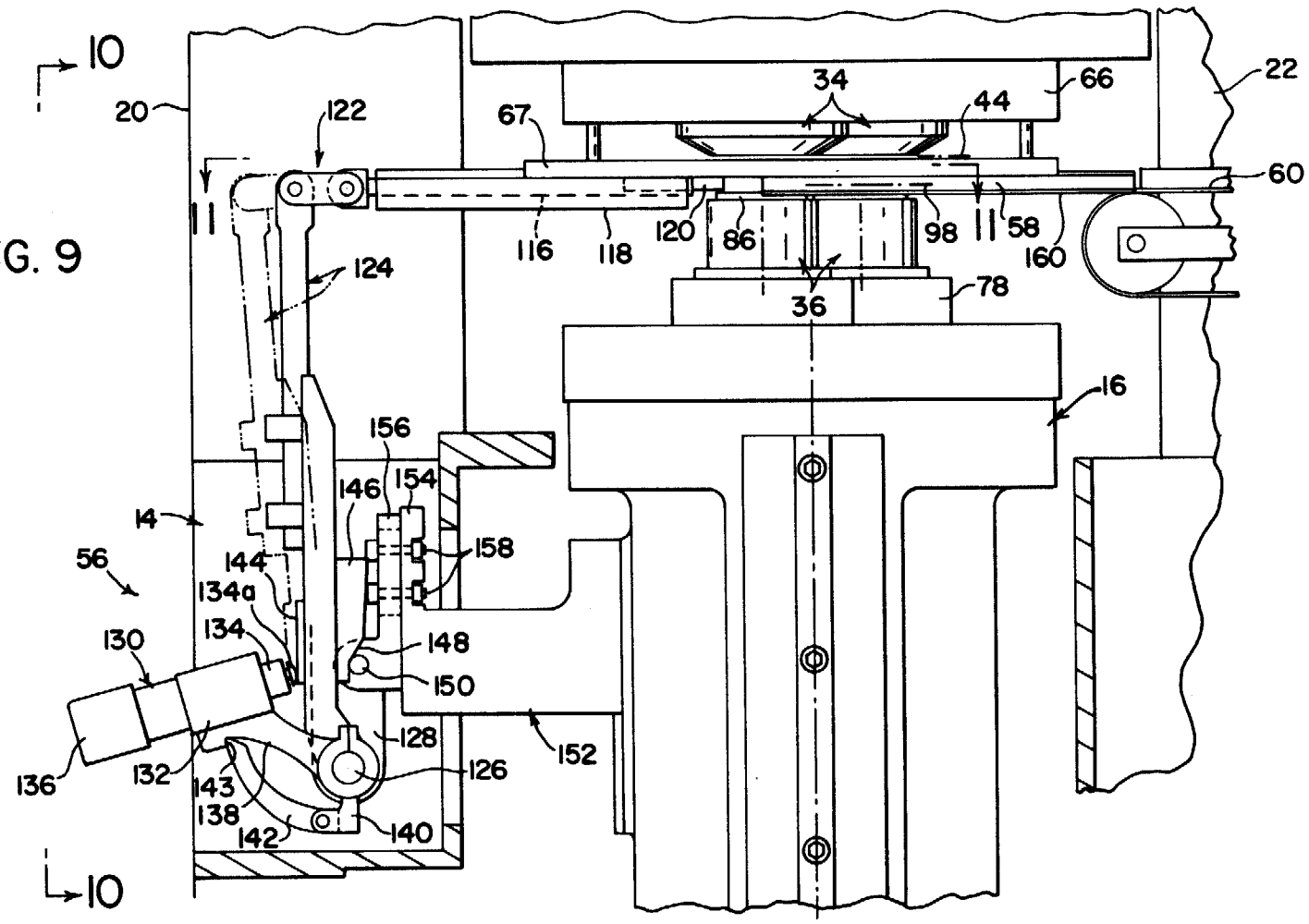
FIG. 9 is an elevation view, partially in section, of a portion of the slide and press frame showing the kicker mechanism for propelling partially formed can ends from the die area.

From the foregoing description of the operation of the pairs of upper and lower tooling, it will be appreciated from FIG. 9 of the drawing that upward movement of slide 16 to displace lower tooling 36 into cooperable interengagement with upper tooling 34 causes follower rollers 150 to engage ramp portion 148 of the corresponding cam track, thus to displace actuating lever assembly 124 counterclockwise to the broken line position thereof. Accordingly, the inner end of the corresponding kicker bar member 116 is displaced outwardly relative to the corresponding tooling to the position thereof shown by broken lines in FIG. 11. Such displacement of actuating lever assemblies 124 is against the bias of the spring in the corresponding biasing mechanism and, following the operation of the tooling to partially form a can end, slide 16 descends for the partially formed can end to be positioned in horizontal plane 98 as described hereinabove. At this time, follower roller 150 reaches ramp portion 148 of the corresponding cam track, whereby biasing mechanism 130 operates to pivot actuating lever assembly 124 clockwise with sufficient velocity for end 120 of kicker bar 116 to impact against and propel the partially formed can end from the lift out component of the lower tooling. More particularly, the incline of ramp portion 148 of the cam track together with the velocity of the slide provide for quick actuation of the kicker mechanisms to assure that the latter operate to impact against and propel the partially formed can ends as opposed to engaging and pushing the can ends.

Figure 12:
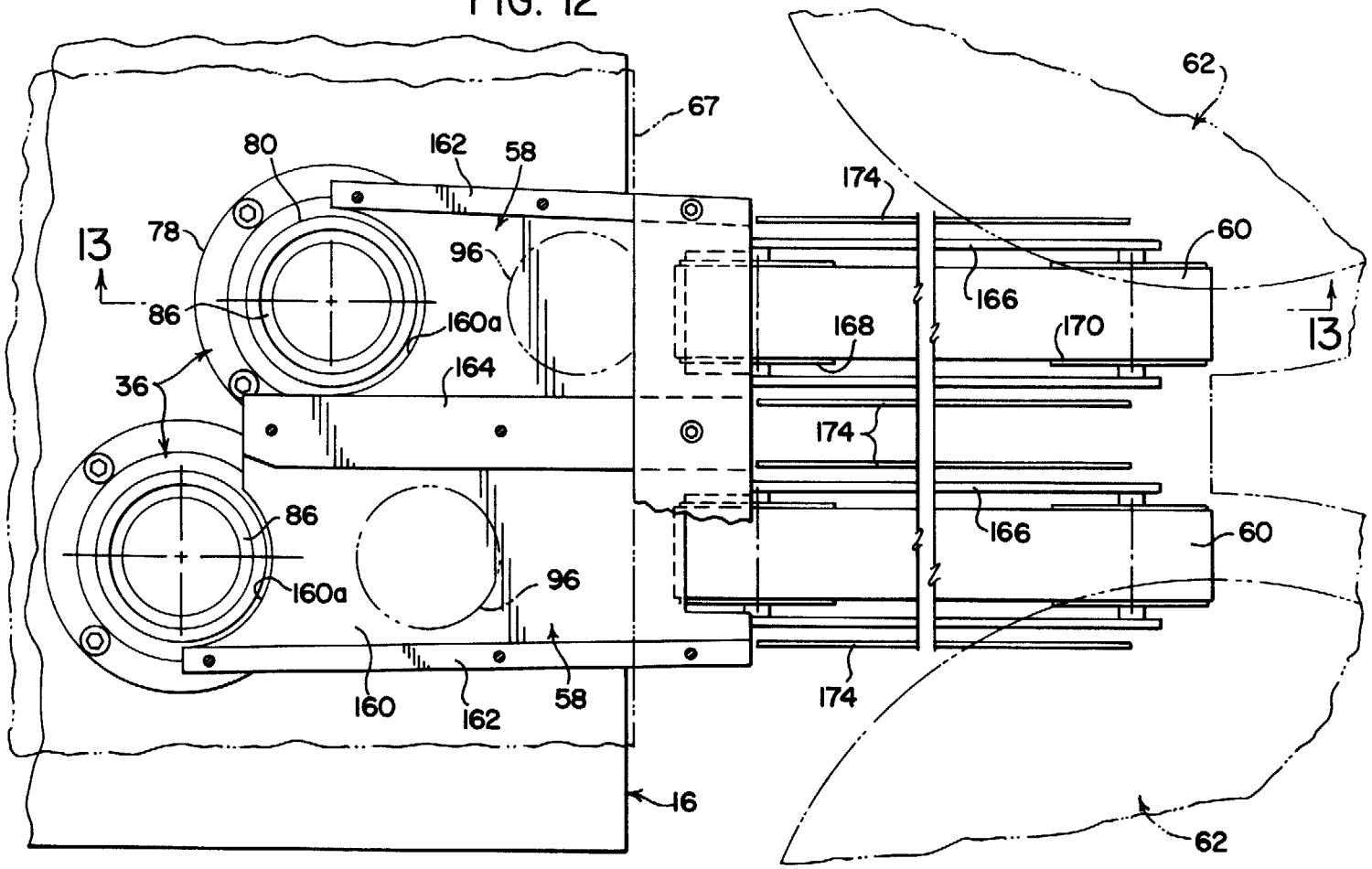
FIG. 12 is a plan view showing the guide chutes and conveyors between the die sets and curling machines.
Figure 13:
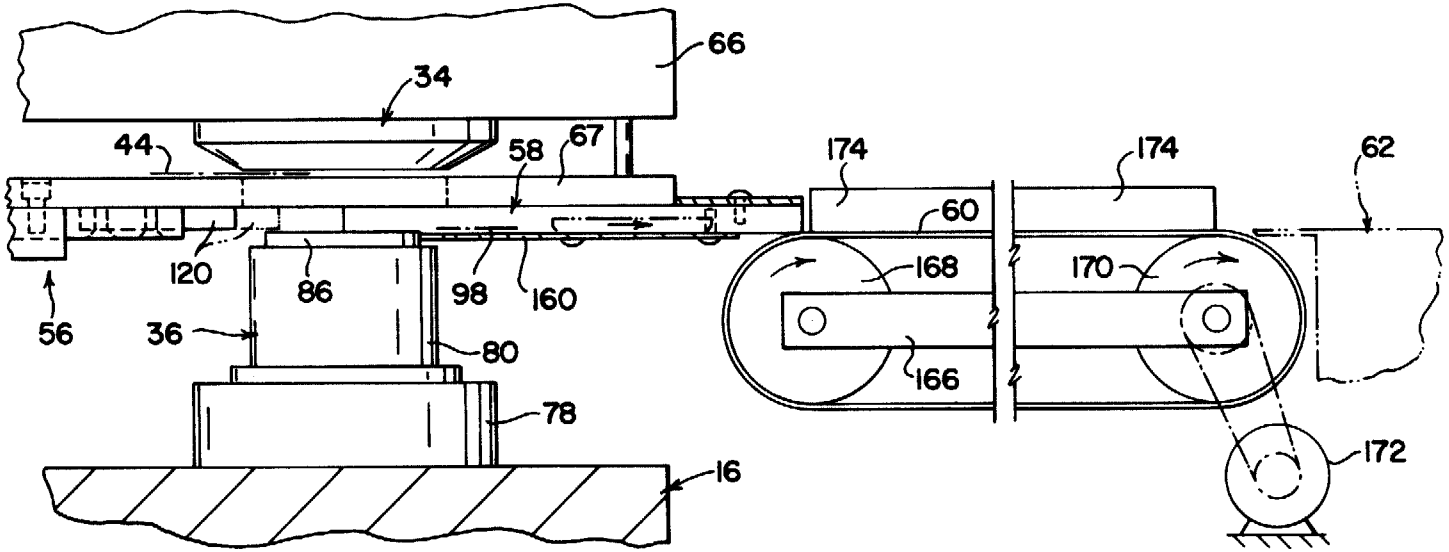
FIG. 13 is a sectional elevation view taken along line 13—13 in FIG. 12.
Figure 14:
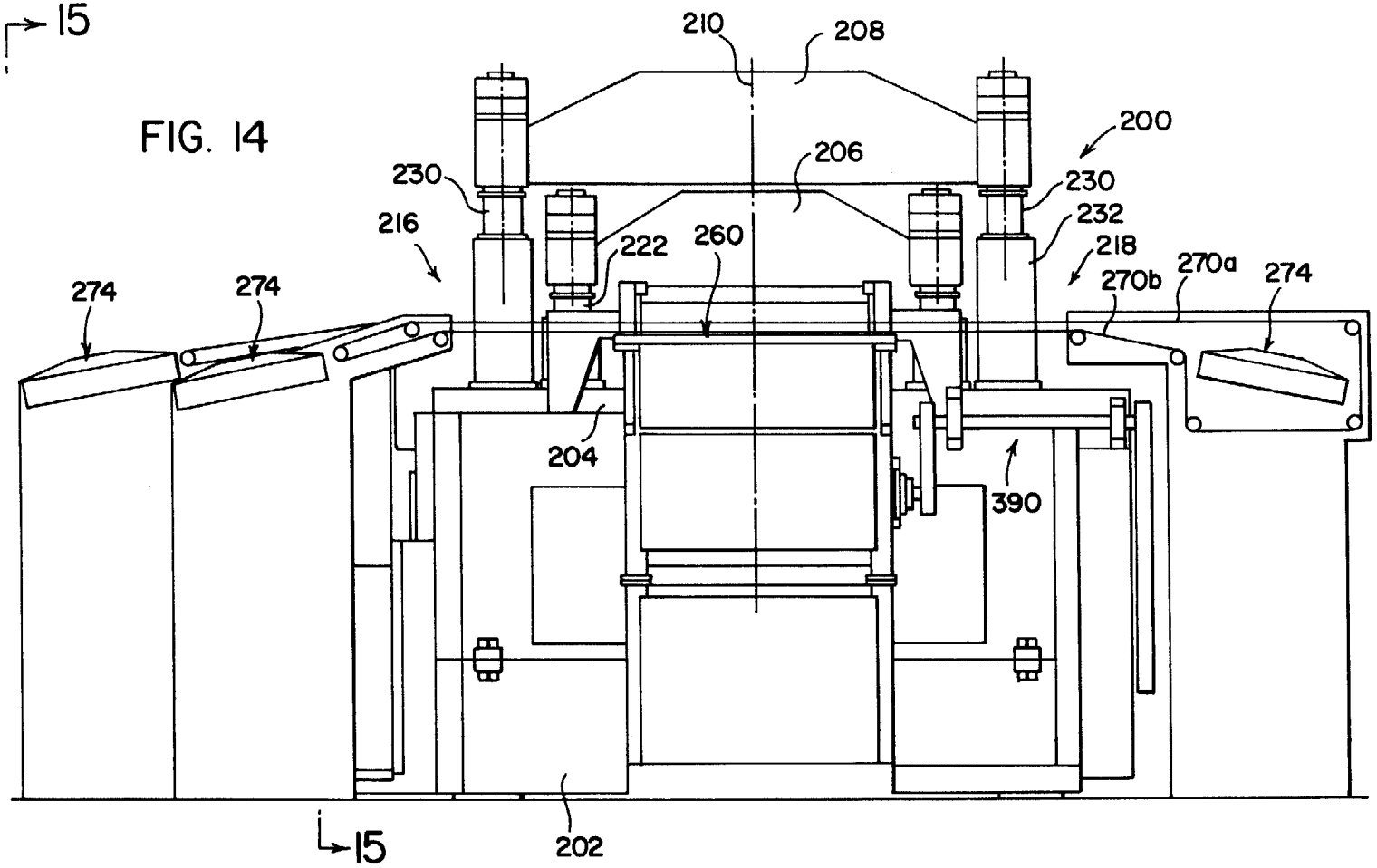
FIG. 14 is a side elevation view of another embodiment of can end making apparatus according to the present invention.
Figure 15:
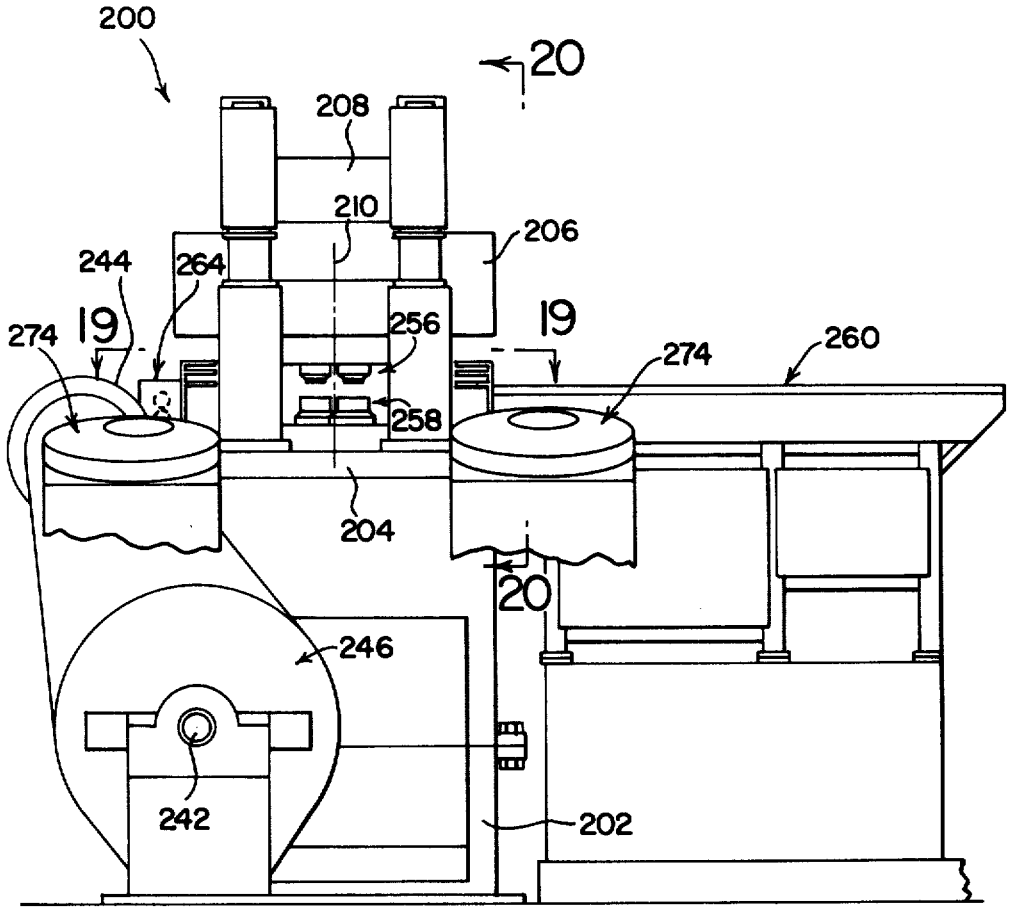
FIG. 15 is an end elevation view of the apparatus looking in the direction of line 15—15 in FIG. 14.
Figure 16:
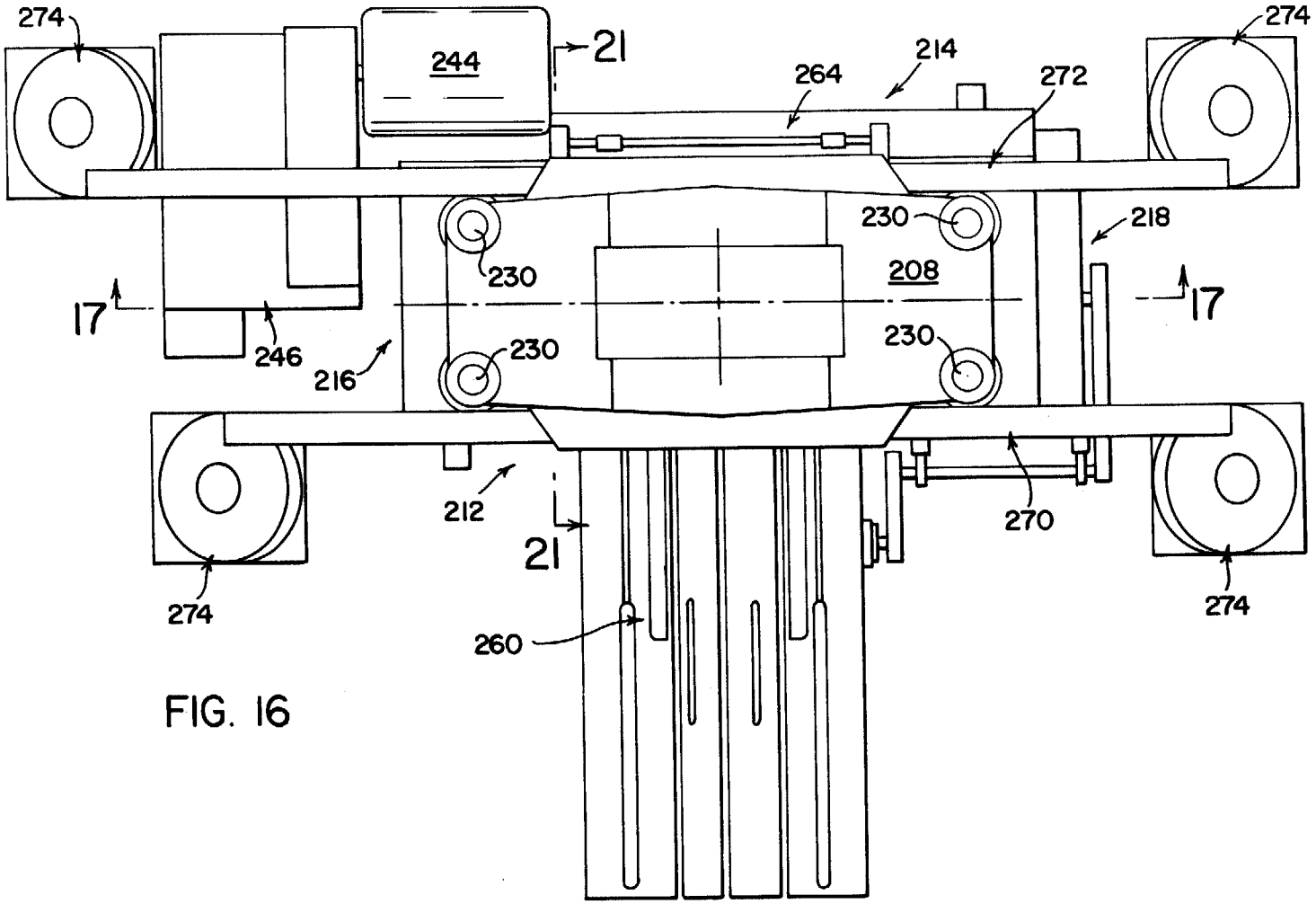
FIG. 16 is a plan view of the apparatus.

As further mentioned hereinabove, the partially formed can ends are propelled from the tooling into corresponding guide chutes 58 leading to corresponding endless conveyor belts 60 by which the partially formed can ends are conveyed to the entrance ends of curling machines 62. The guide chutes and conveyor arrangements from this purpose are illustrated in FIGS. 12 and 13 of the drawing. With reference to the latter Figures, guide chutes 58 are defined by a floor plate 160 having an upper surface in horizontal plane 98 and mounted beneath cover plate 67 by means of corresponding side rails 162 and a common center rail 164. The guide chutes extend inwardly of the tooling area, and floor plate 160 is provided with arcuate edges 160*a* adjacent the periphery of the upper tooling 34 on the sides thereof opposite kicker assemblies 56. Edges 160*a* together with side rails 162, center rail 164 and the overlying portions of cover plate 67 provide each of the guide chutes with an entrance end adjacent the tooling. Each of the guide chutes has an exit end opening onto the upper run of the corresponding conveyor belt 60, whereby partially formed can ends propelled by the corresponding kicker mechanism slide along the corresponding portion of floor plate 160 onto the conveyor belt. The conveyor belts 60 are supported on the press frame by a common support bracket assembly 166 and include corresponding idler wheels 168 at the entrance ends thereof and driven wheels 170 at the discharge ends thereof. Wheels 170 are driven by a common electric motor 172 through a sprocket wheel and drive chain arrangement, not designated numerically. Further, each conveyor belt is laterally bounded along the length thereof by pairs of upright walls 174 to laterally confine a partially formed can end being conveyed thereby. It will be appreciated that the impacting force against partially formed can ends by kicker mechanisms 56 is sufficient to propel the can ends along the corresponding guide chute 58 onto the entrance end of the corresponding conveyor belt 60, and that drive motor 172 operates to drive the conveyor belts at a speed coordinated with the press and curling machine operations.

It is believed that the operation of the apparatus in producing can ends will be apparent from the foregoing description. Briefly, in this respect, however, sheet material S is stepped into the press in the direction from side 24 toward side 26 thereof each time slide 16 is in that portion of its stroke providing for upper and lower sets of tooling 34 and 36 to be spaced apart, such stepping being a distance sufficient to present uncut material between the tooling sets. During movement of slide 16 upwardly towards crown 12 of the press frame and through its work stroke, each set of upper and lower tooling 34 and 36 cooperatively interengage as described herein to cut a circular blank from sheet S and shape the blank to provide a partially formed can end including a central panel and the peripheral upstanding skirt. Upon downward movement of slide 16 following such blanking and forming operations, each of the lower tooling assemblies carries the corresponding partially formed can end therewith downwardly to horizontal plane 98 beneath feed path 44 for the sheet material. The partially formed can end is positioned in plane 98 by actuation of lift out component 86 of the lower tooling assembly during downward movement of the slide and, as the slide approaches its lowermost position and while the partially formed can end is supported in plane 98, the stored energy in kicker member assemblies 56 is released for the inner ends of the kicker bar members to impact against the partially formed can end supported by the corresponding lower tooling assembly. Thus, the partially formed can ends are propelled through the corresponding guide chute 58 and onto the entrance end of the corresponding conveyor belt 60, such kicking and conveying being transverse to the direction of feed of sheet S through the press. The partially formed can ends are then conveyed to the corresponding curling machine 62 which, in a well known manner, forms a curl on the free edge of the skirt portion to complete the can end. During the subsequent upward movement of slide 16, lift out components 86 of lower tooling assemblies 36 are retracted and the kicker bars of kicker assemblies 56 are retracted storing energy for subsequent operation thereof, both such retractions taking place before the upper and lower tooling interengage with sheet S therebetween to perform the next blanking and forming operation.

FIGS. 14–28 illustrate another embodiment of can end making apparatus in according with the present invention which, as seen in FIGS. 14–18, includes an underdriven, double action press 200 including a press frame having a lower portion 202 providing a press bed 204, and first and second slides 206 and 208, respectively, each reciprocable toward and away from bed 204 along a corresponding slide path having a common axis 210. Press 200 has opposite sides 212 and 214 and opposite ends 216 and 218, and it will be appreciated that slides 206 and 208 have corresponding opposite sides and opposite ends with respect to the sides and end of the press.

Figure 17:
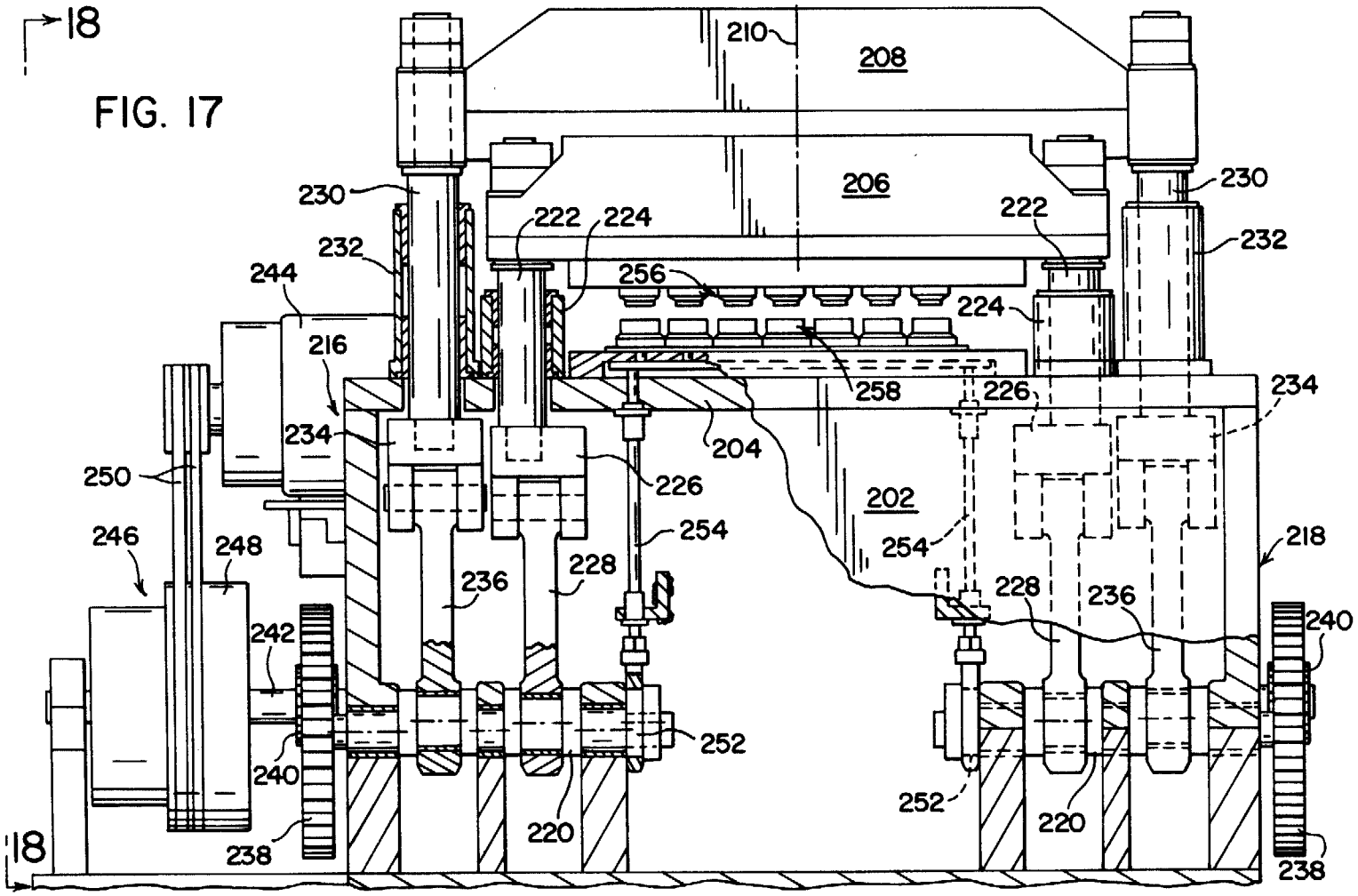
FIG. 17 is a sectional elevation view taken along line 17—17 in FIG. 16 and showing the slide guide and drive arrangement.
Figure 18:
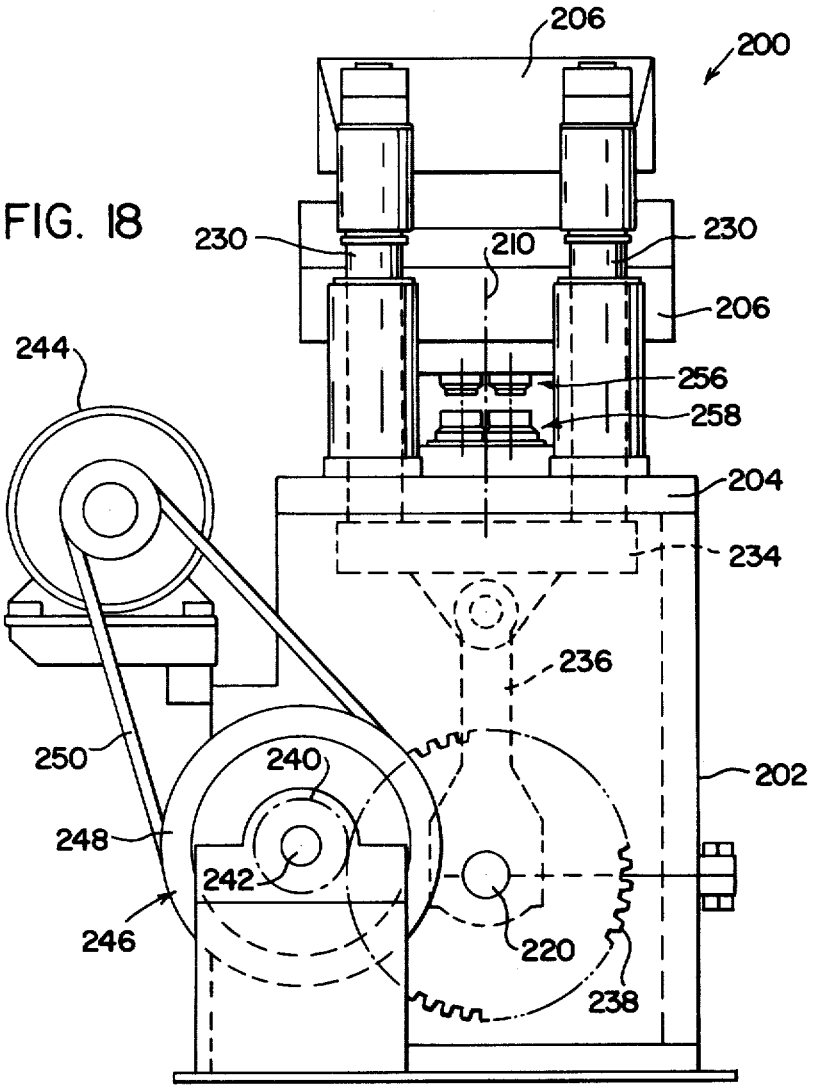
FIG. 18 is an end elevation view taken along line 18—18 in FIG. 17.

As best seen in FIGS. 17 and 18, lower portion 202 of the press frame supports two double throw crankshafts 220, one at each end of the lower portion of the frame and each extending in the direction between ends 216 and 218 of the press. Slide 206 is connected at each of its opposite ends to a pair of vertical drive posts 222 guided for vertical reciprocation by corresponding guide sleeves 224 mounted on bed 204. Posts 222 extend through sleeves 224 and the press bed into lower portion 202 of the frame, and the posts 222 at each end of slide 206 are connected to drive plates 226 which are interconnected with corresponding ones of the throws of crankshafts 220 by means of a corresponding connecting rod 228. Similarly, each of the opposite ends of slide 208 is connected to a pair of drive posts 230 extending through corresponding guide sleeves 232 on the press bed and into lower portion 202 of the press frame for connection with a corresponding drive plate 234. Drive plates 234 are interconnected with the others of the throws of crankshafts 220 by means of a corresponding connecting rod 236. Accordingly, it will be appreciated that rotation of crankshafts 220 imparts reciprocation to slides 206 and 208, the length of the strokes of which are determined by the radial offset of the corresponding crankshaft throw, and the coordination of which strokes relative to one another is determined by the angular relationship of the two throws on each shaft to one another with respect to the crankshaft axis. Each of the crankshafts 220 is provided on its outer end with a drive gear 238 in meshing engagement with a corresponding drive pinion 240, which pinions 240 are mounted on opposite ends of a pinion shaft 242 rotatably supported by the press frame and having a driven end adjacent end 216 of the press. A drive motor 244 for the press is drivingly interconnected with the driven end of shaft 242 by means of a selectively operable brake and clutch unit 246 including a flywheel 248 driven by motor 244 through endless belts 250 therebetween. As further seen in FIG. 17, the inner end of each crankshaft 220 is provided with a cam 252 for vertically displacing a corresponding lift out rod 254 having an upper end extending through press bed 204 for the purpose set forth hereinafter.

Figure 19:
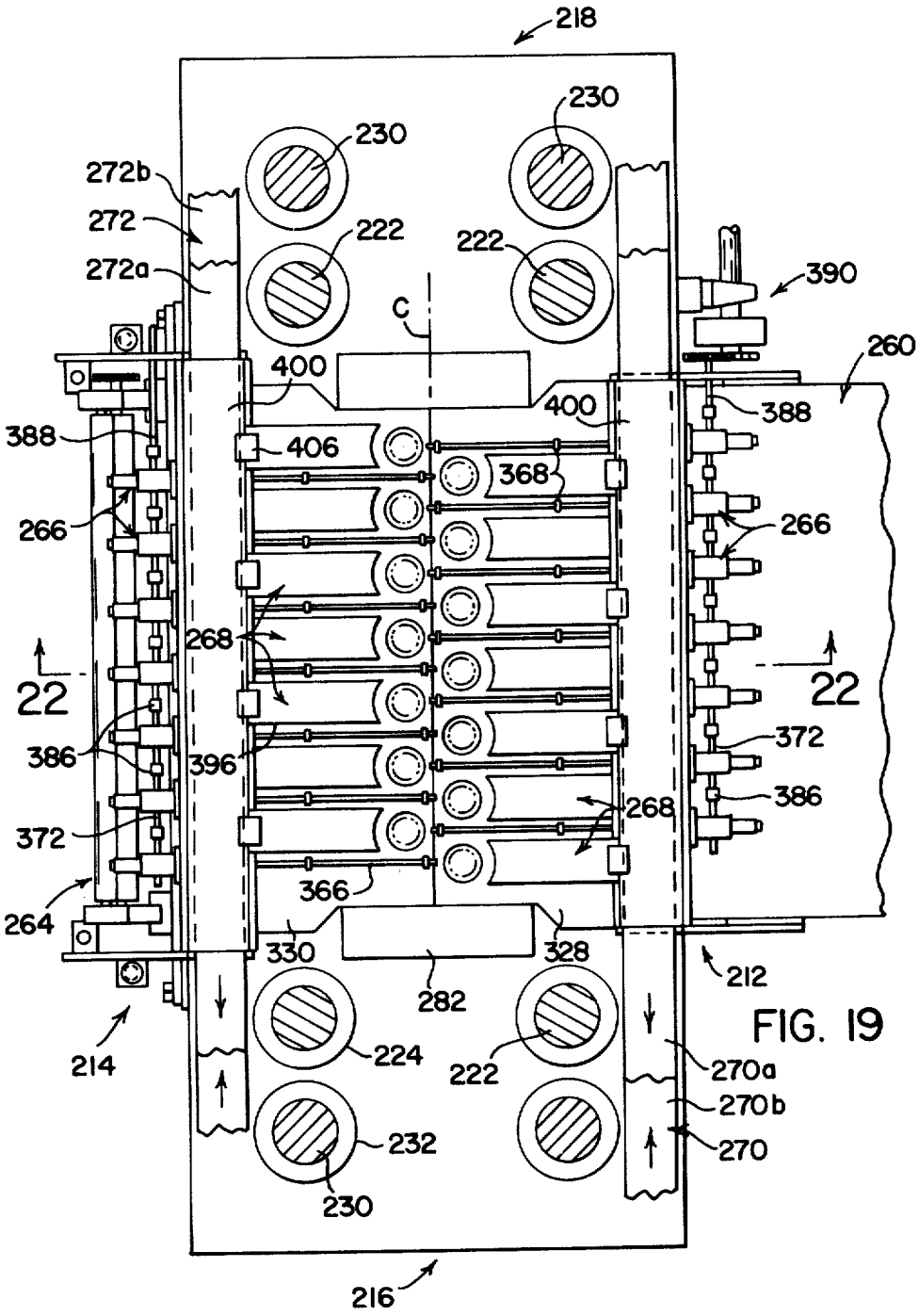
FIG. 19 is a plan view of the apparatus taken along line 19—19 in FIG. 15.
Figure 20:
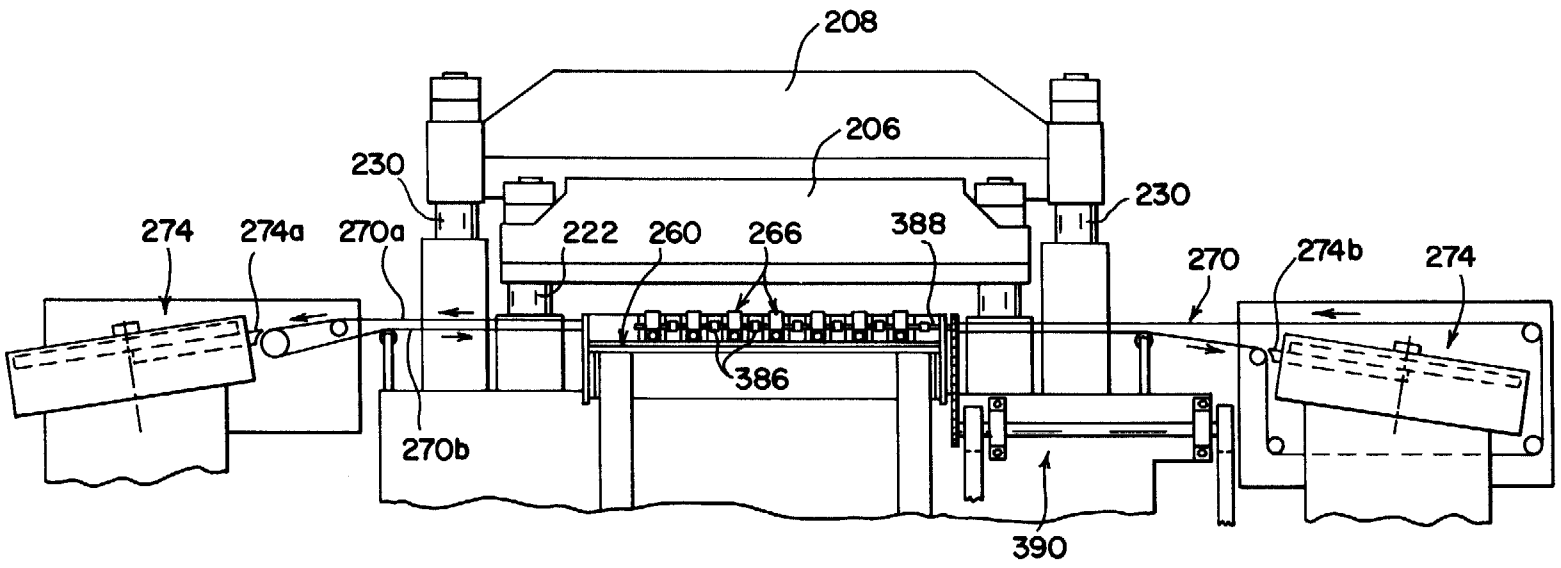
FIG. 20 is a side elevation view of a portion of the apparatus taken along line 20—20 in FIG. 15.
Figure 21:
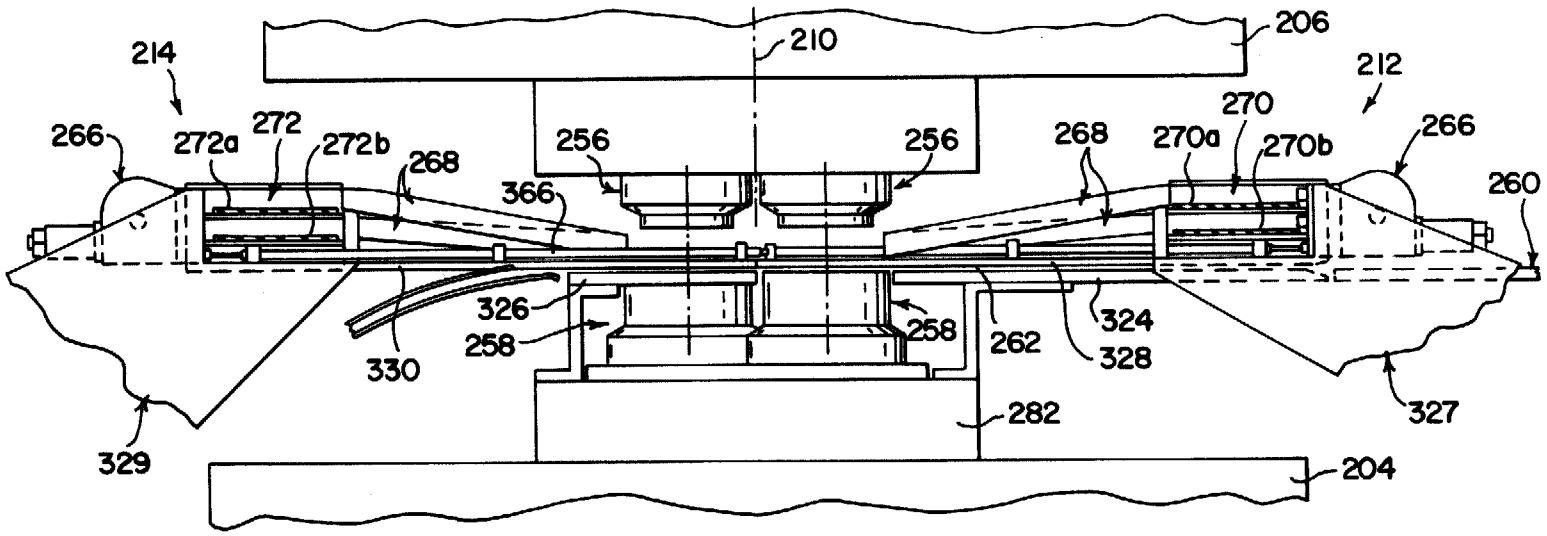
FIG. 21 is an end elevation view of a portion of the apparatus taken along line 21—21 in FIG. 16.

Referring again to FIGS. 14–16, together with FIGS. 19–21, press bed 204 and slides 206 and 208 support a plurality of opposed pairs of tooling, each pair including upper and lower tooling 256 and 258, respectively. As will be appreciated from FIG. 19, adjacent ones of the tooling pairs are offset from one another in the direction between the opposite ends of the slides and in the direction between the opposite sides of the slides, providing two rows of tooling on opposite sides of a center line C between the ends of the slides. In the embodiment illustrated, fourteen such opposed pairs of tooling are provided and, as will become apparent hereinafter, each pair is cooperable to blank and partially form a can end from sheet material interposed therebetween, whereby fourteen partially formed can ends are produced during each work stroke of the press. Sheet material to be blanked and formed in the press is adapted to be fed therethrough in the direction from side 212 toward side 214 and, for this purpose, a sheet feeding mechanism 260 is supported adjacent side 212 for feeding sheet material step-by-step through the press in coordination with the operation of slides 206 and 208 and along a horizontal feed path 262. Feed mechanism 260 may, for example, be a reciprocating feed fingertype sheet feeder similar to that shown in connection with the embodiment of FIGS. 1–13. The opposite side of the press, namely side 214, is provided with a roll type scrap discharge mechanism 264 operable in the manner described hereinabove with regard to the embodiment of FIGS. 1–13 to achieve discharge of the scrap metal of a sheet fed through the press after the last blanking and forming operation has been performed with respect thereto.

In accordance with the present embodiment, kicker mechanisms 266 corresponding in number to the number of pairs of opposed tooling are supported on opposite sides 212 and 214 of the press. As described more fully hereinafter, each kicker mechanism is in alignment with a tool set located relative thereto on the far side of centerline C of the slides. As explained in detail hereinafter, lower tooling 258 is operable to position a partially formed can end in a horizontal plane above feed path 262, and each kicker mechanism 266 is operable to impact against and propel a partially formed can end from the corresponding tooling and into a corresponding guide chute 268 leading toward the opposite side of the press. Further in accordance with the present embodiment, an endless belt type conveyor 270 is supported adjacent side 212 of the press and has upper and lower runs **270*a* and 270*b*, respectively, extending in the direction between opposite ends 216 and 218 of the press. Similarly, an endless belt type conveyor 272 is supported adjacent side 214 of the press and has upper and lower runs 272*a* and 272*b*, respectively, extending in the direction between the opposite ends of the press. Each conveyor belt is adapted to be continuously driven such as by a corresponding electric motor, not illustrated, and it will be appreciated that the upper and lower runs thereof move in opposite directions with respect to the opposite ends of the press, such as indicated by arrows associated with belt 270 in FIG. 20. The upper and lower run of each belt has a curling machine 274 associated therewith at a location adjacent the corresponding end of the press with respect to the direction of travel of the belt run. Each curling machine has an entrance adjacent the belt run for receiving partially formed can ends, as indicated by numerals 274*a* and 274*b* in FIG. 20 for upper and lower runs 270*a* and 270*b* of belt 270. Adjacent ones of the guide chutes 268 associated with conveyor belt 270 are oriented to direct partially formed can ends onto a different one of the upper and lower runs 270*a* and 270*b* thereof and, similarly, adjacent ones of the guide chutes associated with belt 272 are oriented to deliver can ends onto a different one of the runs 272*a* and 272*b* thereof. Accordingly, during each cycle of operation of the press the runs of each conveyor belt transfer partially formed can ends to the corresponding curling machine for completion of the can ends. Each of the curling machines is adapted to be suitably supported relative to the press and driven by a corresponding electric motor, not illustrated, in a manner similar to that described in connection with the embodiments of FIGS. 1–13**.

Figure 22A:
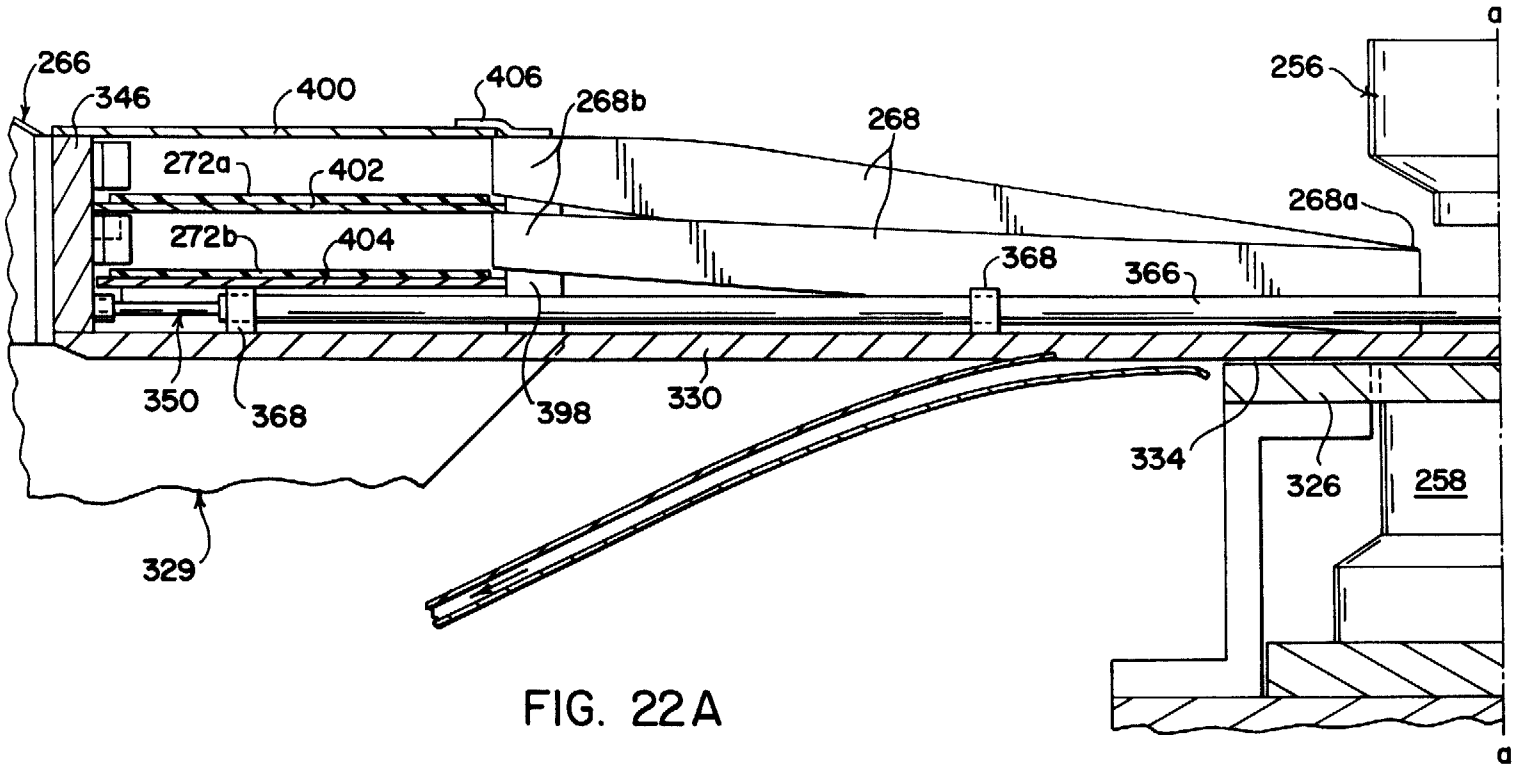
FIG. 22A-C is a detailed sectional elevation view taken along line 22—22 in FIG. 19 and showing the tooling structure and the structural interrelationship therewith with the corresponding kicker mechanism and guide chute.
Figure 22B:
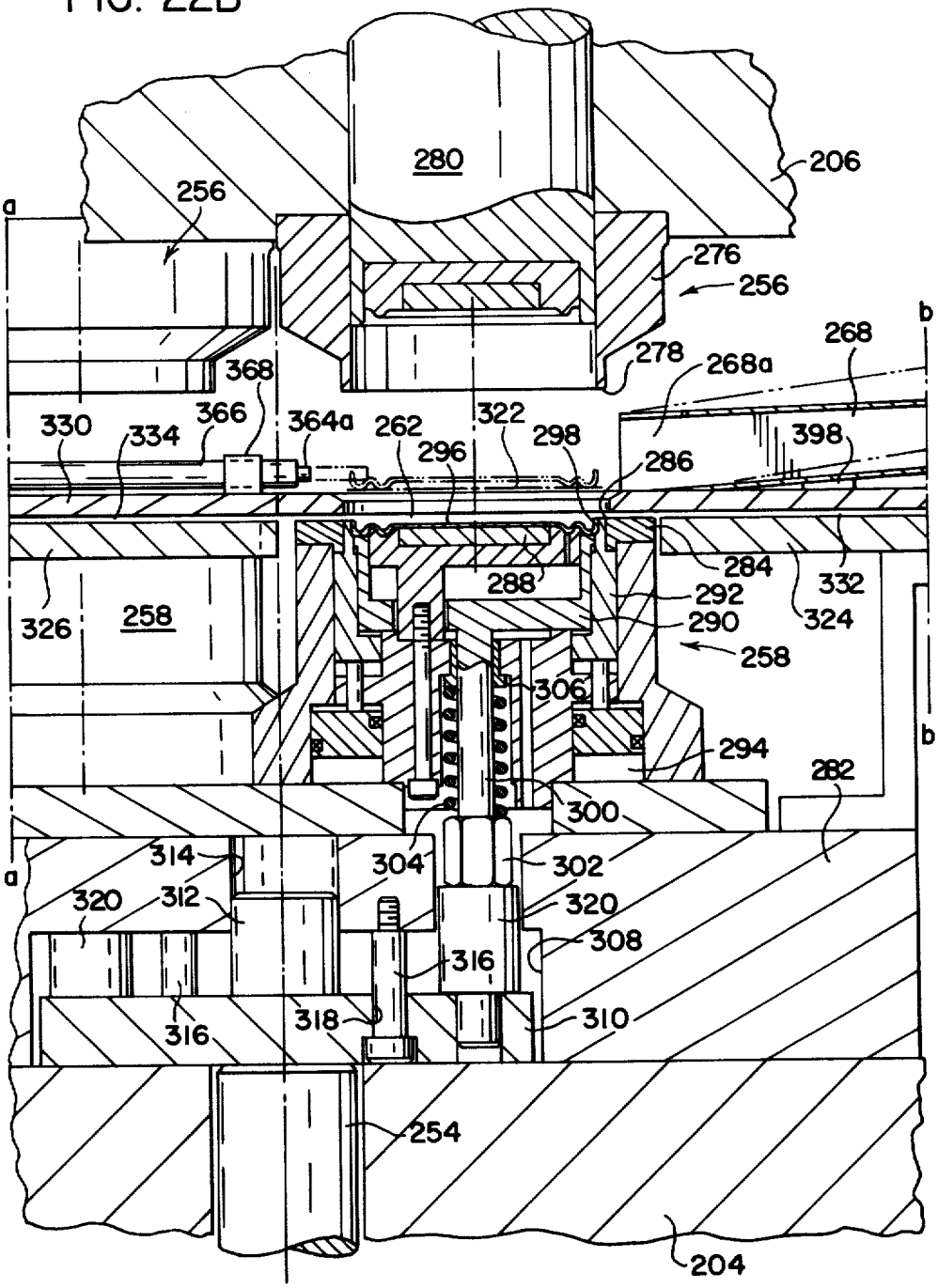

The structure and operation of each tooling set as defined by upper tooling 256 and the corresponding opposed lower tooling 258 is identical, as is the structure and operation of kicker mechanism 266 and the structural interrelationship of guide chutes 268 with the corresponding tooling set. Accordingly, it will be appreciated that the following description of FIG. 22B showing one tool set and the corresponding kicker mechanism and guide chute is applicable to each such combination of components shown in FIGS. 19–21, such combination of components differing only in their orientation with respect to opposite sides of the press. With regard first to the tooling, it will be seen from FIG. 22B that upper tooling 256 includes a blanking and holding ring 276 mounted on slide 206 for displacement therewith and providing an annular cutting edge 278. The upper tooling further includes a forming plunger 280 slidably received within ring component 276 and mounted on slide 208 for displacement therewith and relative to ring component 276. Lower tooling 258 is mounted on press bed 204 by means of a tool support plate 282 and includes an annular cutter component 284 providing a cutting edge 286 cooperable with cutting edge 278 of upper tooling to cut a circular blank from sheet material interposed therebetween during operation of the press. The lower tooling further includes a central forming component 288 fixed relative to support block 282 and immediately surrounded by a lift out component 290 which is axially reciprocable relative thereto. Lift out component 290 is surrounded by a forming sleeve 292 which is axially displaceable relative to forming component 288 against a pneumatic bias achieved by air under pressure in a chamber 294 therebehind. The upper surfaces of forming component 288 and lift out component 290 and the inner surface of forming sleeve 292 cooperate with the lower face of forming plunger 280 of upper tooling 256 during interengagement of the tooling to shape the circular blank so as to partially form a can end having a central panel portion 296 bounded by an upstanding peripheral skirt 298. Lift out component 290 of the lower tooling includes an actuating stem 300 having a lower end provided with a nut 302, and the lift out component is biased downwardly to the position thereof shown in FIG. 22B by means of a coil spring 304 surrounding stem 300 between nut 302 and a shoulder provided by a guide sleeve 306 through which the stem extends.

Tool support plate 282 is of a length in the direction between the opposite ends of the press to support all fourteen of the lower tool assemblies 258 and is provided on its under side with a lift out actuator plate recess 308 extending between the opposite ends thereof. Recess 308 receives an actuator plate 310 having portions adjacent its opposite ends each overlying one of the lift out rods 254 described hereinabove in connection with FIG. 17 of the drawing. Vertical reciprocation of actuator plate 310 is guided by means of guide posts 312 mounted on the upper surface thereof and received in corresponding guide openings 314 in support plate 282, only one of which is seen in FIG. 22B, and by headed bolts 316 fastened to support plate 282 and extending through openings 318 in actuator plate 310. Actuating plate 310 is provided with an actuator pin 320 for each tooling assembly, each pin 320 underlying nut 302 on stem 300 of the lift out component 290 of the corresponding tooling. Accordingly, it will be appreciated that upward displacement of actuating plate 310 from the position thereof shown in FIG. 22B displaces lift out component 290 upwardly relative to forming component 288 against the bias of spring 304, and that subsequent movement of actuating plate 310 back to the position shown in FIG. 22B provides for lift out component 290 to be retracted by biasing spring 304. It will be further appreciated that such extension and retraction of lift out component 290 for each of the lower tooling assemblies is achieved simultaneously and each time the crankshaft of the press rotates for lift out rods 254 thereof to be displaced upwardly by crankshaft cams 252.

It will be appreciated that sheet material S to be blanked and formed is fed between the upper and lower tooling along feed path 262 when the upper tooling is spaced from the lower tooling as shown in FIG. 22B, and that, during downward movement of slides 206 and 208 the opposed pairs of tooling interengage to cut circular blanks from the sheet material and from the blanks to the partially formed can end configuration described above and shown in FIG. 22B. During the subsequent upward movement of slides 206 and 208, crankshaft cams 252 actuate lift out rods 254 to elevate actuating plate 310, whereby lift out components 290 of the lower tooling, and thus the partially formed can ends, are elevated to the broken line position of the can end shown in FIG. 22B. In the elevated position, the partially formed can end is in a horizontal plane 322 spaced above the feed path 262, and while so positioned, the partially formed can end is propelled from the lower tooling by the corresponding kicker mechanism 266 into the entrance end of the corresponding guide chute.

As best seen in FIGS. 21 and 22A–C, a pair of support plates 324 and 326 are provided on opposite sides of the tooling sets at the level of sheet material feed line 262 and, as set forth more fully hereinafter, kicker mechanism 266 and guide chutes 268 are mounted on support bracket assemblies 327 and 329 on sides 212 and 214 of the press, respectively. Bracket assembly 327 supports a cover plate 328 overlying support plate 324, and bracket assembly 329 supports a cover plate 330 overlying support plate 326. Cover plates 328 and 330 are each spaced above the underlying support plate to provide a sheet material feed slot 332 on the feed table side and a discharge slot 334 on the discharge side, both of which slots coincide with the horizontal feed path 262 through the press. In the cross-sectional view in FIGS. 22A–B, kicker mechanism 266 associated with the upper and lower tooling shown is mounted on the discharge side of the press and thus on the bracket assembly which includes cover plate 330. As will be seen from FIGS. 19–22 in connection with the structure of a kicker mechanism 266 shown in FIGS. 23 and 24, each kicker mechanism 266 includes a housing having a bottom member 336, side members 338 spaced apart from one another and extending upright from bottom member 336, a front mounting plate 340, a spring cartridge 342 mounted on and extending rearwardly from said members 338, and a cover portion 344 overlying and closing the space between side members 338. An elongated support plate 346 is mounted on cover plate 330 of the bracket assembly referred to hereinabove and extends therealong to support each of the kicker assemblies on the corresponding side of the press and, in this respect, each kicker assembly is mounted on support plate 346 by means of threaded fasteners 348 extending through mounting plate 340 and into support plate 346. Plate 346 is laterally outwardly adjacent the corresponding conveyor of the apparatus, and each kicker mechanism further includes a horizontally reciprocable kicker rod member 350 extending from the kicker mechanism housing beneath the lower run of the conveyor and inwardly toward the corresponding set of tooling in alignment with the axis thereof. More particularly, outer end 352 of the kicker rod member extends through an opening 354 therefor in bottom member 336 of the housing and through corresponding openings in mounting plate 340 and support plate 346, not designated numerically. Opening 354 provides support and guidance for inner end 352 of the kicker rod, and the inner end of the rod terminates in a cam follower block 356 slidably supported on bottom member 336 and between side members 338 of the housing. Spring cartridge 342 includes a coil spring 358 between end face 360 of follower block 356 and a threaded plug 362 received in the outer end of the cartridge housing, which spring biases the kicker rod member inwardly of the press toward the corresponding tooling. Inner end 364 of kicker rod member 350 extends through a guide tube 366 mounted on cover plate 330 by means of mounting brackets 368, and the innermost end 364*a* of the kicker rod member is adapted to be displaced relative to the corresponding tooling assembly between the solid line and broken line positions thereof shown in FIG. 22B.

Figure 23:
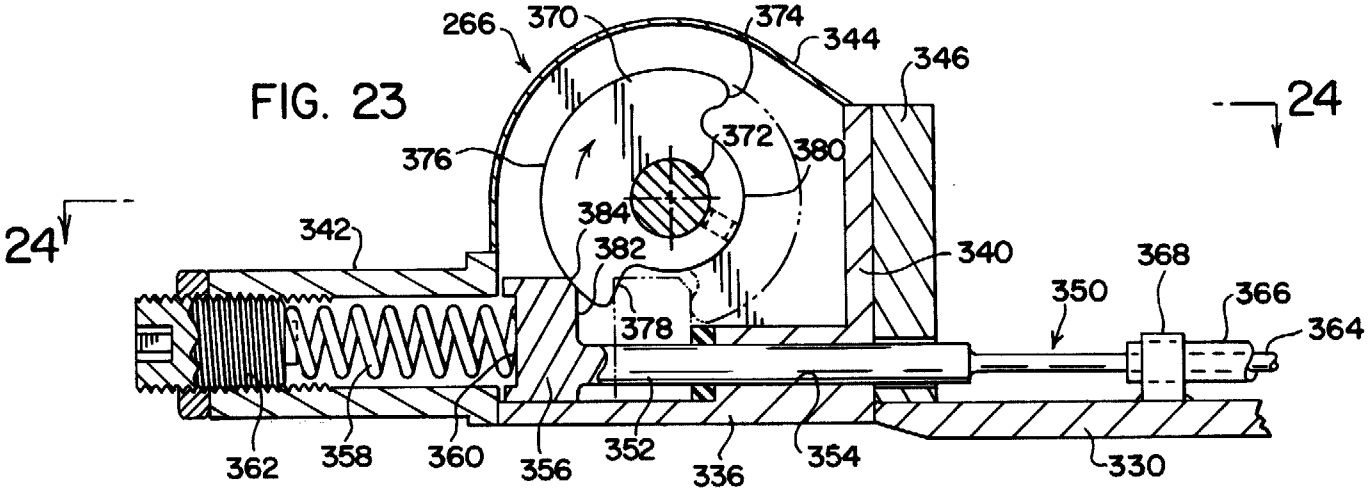
FIG. 23 is a cross-sectional elevation view showing the structure of the kicker mechanism.
Figure 24:
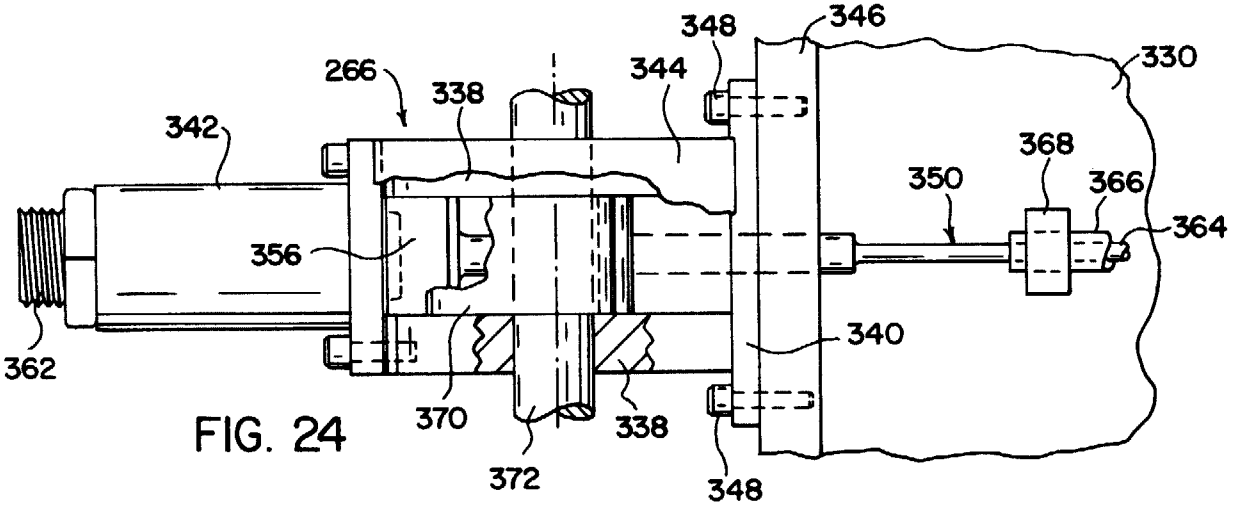
FIG. 24 is a plan view in section of the kicker mechanism taken along line 24—24 in FIG. 23.

Each kicker mechanism 266 further includes a cam 370 mounted on a corresponding camshaft 372 extending through and supported for rotation by side members 338 of the kicker mechanism housing. Cam 370 includes a nose portion 374 with respect to the direction of rotation thereof which, in FIG. 23 is clockwise, and a keeper surface portion 376 following nose 374 with respect to the direction of rotation. Surface 376 terminates in a dropoff shoulder 378 circumferentially spaced from nose 374, and the remainder of the cam is defined by an inoperative surface 380 between shoulder 378 and nose 374. Follower block 356 of the kicker rod member is provided with a front face 382 having a beveled upper edge 384, which front face and beveled edge are cooperable with cam 370 to achieve actuation of the kicker rod member. In this respect, when the component parts in the housing of the kicker rod assembly are in the broken line positions thereof shown in FIG. 23, nose 374 engages front face 382 of follower block 356, whereby continued clockwise rotation of cam 370 causes nose 374 to displace follower block 356 and thus the kicker rod member to the left in FIG. 23 against the bias of spring 358. When nose 374 passes beveled edge 384, cam surface 376 engages the latter edge to maintain follower block 356 and thus the kicker rod member in the solid line position shown in FIG. 23 until such time as rotation of the cam moves drop-off shoulder 378 past beveled edge 384. Upon the latter movement of the cam, kicker rod member 350 is released from cam 370, whereby the stored energy of spring 358 propels the kicker rod to the right in FIG. 23. Thus, with reference to FIG. 22B, innermost end 364*a* of the kicker rod is displaced from the solid line to the broken line position thereof to impact against and propel the partially formed can end supported by lower tooling 258 into the entrance end of the corresponding guide chute 268.

It will be appreciated that all of the kicker mechanisms are operated simultaneously and, in this respect, as best seen in FIGS. 19 and 20 of the drawing, camshafts 372 of adjacent kicker mechanisms 266 on each side of the press are interconnected by suitable couplings 386. As further seen in the latter Figures, the endmost ones of the kicker mechanisms 266 with respect to end 218 of the press are coupled to a corresponding drive shaft 388 adapted to be driven in response to rotation of the crankshaft of the press through a corresponding power take-off arrangement 390 providing a drive train between the crankshaft and kicker assembly drive shafts 388. It will be appreciated, of course, that the drive trains provide for the kicker mechanism cams to rotate one revolution for each revolution of the press crankshaft, and that the profiles of the cams and their circumferential orientation relative to the corresponding kicker rod follower block 356 provide for the kicker rod members to be released to impact against and propel the partially formed can ends when the can ends are supported in plane 322 as illustrated in FIG. 22B of the drawing.

Figure 22C:
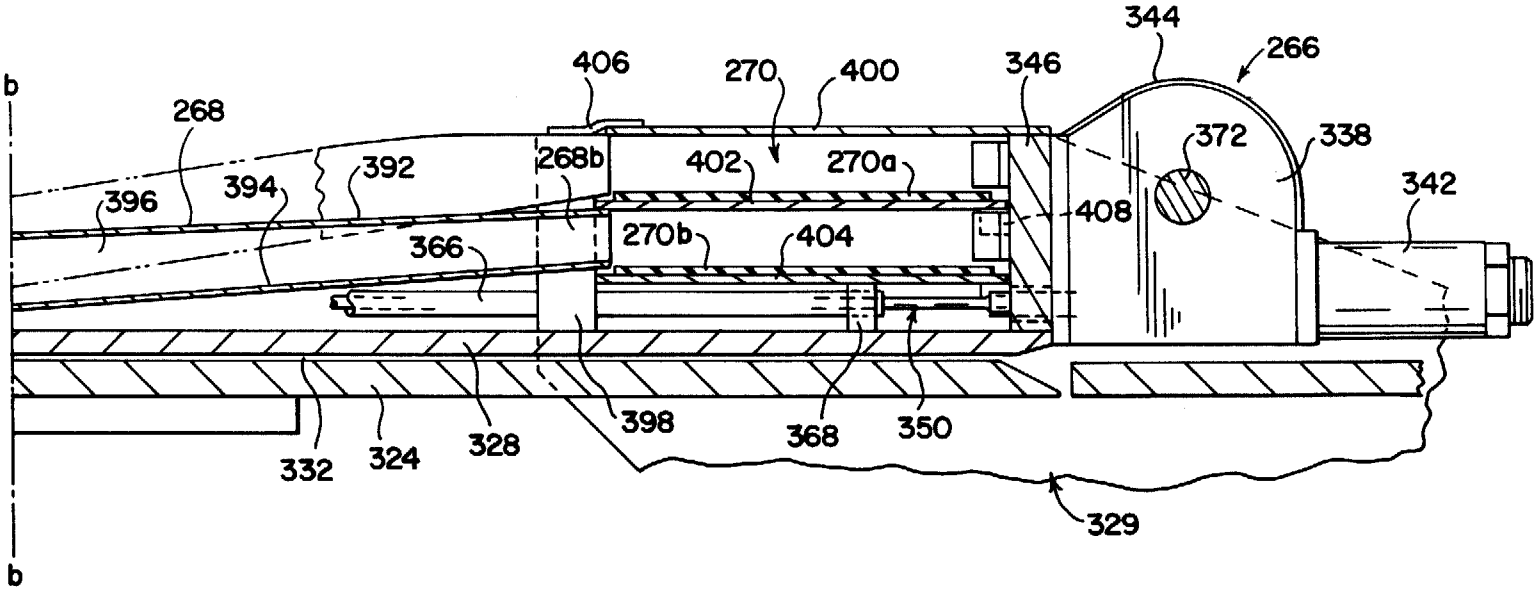

With further regard to FIGS. 19, 21 and 22, each of the guide chutes 268 is disposed on the opposite side of a set of upper and lower tooling from the corresponding kicker mechanism for the tooling. Each chute has an entrance end 268*a* peripherally adjacent the corresponding tooling set and an outlet end 268*b* opening onto one of the runs of the corresponding conveyor of the apparatus. Each guide chute is generally rectangular in cross-sectional contour and, as best seen in FIGS. 19 and 22C, includes a top wall 392, a bottom wall 394 and opposed side walls 396. The innermost ends of the top and bottom walls are arcuately recessed to enable positioning of entrance end 268*a* as close as possible to the periphery of the tooling assembly without interferring with the operation thereof. Each guide chute is mounted on the corresponding one of the cover plates 328 and 330 by brackets 398 spaced apart along the chute. As mentioned hereinabove, adjacent ones of the guide chutes extending between the tooling assemblies and a corresponding one of the conveyors 270 and 272 have their discharge ends arranged to discharge a partially formed can end onto a different one of the top and bottom runs of the conveyor. Accordingly, it will be appreciated that the discharge ends of such adjacent guide chutes are at different elevations, and that the mounting brackets therefor at the discharge ends support the latter relative to the appropriate one of the conveyor runs.

As further seen in FIG. 22, support bracket assemblies 327 and 329 each support a cover plate 400 for the corresponding upper conveyor belt run, a support plate 402 underlying the corresponding upper conveyor belt run and providing a cover plate for the lower run, and a lower support plate 404 underlying the corresponding lower belt run. Plates 400, 402 and 404 extend the full width of the support plate 346 of the corresponding bracket assembly in the direction of the conveyor belts, and the outer ends of plates 400 are suitably attached to support plate 346 of the bracket assembly. The inner ends of plates 400 are supported by the discharge ends of those guide chutes 268 which open onto the upper conveyor run by means of straps 406 fastened to the top walls of the guide chutes and plates 400. The outer ends of plates 402 are interconnected with support plate 346 by means of a mounting member 408, and the inner ends of plates 402 are supported by the guide chute support brackets 398 adjacent the discharge ends of the guide chutes. Lower plates 404 are supported at their outer ends on the corresponding one of the cover plates 328 and 330 and at their inner ends by the guide chute mounting brackets 398 adjacent the discharge ends of the guide chutes. As set forth more fully hereinafter, each of the support bracket assemblies 327 and 329 is mounted on the corresponding side of the press for displacement laterally away therefrom and, from the foregoing description of the support bracket assemblies, kicker mechanisms and guide chutes, it will be appreciated that the latter components and cover plates 328 and 330 are adapted to be displaced outwardly with the bracket assemblies thus opening the tooling area in the press for access thereto.

Figure 25:
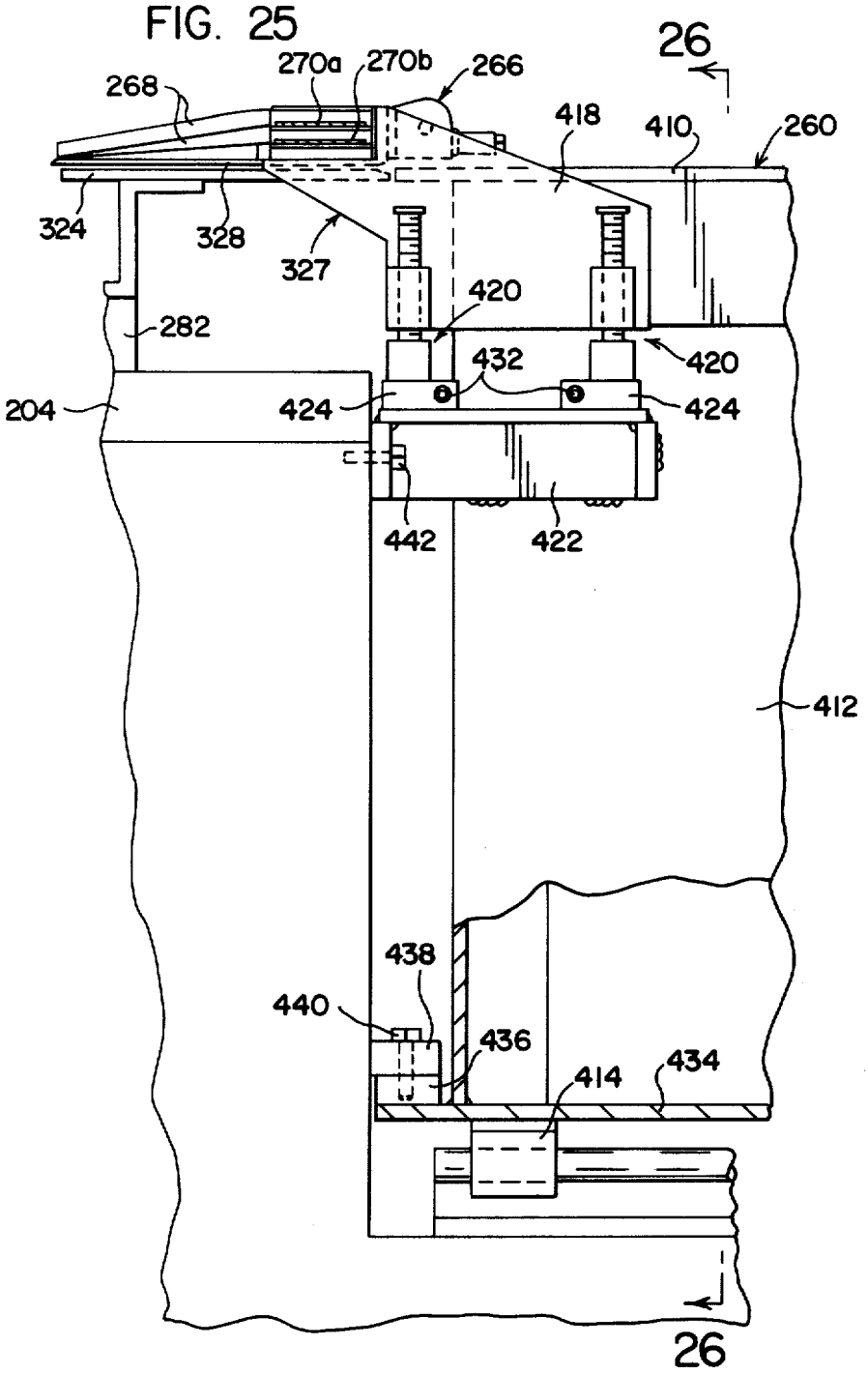
FIG. 25 is a side elevation view showing the support arrangement for the feed table and the kicker mechanisms, guide chutes and conveyors on the corresponding side of the press.
Figure 26:
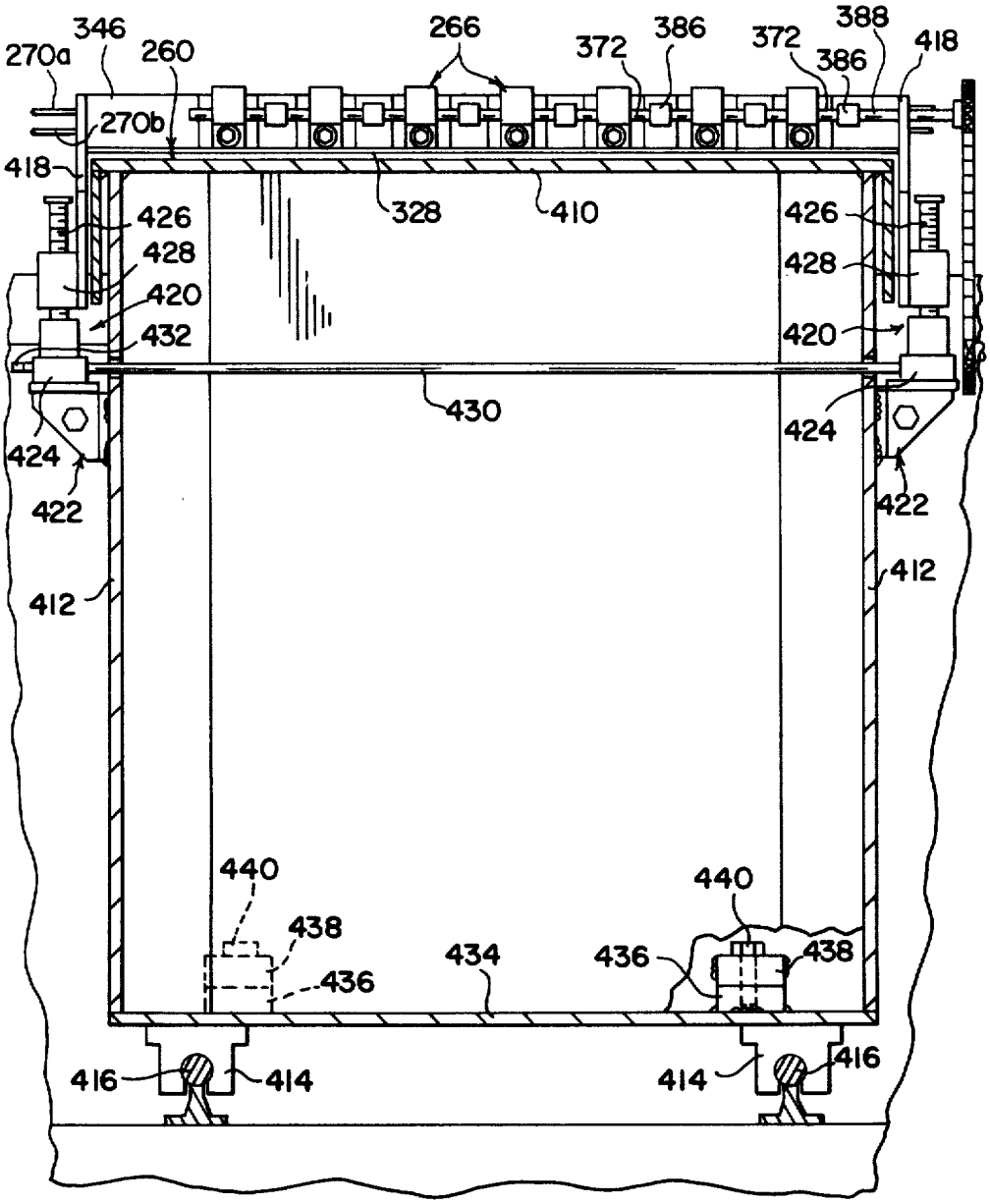
FIG. 26 is an end elevation view looking in the direction of line 26—26 in FIG. 25.

Referring now to FIGS. 25 and 26 of the drawing, it will be seen that feed table 260 includes a top plate 410 extending between and supported by side portions 412 each of which is provided at its lower end with a pair of support blocks 414 slidably received on a corresponding guide rod 416 which is suitably supported relative to the press frame. Bracket assembly 327 includes a pair of side plate members 418 between which support plate 346 and cover 328 extend and to which the latter plates are rigidly secured such as by welding. Each side plate 418 extends downwardly along the corresponding side of feed table 260 and is provided adjacent its lower end with a pair of rotatable screw-type jack assemblies 420 by which the bracket assembly is vertically adjustably supported on a feed table. More particularly in this respect, each jack assembly is supported on the corresponding side of the feed table by a mounting bracket 422 to which base portion 424 of the jack assembly is suitably attached. Base portion 424 supports a rotatable screw member 426 which extends through a threaded sleeve 428 mounted on side plate 418, whereby rotation of screw 426 in opposite directions achieves elevating and lowering of the bracket assembly relative to table 260. It will be appreciated that such elevating and lowering enables appropriate positioning of cover plate 328, kicker mechanisms 266 and guide chutes 268 relative to top plate 410 of the table as well as support plate 324 mentioned hereinabove. Jack devices 420 can be actuated in any desired manner and, in the embodiment disclosed, bases 424 are interconnected by a rotatable drive shaft 430 having an end 432 provided with flats by which the shaft can be rotated through a suitable tool or other drive arrangement. While the jack mechanisms are disclosed as being screw-type, it will be appreciated that the desired elevating and lower capability could be achieved by hydraulic or pneumatic units. As further seen in FIGS. 25 and 26, the lower end of feed table 260 includes a bottom plate 434 provided adjacent the press frame with a pair of retaining blocks 436, each of which underlies a retaining block 438 rigidly secured to the press frame. Feed table 260 and thus bracket assembly 327 is adapted to be releaseably secured in place relative to the press frame by means of threaded fasteners 440 interengaging the retaining plates 436 and 438, and by means of threaded fasteners 442, which latter fasteners interconnect the press frame with the jack device mounting brackets 422 closest to the press frame. Accordingly, it will be appreciated that, by removing fasteners 440 and 442, feed table 260 and bracket assembly 327 are released for sliding movement along guide rods 416 laterally outwardly of the side 212 of the press, and that all of the component parts described hereinabove as being supported by bracket assembly 327 are thus displaceable therewith so as to expose the corresponding side of the tool area of the press. In connection with such displacement of the feed table and bracket assembly, it will be understood that the conveyor belt 270 and the various drive belts for the feed table and kicker assemblies are disengaged or suitably released to facilitate the feed table displacement.

Figure 27:
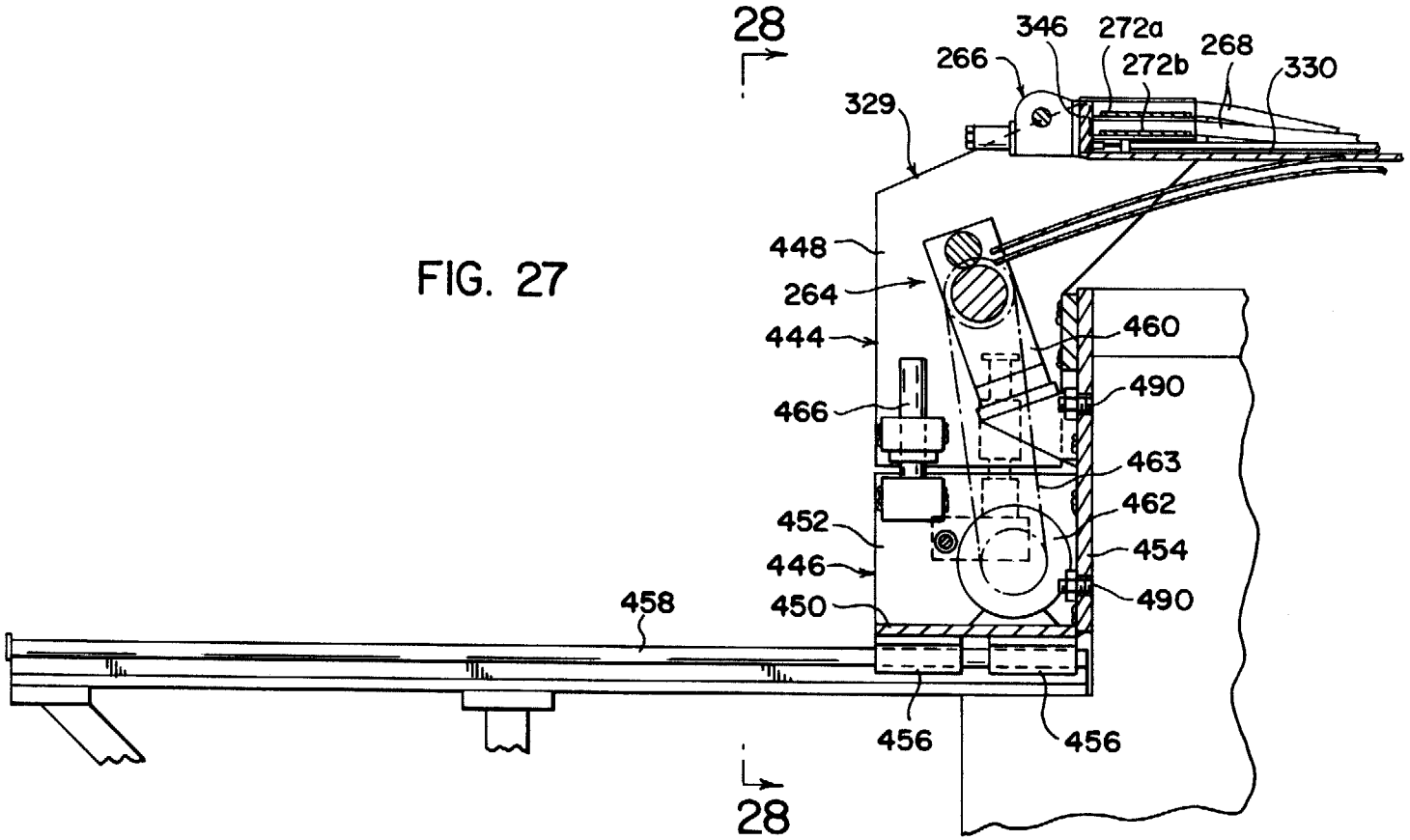
FIG. 27 is a side elevation view showing the support arrangements for the scrap discharge assembly and the kicker mechanisms, guide chutes and conveyors on the corresponding side of the press.
Figure 28:
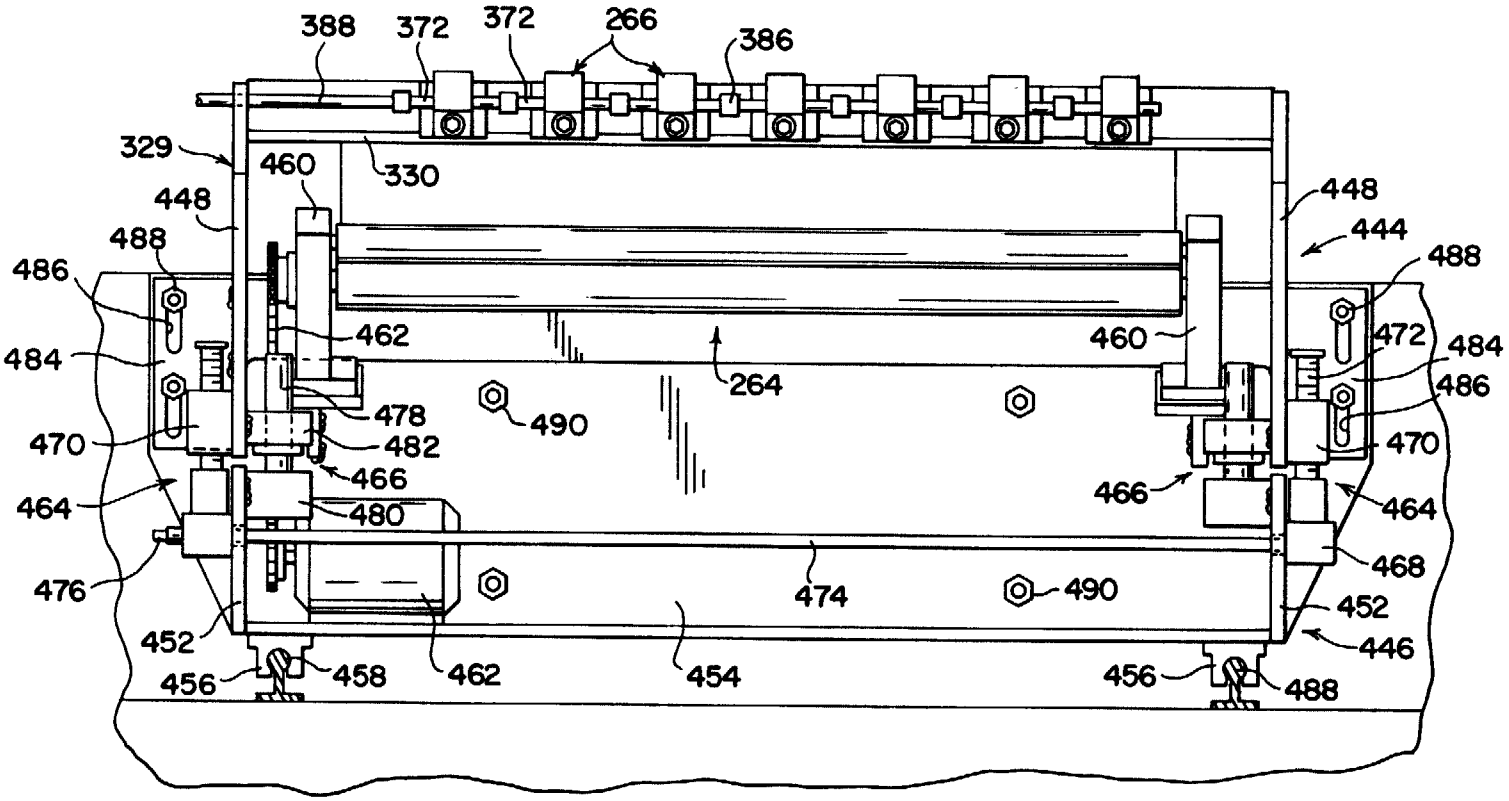
FIG. 28 is an end elevation view looking in the direction of line 28—28 in FIG. 27.

Referring now to FIGS. 27 and 28 of the drawing, it will be seen that bracket assembly 329 on the discharge side of the press includes upper and lower portions 444 and 446, respectively, upper portion 444 of which includes a pair of side plates 448 supporting the corresponding support plate 346 and cover plate 330 described hereinabove. Lower portion 446 of the bracket assembly includes a bottom plate 450, side plates 452 each underlying a corresponding one of the side plates 448 of the upper portion, and a front plate 454. Bottom plate 450 is provided at each of its opposite ends with a pair of support blocks 456 each slidably receiving a corresponding support rod 458 extending horizontally outwardly from the press and suitably supported relative to the press frame. Front plate 454 of the lower portion of the bracket assembly supports the rolls of the scrap discharge assembly 264 by means of mounting blocks 460 at opposite ends of the rolls, and a drive motor 462 for the discharge rolls is mounted on bottom plate 450 for driving interconnection with the discharge rolls such as by means of a sprocket chain 463. Side plate members 448 of the upper portion of the bracket assembly, and thus cover plate 330 and support plate 346 are supported for vertical displacement relative to lower portion 446 to facilitate vertical adjustment of the component parts carried by the upper bracket portion in the manner described hereinabove in connection with bracket assembly 327. Such vertical adjustment is achieved by a pair of screw-type jack assemblies 464, one on each side of the bracket assembly, and corresponding guide rod assemblies 466. Each jack assembly 464 includes a base portion 468 mounted on the corresponding side plate 452 of lower portion 446 of the bracket assembly and a threaded sleeve 470 mounted on the corresponding side plate 448 of upper bracket portion 444. Base portion 464 supports a rotatable screw 472 which extends through sleeve 470 and which operates to elevate and lower upper bracket portion 444 and the component parts carried thereby in response to rotation of screw 472 in opposite directions. Rotation of screws 472 can be achieved in any desired manner and, in the embodiment shown, the screws are rotated simultaneously by means of a cross shaft 474 between base portions 468 and having an end 476 provided with flats to facilitate rotation thereof by a suitable tool or drive mechanism. Each guide rod assembly 466 includes a guide rod 478 supported on the corresponding side plate 452 of lower portion 446 of the bracket assembly by means of a mounting block 480, and a corresponding guide block 482 mounted on side plate 448 of upper portion 444 and slidably receiving rod 478. Side plates 448 are further provided with laterally outwardly extending plates 484 having slots 486 therethrough by which upper bracket portion 444 can be fastened in an adjusted position relative to lower bracket portion 446. In this respect, threaded fasteners 488 extend through slots 486 and into threaded engagement with front plate 454 of lower portion 466, which plate extends laterally outwardly of side plates 448 for the latter purpose. Support bracket assembly 329 is adapted to be releaseably held in place relative to the press frame by means of a plurality of threaded fasteners 490 extending through front plate 454 and into the press frame and, accordingly, it will be appreciated that the bracket assembly and the component parts supported thereby are adapted to be displaced laterally from the discharge side of the press by removing fasteners 490 and sliding the support bracket assembly along guide rods 458. It will be further appreciated from the foregoing description that such displacement of the bracket assembly exposes the corresponding tooling area of the press.

FIGS. 29–36 illustrate yet another embodiment of can end making apparatus in accordance with the present invention. In this embodiment, an overdriven press construction is provided which enables high speed operation without the lubricant contamination problems heretofore encountered in connection with overhead press drives. In this respect, as best seen in FIGS. 29–34, the press includes a frame comprised of upright end plate members 500 having corresponding upper and lower portions 502 and 504, respectively, and corresponding front and rear sides 506 and 508, respectively. Each end plate member 500 is provided with a generally C-shaped opening 510 extending inwardly from the front side thereof, each of which openings receives a corresponding L-shaped bed support member 512 suitably secured thereto such as by welding. End plates 500 are interconnected in spaced apart parallel relationship by means of a plurality of cross members therebetween including cross plate 514 between upper portions 502, plate member 516 between bed support members 512, plate 518 between lower portions 504 and inwardly of rear sides 508, and top cover plates 520 and 522 between the uppermost edges of top portions 502. End plates 500 are further laterally interconnected by a bed plate 524 supported on the lower legs of bed support members 512 and suitably interconnected therewith, and which bed plate supports a bolster plate 526.

Figure 29:
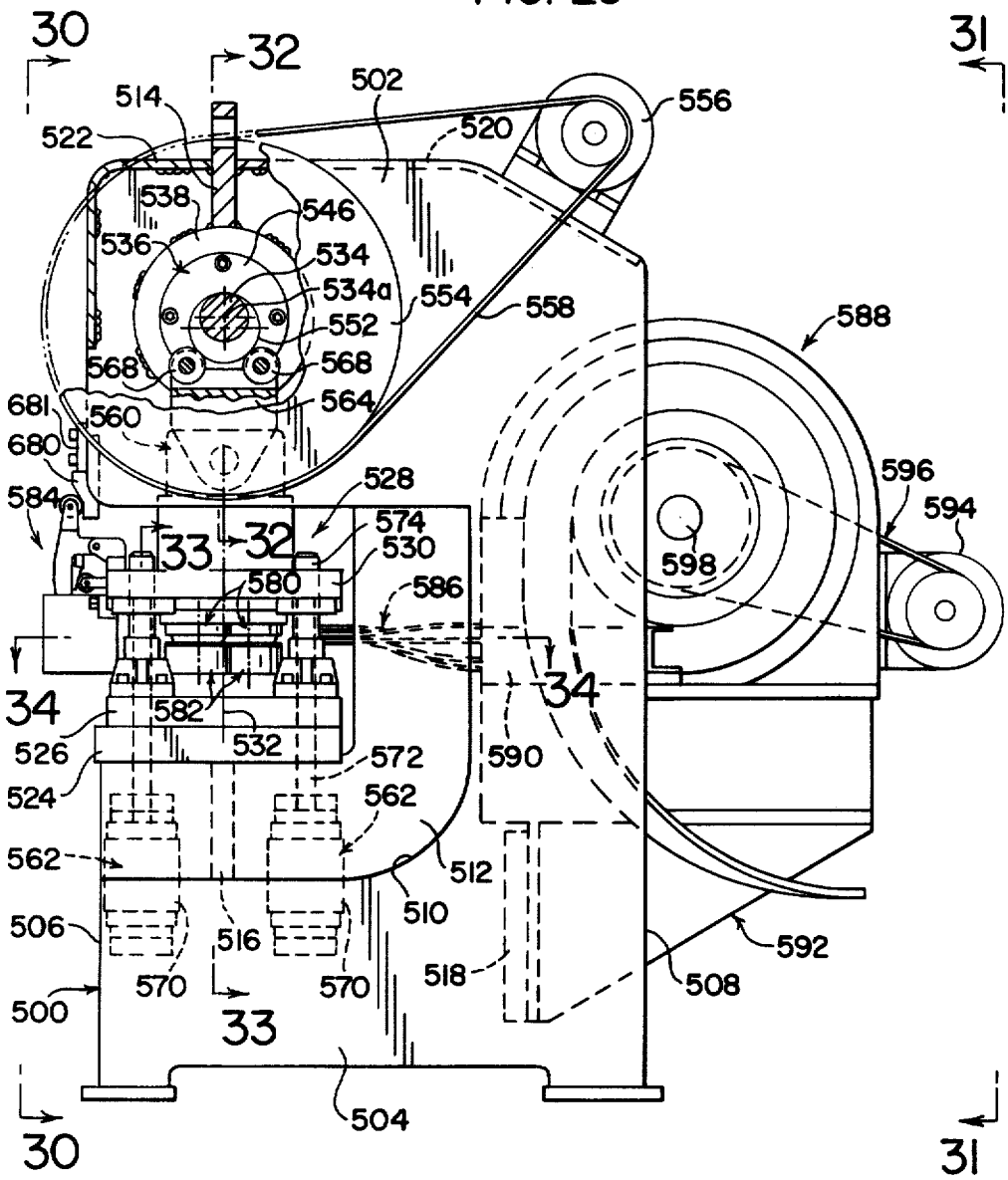
FIG. 29 is a side elevation view of another embodiment of can end making apparatus in accordance with the present invention.
Figure 30:
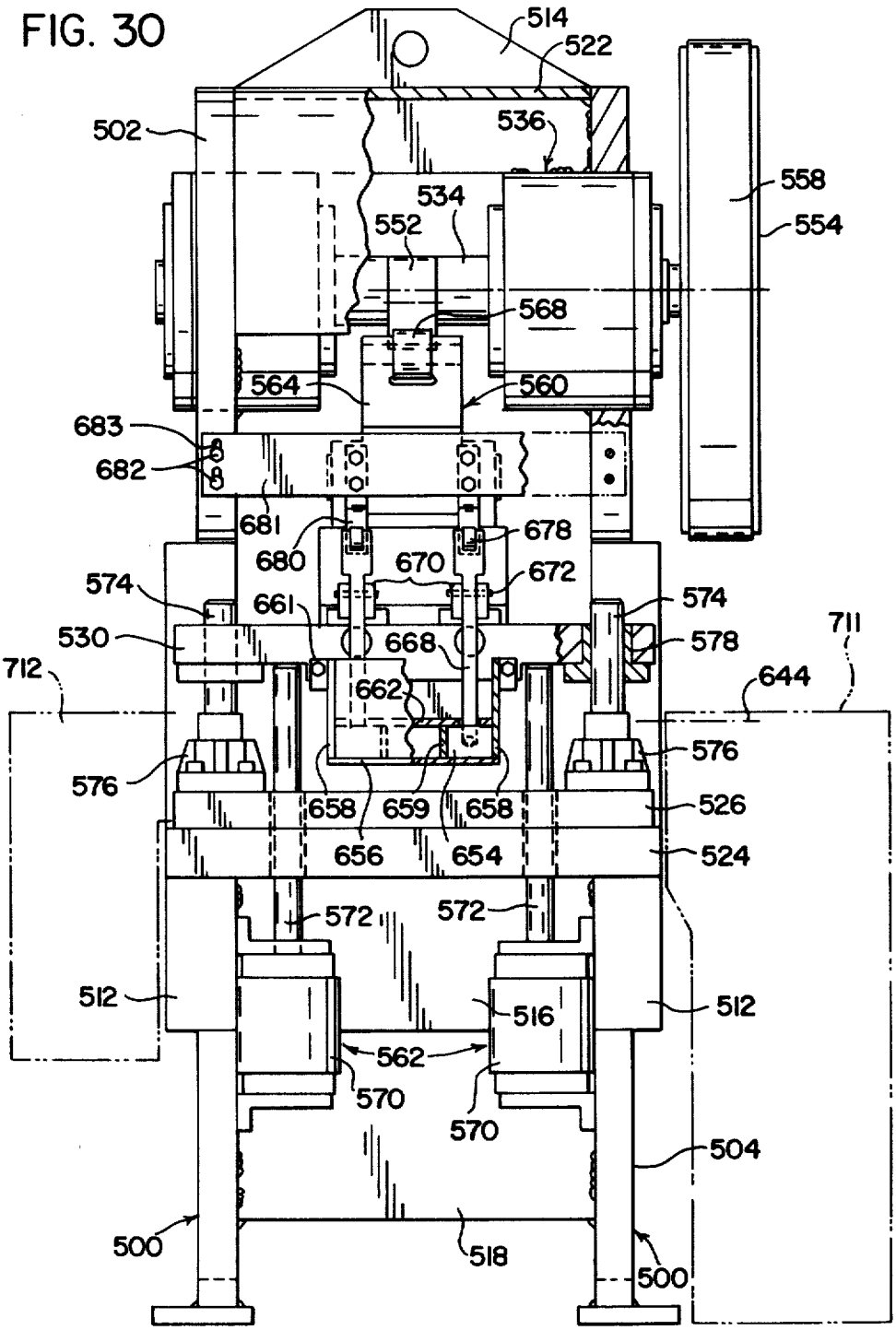
FIG. 30 is a front elevation view of the apparatus looking in the direction of line 30—30 in FIG. 29.
Figure 32:
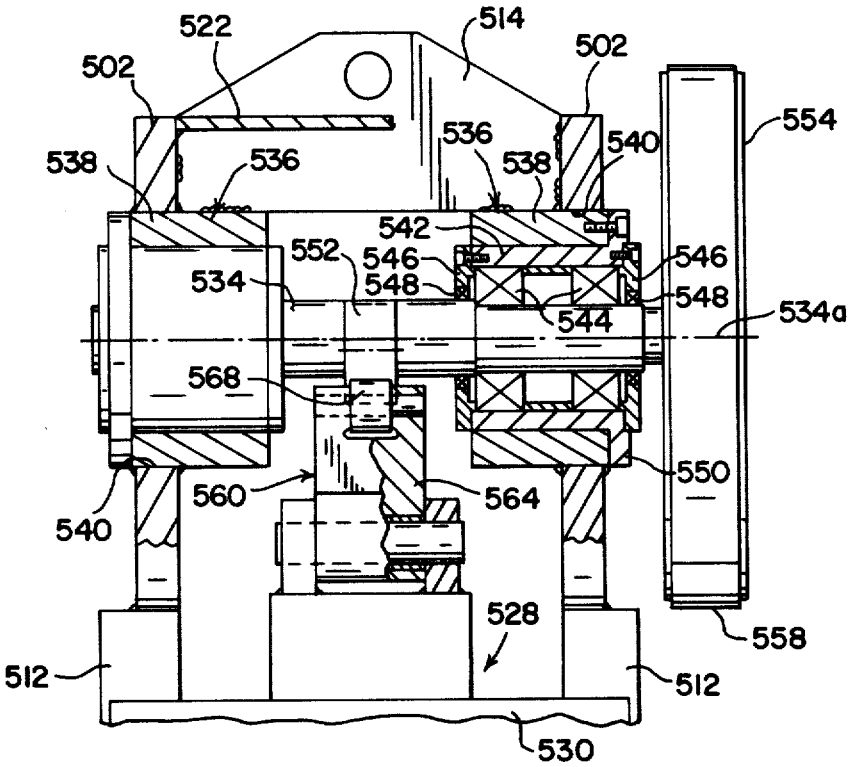
FIG. 32 is a detailed sectional elevation view taken along line 32—32 in FIG. 29 and showing the slide drive arrangement for the press.

The press further includes a slide assembly 528 including a slide plate 530 adapted to be reciprocated vertically toward and away from bolster plate 526 along a slide axis 532 by an overhead drive arrangement including drive shaft 534 in the upper portion of the frame. More particularly in this respect, as best shown in FIGS. 29, 30 and 32, drive shaft 534 is supported for rotation about its axis **534*a* by means of sealed cartridge-type bearing assemblies 536 interposed between the drive shaft and each of the frame end plates 502. Each bearing assembly 536 includes an annular bearing housing 538 welded or otherwise secured in a corresponding opening 540 in end plate 502 and to the overlying portion of frame cross plate 514. Housing 538 removably receives a sealed cartridge-type bearing including a bearing support sleeve 542 supporting bearing components 544 surrounding drive shaft 534. Sleeve 542 further supports annular collars 546 at its axially opposite ends, each of which collars supports a seal component 548 sealingly engaging drive shaft 534** to prevent egress of lubricant along the shaft from within the cartridge.

Support sleeve 542 is provided with a radially outwardly extending annular flange 550 at its axially outer end by which the bearing cartridge is removably fastened to housing 538.

Drive shaft 534 is provided intermediate its opposite ends with an eccentric 552, preferably integral therewith, and one end of drive shaft 534 is adapted to be driven through a brake and clutch mechanism including a flywheel 554 driven by an electric motor 556 mounted on top plate 522 and an endless drive belt or belts 558 interconnecting the motor and flywheel. Slide assembly 528 is adapted to be reciprocated in response to rotation of drive shaft 534 and, for this purpose, a cam follower connecting assembly 560 is interposed between drive shaft cam 552 and the slide assembly, and four pneumatically actuated biasing units 562 are supported between the lower portion of the press frame and the underside of slide plate 530 to bias the slide assembly upwardly with respect to drive shaft 534. More particularly, as best seen in FIGS. 29, 30, 32 and 33, connecting assembly 560 includes a connecting rod member 564 pivotally interconnected at its lower end with slide assembly 528 and provided at its upper end with a follower roller assembly pivotally mounted thereon and including follower rollers 568 engaging drive shaft cam 552 on opposite sides of slide axis 532 and beneath drive shaft axis 534*a*. Biasing units 562 operate to bias follower rollers 568 against cam 552 and, in this respect, each biasing unit includes a cylinder 570 mounted on a corresponding one of the frame end plates 500, and a piston rod 572 extending through corresponding openings in bolster support plate 524 and bolster plate 526 and into engagement with the underside of slide plate 530. It will be appreciated of course that each piston rod is attached to a piston member in the corresponding cylinder 570 and that the cylinders are connected to a suitable source of air under pressure, not illustrated, for biasing the piston and thus the piston rod upwardly towards slide plate 530, thus to maintain follower rollers 568 in engagement with cam 552. It will be further appreciated from the foregoing description that cam 552 is operable in response to rotation of drive shaft 534 to displace slide assembly 528 downwardly through interengagement between the cam and follower rollers 568, such downward movement being against the bias of pneumatic units 562, and that the latter units are operable to displace the slide assembly upwardly as the lobe of cam 552 rotates from its lower toward its upper position relative to drive shaft axis 534*a*. It will be further appreciated that the sealed cartridge-type bearing support for the drive shaft together with the cam and follower arrangement for the connecting assembly minimizes the potential contamination of the tooling area of the press from lubricant in portions of the press overlying the tooling area.

Potential lubricant contamination in the tooling area is further minimized by providing for guidance of slide plate 530 by means of a plurality of upstanding guide pins on the press bed as opposed to standard gibbing between the slide and press frame. More particularly in this respect, slide plate 530 is rectangular, and four slide guide pins 574 are mounted on bolster plate 526, each adjacent one corner of the slide plate. Each guide pin 574 is removably secured to bolster plate 526 by means of a corresponding mounting sleeve 576, and the upper end of each guide pin extends through a corresponding opening in slide plate 530 in sliding engagement with a bearing sleeve 578 mounted in the opening in the slide plate. The guide pin arrangement advantageously avoids the use of gibbing between the upper portion of the press frame and corresponding portion of the slide and thus avoids exposing the underlying tool area of the press to lubricant for the gibbing. Moreover, the guide pin arrangement enables positioning of the guide components laterally away from the slide axis a distance which further promotes avoidance of lubricant contamination in the tooling area, and enables this advantage to be achieved without the massive frame and slide structure which would be required to support and guide a slide with standard planar type gibbing spaced an equivalent distance from the slide axis.

With further reference to FIGS. 29, 30, 31 and 34, it will be seen that the can making apparatus of this embodiment includes two sets of opposed pairs of tooling, each including upper tooling 580 mounted on slide plate 530 for displacement therewith and corresponding lower tooling 582 mounted on bolster plate 526. The two sets of tooling are offset relative to one another in the direction between the ends of the press as defined by end frame members 500 and in the direction between the front and rear sides of the press and, as will become more apparent hereinafter, each set of tooling is adapted to interengage with sheet material interposed therebetween to blank and partially form a can end from the sheet material. As further set forth more fully hereinafter, upper tooling 580 of each tooling set includes a knockout component adapted to displace a partially formed can end into a horizontal plane vertically spaced from the feed line for the sheet material, and each tooling set has a kicker mechanism 584 associated therewith and operable to impact against and propel a partially formed can end in the horizontal plane. The can end is propelled into the entrance end of a corresponding guide chute 586 which leads to a corresponding curling machine 588 mounted on the rear side of the press between end plate members 500.

In the present embodiment, the exit end of each guide chute opens directly into the entrance 590 of the corresponding curling machine, and curling machines 588 are vertically oriented as opposed to being horizontally oriented as in the preceding embodiments. Accordingly, entrances 590 into the curling machines are each in a vertical plane, and the guide chutes 586 are contoured between their entrance and exit ends to turn a partially formed can end during movement therethrough from the horizontal plane in which it is received to a vertical plane for reception in a corresponding curling machine. The vertical disposition of the curling machines advantageously promotes compactness of the apparatus by enabling positioning of the curling machines between end plate members 500 of the press. Moreover, the vertical disposition enables a portion of the curling machines to extend inwardly of the press from rear side 508 thereof, thus eliminating the need for belt conveyors between the guide chutes and curling machines. The curling machines are supported on a common mounting bracket arrangement 592 attached to cross plate 518 of the press frame, and the machines are driven by a common electric motor 594 through a belt and pulley arrangement 596 including a driven pulley on a portion 598 of a common drive shaft extending between the curling machines.

Figure 35:
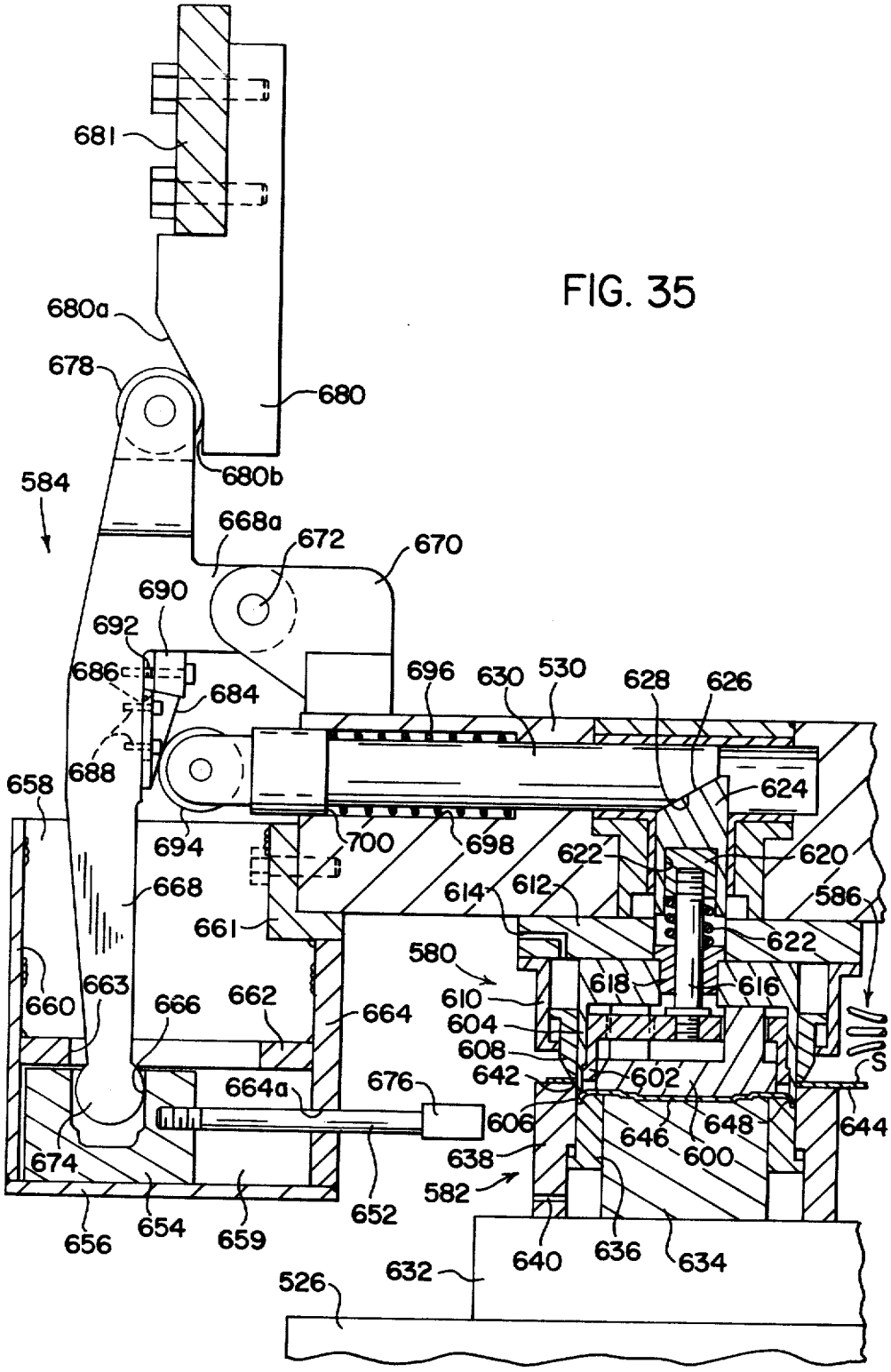
FIG. 35 is a detailed sectional elevation view of one of the opposed pairs of tooling and the corresponding kicker mechanism and chute; and, FIG. 36 is a detailed sectional elevation view showing the actuated positions of the kicker and knockout mechanisms.
Figure 36:
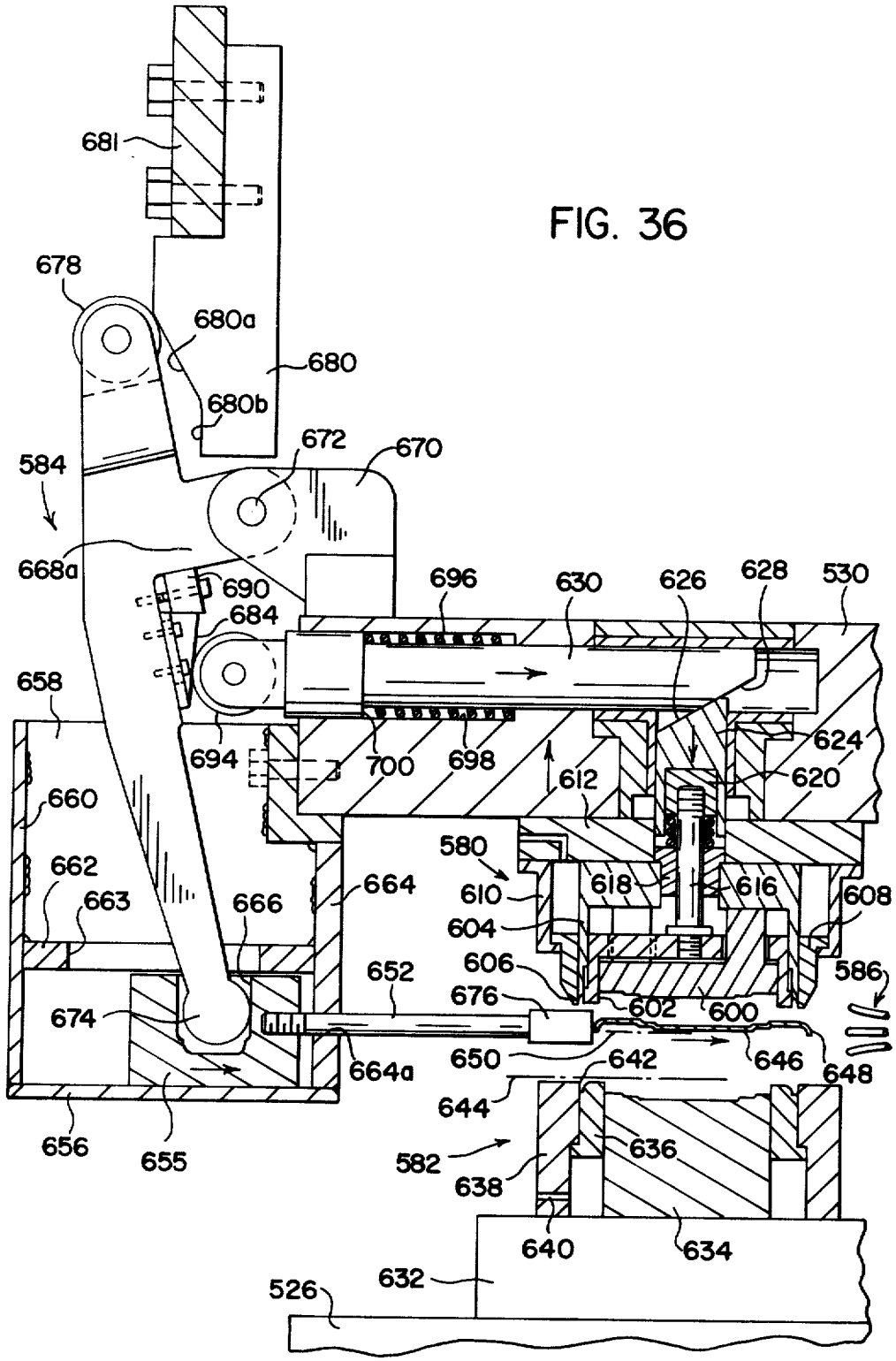

As will be appreciated from the one set of tooling shown in FIGS. 35 and 36 of the drawing, upper tooling 580 of each set includes a central die member 600 axially fixed with respect to slide plate 530, and a knockout sleeve 602 extending about the central die member and axially reciprocable relative thereto. Upper tooling 580 further includes an annular cutting member 604 surrounding knockout sleeve 602 and provided at its lower end with an annular cutting edge 606, and an annular hold down sleeve 608 surrounding cutting member 604. Sleeve 608 is axially reciprocable relative to cutting member 604 within a chamber defined in part by the cutting member and an outer tooling ring 610 attached to a tool support plate 612 by which the tooling assembly is mounted on slide plate 530. Hold down sleeve 608 is normally biased downwardly such as by air under pressure introduced into the chamber therebehind through a passage 614 connected to a suitable source of air under pressure, not illustrated. Knockout sleeve 602 is mounted on an actuating stem 616 extending upwardly through a bearing sleeve 618, and the upper end of actuating stem 616 is threadedly interengaged with an adjustable actuating cap 620. A coil spring 622 is captured between cap 620 and bearing sleeve 618 to bias stem 616 and thus knockout sleeve 602 upwardly relative to slide plate 530. Cap 620 seats in a recess 622 opening into the lower end of a knockout bar 624 having an inclined surface 626 facially engaging inclined surface 628 of a horizontal knockout bar 630 which is reciprocable to actuate bar 624 and thus knockout sleeve 602 of the tooling, as set forth more fully hereinafter. At this point, it will be appreciated that displacement of knockout bar 630 to the right in FIG. 35 displaces knockout bar 624 downwardly against the bias of spring 622, thus to displace knockout sleeve 602 downwardly relative to tooling components 600 and 604.

Lower tooling 582 is mounted on bolster plate 526 by means of a tooling support plate 632 and includes a central die member 634 immediately surrounded by a die sleeve 636 which is axially reciprocable relative to die members 634 and biased upwardly by means of air under pressure in a chamber therebehind which is defined in part by die member 634 and an annular outer die component 638. The latter die component is provided with a passageway 640 adapted to be connected to a suitable source of air under pressure, not shown, and is further provided with an annular cutting edge 642 cooperable with cutting edge 606 of the upper tooling to sever a circular blank from sheet material interposed between the upper and lower tooling.

In operation of the tooling, it will be appreciated that sheet material is fed between the upper and lower tooling along a horizontal feed line 644 adjacent the lower tooling, and, in response to downward movement of the slide, the lower end of hold down member 608 engages the sheet material against lower die component 638. Thereafter, the descent of cutter ring 604 of the upper tooling provides for a circular blank to be severed from the sheet material by cooperable interengagement of cutting edges 606 and 642. Further downward movement of the upper tooling results in the partial forming of a can end having a central panel portion 646 and a downwardly extending peripheral skirt 648. During subsequent upward movement of the slide, the partially formed can end is carried upwardly with the upper tooling and, after ascending above feed line 644, and while still ascending, the knockout mechanism is actuated to cause relative axial displacement between knockout sleeve 602 and the slide in the direction downwardly of the upper tooling, whereby knockout sleeve 602 displaces the partially formed can end from the tooling for the can end to be momentarily suspended in mid-air in a horizontal plane 650 spaced above feed line 644. At this time, kicker mechanism 584 is actuated as set forth hereinafter to impact against and propel the partially formed can end in horizontal plane 650 and into the entrance end of the corresponding guide chute 586.

Figure 34:
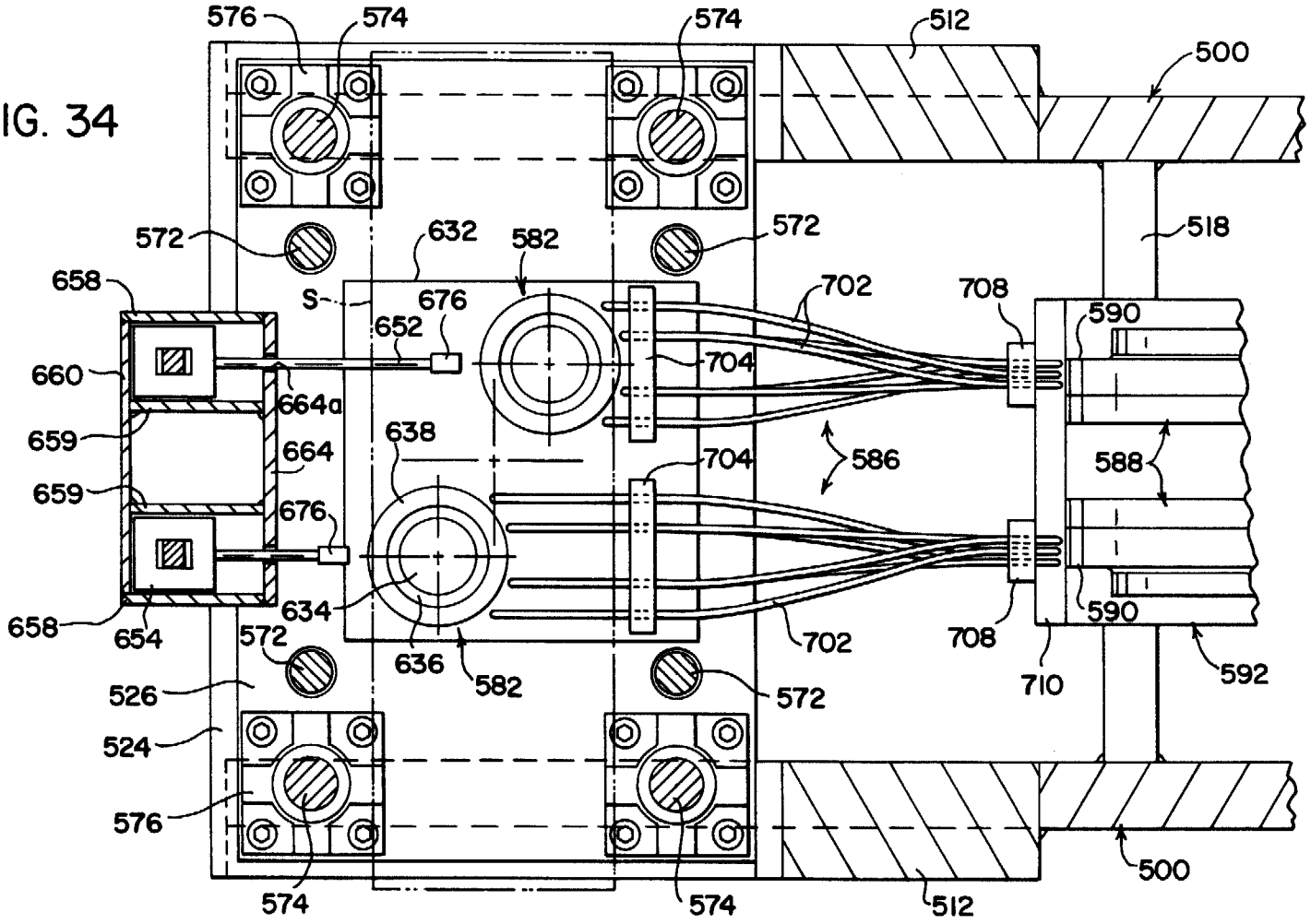
FIG. 34 is a sectional plan view through the tooling area of the press taken along line 34—34 in FIG. 29.

With regard in particular to the structure and operation of kicker mechanisms 584, as best seen in FIGS. 34–36 each kicker mechanism is mounted on the slide for vertical reciprocation therewith and includes a kicker rod member 652 aligned with the corresponding set of tooling and supported on the slide for horizontal reciprocation toward and away from the tooling. In this respect, each kicker rod 652 has an outer end suitably attached to a kicker body member 654 which is horizontally slidable in a kicker housing removably mounted on the slide. The kicker housing includes a bottom plate 656 along which body members 654 are slidable, opposed parallel outer side plate members 658 on the outermost opposite sides of body members 654 and extending upwardly from bottom plate 656, an outer wall plate 660 extending upwardly from bottom plate 656 and between side plates 658, a top plate 662 overlying body members 654, and a front plate 664 having a guide opening 664*a* through which the corresponding kicker rod member 652 extends. Inner side plate members 659 are provided on bottom plate 656 adjacent the innermost sides of kicker body members 654, and the kicker housing is removably mounted on slide plate 530 by means of bolts, not designated numerically, extending through housing side plates 658 and into a mounting bracket 661 on slide plate 530.

Top plate 662 of the housing is provided with a slot 663 overlying each kicker body member 654, and each kicker body member is provided with a recess 666 receiving the lower end of a corresponding pivotal actuator lever 668. Levers 668 are pivotally mounted intermediate their upper and lower ends to the slide by means of a corresponding mounting bracket 670 on slide plate 530 and a pivot pin 672 extending through the bracket and mounting arm portion 668*a* of lever 668. The lower end of actuating lever 668 is provided with a head 674 which is slidably received in recess 666 of the corresponding kicker body member 654, whereby it will be appreciated that pivotal movement of lever 668 about the axis of pin 672 imparts reciprocation to kicker body member 654 and thus kicker rod 652 inwardly and outwardly of the corresponding tooling. The inner end of kicker rod 652 is provided with a tip 676 of nylon or the like and, during inward displacement of the kicker rod in the manner set forth hereinafter, tip 676 impacts against a partially formed can end to propel the latter in horizontal plane 650.

The upper end of each actuating lever 668 is provided with a cam follower roller 678 engaging the track of a corresponding actuating cam 680 mounted on the press frame. As seen in FIG. 30, cams 680 are mounted on a common support plate 681 which is vertically adjustable relative to the press frame by means of mounting bolts 682 extending through slots 683 on plate 681 and into frame plates 500. The tracks of cams 680 include a ramp portion 680*a* and a vertical portion 680*b* engaged by follower roller 678 to actuate levers 668 in response to slide displacement and in the manner set forth hereinafter. Each actuating lever 668 provides the dual functions of actuating the knockout sleeve component of the corresponding upper tooling 580 and displacing kicker body member 654 and thus kicker rod 652 of the corresponding kicker mechanism to achieve the impacting against and propelling of a partially formed can end upon release thereof from the tooling. Further in this respect, actuating lever 668 is provided just below mounting arm portion 668*a* with a knockout cam 684 which is vertically adjustable relative to lever 668 by means of an elongated slot 686 in the cam and fasteners 668 extending through the slot and into lever 668. A wedge member 690 is interposed between the inclined upper edge of cam 684 and arm portion 668*a* and is fastened to the lever by means of a threaded fastener 692 to maintain cam 684 in a desired position relative to lever 668. Cam 684 engages a follower roller 694 mounted on the outer end of knockout bar 630 described hereinabove, and a coil spring 696 interposed between the inner end of a recess 698 for the knockout bar and a shoulder 70 adjacent the outer end of the knockout bar biases the latter and thus follower roller 694 outwardly against cam 684. Accordingly, it will be appreciated that spring 696 biases actuating lever 668 clockwise as viewed in FIGS. 35 and 36, thus biasing follower roller 678 against cam 680 and biasing kicker body member 654 and thus kicker rods 652 outwardly with respect to the associated tooling.

In connection with the operation of the knockout and kicker components, it will be appreciated that during downward movement of the slide to bring the upper and lower tooling into cooperable interengagement with sheet material S therebetween, follower roller 678 moves along vertical portion 680*b* of the cam track of cam 680, whereby kicker rod tip 676 and knockout sleeve 602 of upper tooling 580 are in the positions thereof shown in FIG. 35. Following the forming operation and during subsequent upward movement of the slide, follower roller 678 engages ramp portion 680*a* of cam 680, whereby actuating lever 668 is pivoted counterclockwise about pin 672. Accordingly, cam 684 displaces knockout bar 630 to the right in FIG. 35 to displace knockout bar 624 and thus knockout sleeve 602 downwardly relative to the slide to the position shown in FIG. 36, whereby the partially formed can end is displaced from the tooling and momentarily suspended in horizontal plane 650. Such counterclockwise displacement of lever 668 also displaces kicker body member 654 and thus kicker rod 652 to the right in FIG. 35, in timed relationship with the knockout operation, for kicker rod tip 676 to impact against the partially formed can end in plane 650 and propel the can end to the right in FIG. 36 and into the entrance end of guide chute 586. Further in connection with the knockout and kicker mechanisms, the velocity of the slide during upward movement and the incline of ramp portion 680*a* of cam 680 cooperatively provide for the kicker rod to be displaced with sufficient speed for impacting of the tip 676 with the partially formed can end to propel the can end laterally of the tooling. Further, it will be appreciated that the positions of cams 680 and 684 relative to pivot pin 672 and the contours of the cam surfaces engaging follower rollers 678 and 694 provide the necessary timed coordination between displacement of the partially formed can end from the upper tooling into horizontal plane 650 and the operation of kicker rod 652 to achieve propelling of the can end from the tooling area while the end is suspended in plane 650.

Figure 33:
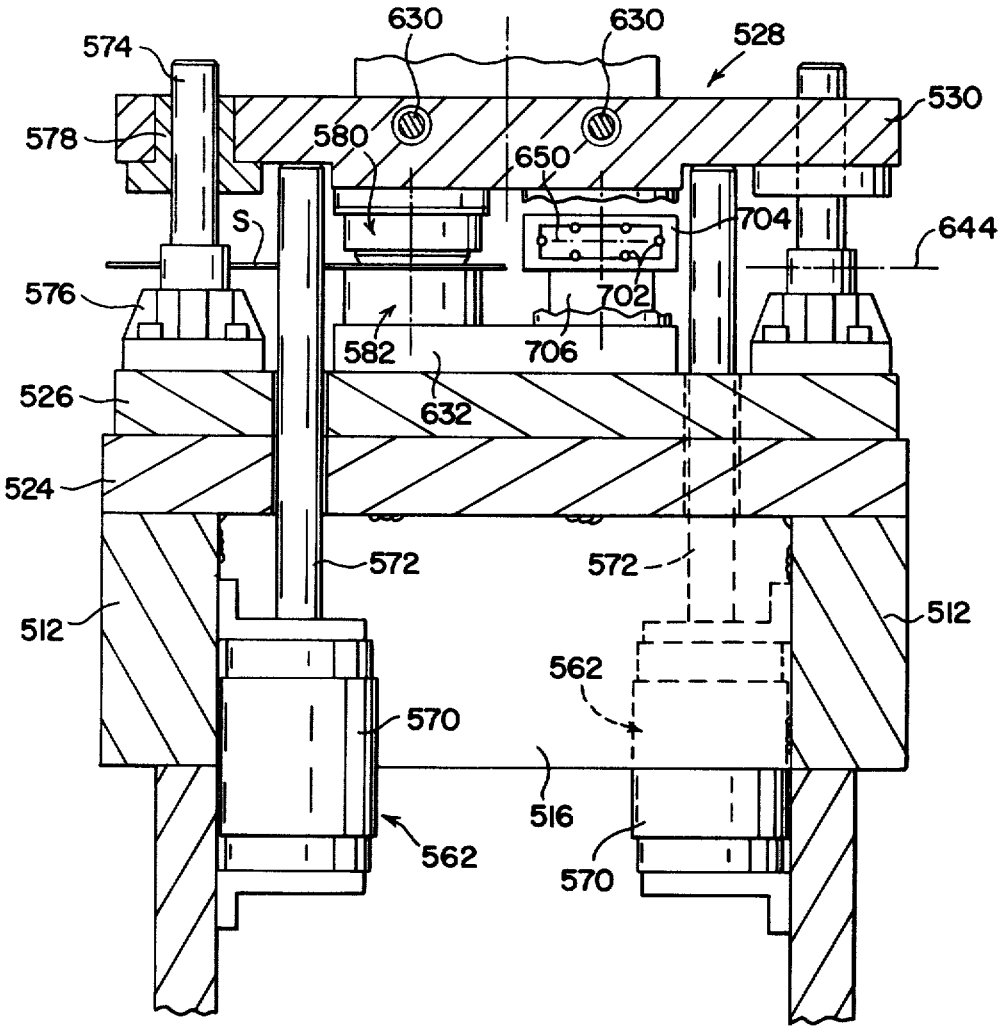
FIG. 33 is a detailed sectional elevation view taken along line 33—33 in FIG. 29 and showing the support and biasing arrangment for the press slide.

As seen in FIGS. 33 and 34, guide chutes 586 are constructed of individual strands of wire 702 supported relative to one another laterally adjacent the corresponding press tooling on the side thereof opposite the kicker mechanism by means of support collars 704 to which the wires are secured, such as by brazing, and which support collars are suitably fastened to a support block 706 on lower tooling mounting plate 632. The arrangement of wires 702 and support collars 704 provide for the guide chute to have a horizontally oriented entrance end in horizontal plane 650 and thus in position to receive partially formed can ends propelled from the corresponding tooling. The opposite ends of wires 702 are attached, such as by brazing, to a support collar 708 mounted on a plate member 701 of support bracket assembly 592 for curling machines 588. As mentioned hereinabove, the vertical disposition of curling machines 588 provide for entrances 590 thereinto to be vertically oriented and, accordingly, support collars 708 support the corresponding ends of wires 702 to provide the guide chutes with vertically oriented discharge ends opening into the entrance of the corresponding curling machine. Thus, it will be appreciated that the guide chute contour is obtained, at least in effect, by attaching the opposite ends of the wires to collars 704 and 708 with the wires in parallel relationship to one another and then twisting one of the collars 90° relative to the other for the guide chutes to be contoured intermediate the opposite ends thereof to reorient the partially formed can end from the horizontal disposition received to a vertical disposition for discharge into the curling machines.

Figure 31:
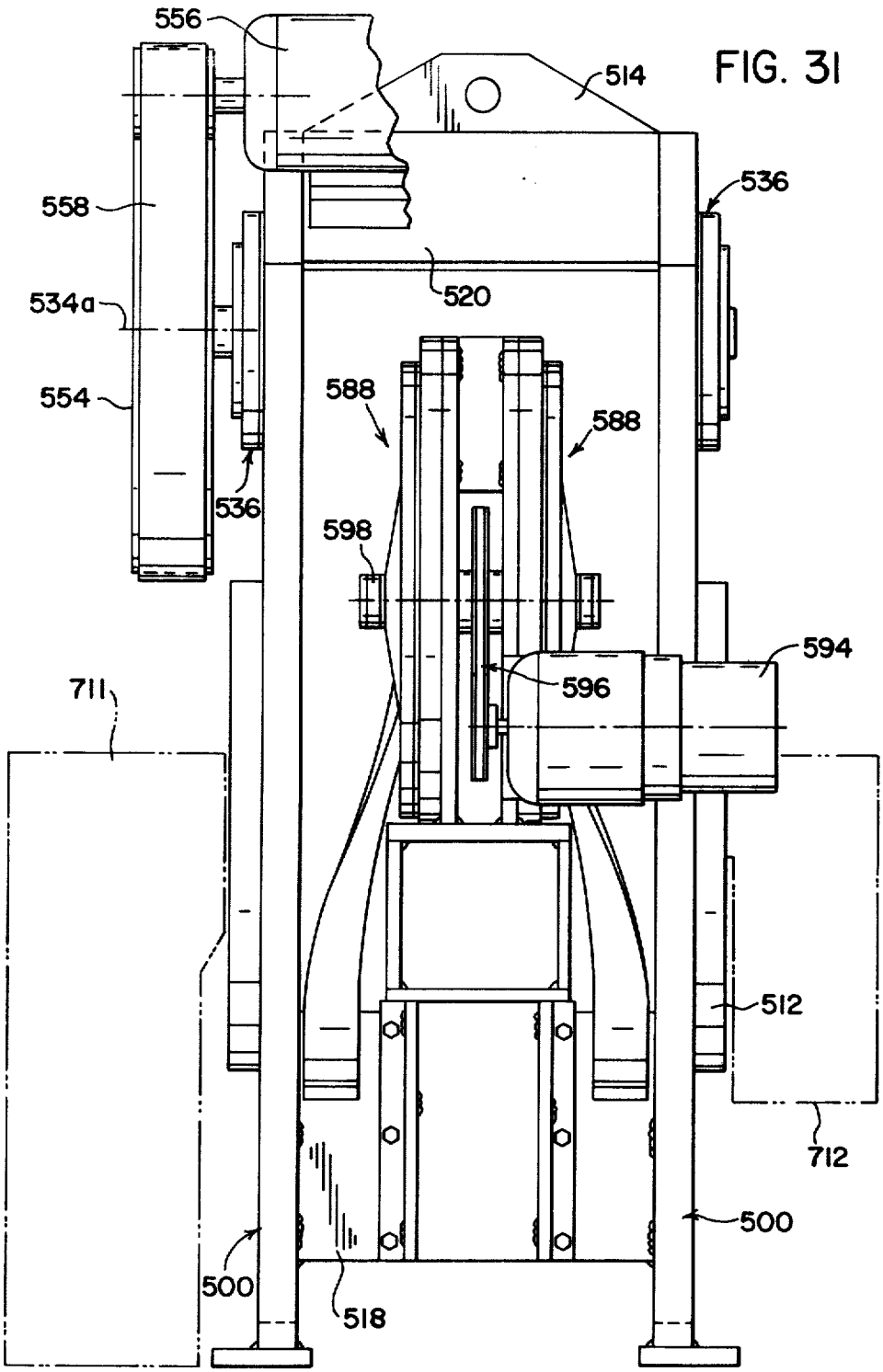
FIG. 31 is a rear elevation view of the apparatus looking in the direction of line 31—31 in FIG. 29.

While not illustrated in detail in FIGS. 29–36 of the drawing, it will be appreciated from the embodiments illustrated in FIGS. 1–28 that a sheet feeding mechanism 711 shown schematically in FIGS. 30 and 31 can be mounted on or adjacent one of the end plate members 500 of the press frame to provide for feeding sheet material step-by-step through the press along feed line 644, and that a suitable scrap discharge mechanism can be mounted on or adjacent the opposite end plate of the press, as schematically illustrated in FIGS. 30 and 31 and designated by numeral 712. It will be further appreciated that such sheet feeding and scrap discharge mechanisms would be operated in coordination with slide displacements and, in this respect, would be driven by a suitable power takeoff from shaft 534.

Since many embodiments of the present invention can be made and since many changes can be made in the embodiments herein illustrated and described without departing from the principles of the present invention, it is to be distinctly understood that the foregoing descriptive matter is to be interpreted merely as illustrative of the present invention and not as a limitation.

Having thus described the invention, it is claimed:

1. Can end making apparatus comprising, a press having frame means providing tool support means, slide means, a plurality of opposed pairs of tooling, each said opposed pair of tooling including first die means on said tool support means and second die means supported on said slide means, means supporting said slide means for reciprocation vertically between first and second slide positions, said first and second die means being spaced apart in said first slide position, means to feed sheet material between said first and second die means and along a horizontal feed path when said die means are spaced apart, said first and second die means being cooperable in said second slide position to partially form a can end from sheet material therebetween, said partially formed can end being cup-shaped and including skirt means, one of said first and second die means including means to displace a partially formed can end to a horizontal plane when said die means are spaced apart, said horizontal plane being vertically spaced from said feed path, kicker means for each said pair of tooling, said kicker means including kicker member means reciprocable in said horizontal plane when said die means are spaced apart to impact against a partially formed can end in said horizontal plane and propel said partially formed end in said plane, curling means for receiving said partially formed can end, and means between said pairs of tooling and said curling means to receive partially formed can ends propelled by said kicker member means and deliver said partially formed can ends to said curling means.

2. Apparatus according to claim 1, wherein said means to receive and deliver partially formed can ends to said curling means includes guide chute means for each said pair of tooling and having an entrance end laterally adjacent the corresponding pair of tooling for receiving partially formed can ends propelled by said kicker member means.

3. Apparatus according to claim 1, wherein said curling means includes a plurality of curling machines, and said means to receive and deliver partially formed can ends includes corresponding endless conveyor means for delivering said can ends to said curling machines.

4. Apparatus according to claim 3, wherein said means to receive and deliver partially formed can ends further includes guide chute means for each said pair of tooling and having an entrance end laterally adjacent the corresponding pair of tooling for receiving partially formed can ends propelled by said kicker member means and discharge ends for directing partially formed can ends onto said conveyor means.

5. Apparatus according to claim 3, wherein said press has opposite sides and opposite ends, and said endless conveyor means extend in the direction between said opposite ends.

6. Apparatus according to claim 5, wherein said feed path for said sheet material is in the direction between said opposite sides of said press.

7. Apparatus according to claim 5, wherein said kicker member means is reciprocable in the direction between said opposite sides.

8. Apparatus according to claim 7, wherein said feed path for said sheet material is in the direction between said opposite sides of said press.

9. Apparatus according to claim 5, wherein said kicker member means is reciprocable in the direction between said opposite ends.

10. Apparatus according to claim 9, wherein said feed path for said sheet material is in the direction between said opposite sides of said press.

11. Apparatus according to claim 5, wherein said endless conveyor means includes conveyor belt means extending along each of said opposite sides of said press, said pairs of tooling being offset in the direction between said opposite ends of said press, and said kicker member means for adjacent ones of said pairs of tooling propelling a partially formed can end therefrom toward a different one of said conveyor belt means.

12. Apparatus according to claim 11, wherein said means to receive and deliver partially formed can ends further includes guide chute means for each said pair of tooling and having an entrance end laterally adjacent the corresponding pair of tooling for receiving partially formed can ends propelled by said kicker member means and discharge ends for directing partially formed can ends onto said conveyor belt means.

13. Apparatus according to claim 12, wherein each said conveyor belt means includes upper and lower runs moving in opposite directions with respect to said ends of said press, said plurality of curling machines including a pair of curling machines for each said belt means, the curling machines of each said pair having can end receiving ends positioned to receive can ends from a different one of said upper and lower runs of the corresponding belt means.

14. Apparatus according to claim 13, wherein said feed path for said sheet material is in the direction between said opposite sides of said press.

15. Apparatus according to claim 3, wherein said endless conveyor means includes conveyor belt means extending in the direction of reciprocation of said kicker member means.

16. Apparatus according to claim 15, wherein each said conveyor belt means is aligned in said direction with the corresponding kicker member means.

17. Apparatus according to claim 16, wherein said means to receive and deliver partially formed can ends further includes guide chute means for each said pair of tooling and having an entrance end laterally adjacent the corresponding pair of tooling for receiving partially formed can ends propelled by said kicker member means and discharge ends for directing partially formed can ends onto said conveyor belt means.

18. Apparatus according to claim 17, wherein said feed path for said sheet material is in the direction transverse to said direction of reciprocation of said kicker member means.

19. Apparatus according to claim 1, wherein said curling means includes a curling machine for each said pair of tooling, and said means to receive and deliver partially formed can ends includes a guide chute for each said pair of tooling having an entrance end in said horizontal plane and adjacent said tooling and a discharge end for delivering partially formed can ends directly to the corresponding curling machine.

20. Apparatus according to claim 19, wherein said curling machines are mounted on said frame means and have can end receiving passageway means each in a different vertical plane, said guide chutes being contoured between said entrance and discharge ends thereof for each said discharge end to be in the vertical plane for the corresponding curling machine.

21. Apparatus according to claim 20, wherein said press has opposite sides and opposite ends, said kicker means being mounted on one of said sides for said kicker member means to be reciprocable in the direction between said sides, and said curling machines being mounted on the other of said opposite sides.

22. Can end making apparatus comprising, an underdriven press having frame means including upper and lower portions, a slide supported by said lower portion of said frame means for reciprocation vertically along a slide axis between first and second positions with respect to said upper portion, and drive means in said lower portion for reciprocating said slide, said slide and said upper portion of said frame means supporting a plurality of opposed pairs of tooling, the tooling of each pair being axially spaced apart when said slide is in said first position and being cooperable in said second position of said slide to partially form a can end from sheet material interposed therebetween, means to feed sheet material between said tooling along a horizontal feed path in a first direction transverse to said slide axis, each said pair of tooling being offset from the other in said first direction, the tooling of said pairs on said slide including means to position a partially formed can end in a horizontal plane beneath said feed path when said slide is in said first position, kicker member means for each said pair of tooling, said kicker member means being supported by said frame means on one side of the corresponding tooling and being reciprocable horizontally in a second direction transverse to said first direction and in said horizontal plane to propel a partially formed can end positioned in said horizontal plane in the direction toward the opposite side of the corresponding tooling on said slide, means for reciprocating said kicker member means, curling means for each said pair of tooling mounted on said frame means and spaced from said opposite side of said corresponding toolng, said curling means including entrance means in said horizontal plane and aligned with the corresponding kicker member means, and means between said opposite side of said corresponding tooling and said entrance means for receiving and delivering partially formed can ends propelled by said kicker member means to said curling means.

23. Apparatus according to claim 22, wherein said means to reciprocate said kicker member means includes kicker member actuator means mounted on said slide for displacement therewith.

24. Apparatus according to claim 22, wherein said means to position a partially formed can end in said horizontal plane includes liftout means on said slide and means on said frame means for actuating said liftout means in response to reciprocation of said slide.

25. Apparatus according to claim 22, wherein said means for receiving and delivering partially formed can ends to said curling means includes endless conveyor means.

26. Apparatus according to claim 25, wherein said means for receiving and delivering partially formed can ends further includes guide chute means between said conveyor means and said opposite side of said corresponding tooling.

27. Apparatus according to claim 26, wherein said conveyor means includes an endless conveyor for each said pairs of tooling and the corresponding curling means.

28. Apparatus according to claim 27, wherein said guide chute means, endless conveyor means and entrance means to said curling means provide a linear delivery path in said horizontal plane.

29. Apparatus according to claim 22, wherein each said kicker member means includes a kicker bar supported for reciprocation in said horizontal plane, means biasing said kicker bar to a first position in the direction from said one side of the corresponding tooling toward said opposite side, and kicker bar actuating means to displace said kicker bar to a second position in the direction against said biasing means and to release said kicker bar for displacement by said biasing means from said second position to said first position to propel a partially formed can end in said horizontal plane.

30. Apparatus according to claim 29, wherein said kicker bar actuating means includes a lever having opposite ends pivotally connected one to said kicker bar and the other to said frame means, said biasing means acting against said lever, and cam and cam follower means mounted one on said lever and the other on said slide and cooperable with said biasing means to pivot said lever in response to reciprocation of said slide.

31. Apparatus according to claim 30, wherein said biasing means includes spring means, and means for adjusting the biasing force of said spring means.

32. Apparatus according to claim 30, wherein said means for receiving and delivering partially formed can ends to said curling means includes endless conveyor means and guide chute means between said conveyor means and said opposite side of said corresponding tooling.

33. Apparatus according to claim 32, wherein said conveyor means includes an endless conveyor for each said pairs of tooling and the corresponding curling means, said guide chute means, endless conveyors and entrance means to said curling means providing a linear delivery path in said horizontal plane.

34. Apparatus according to claim 33, wherein said means to position a partially formed can end in said horizontal plane includes liftout means on said slide and means on said frame means for actuating said liftout means in response to reciprocation of said slide.

35. Can end making apparatus comprising, an underdriven double action press having frame means including a lower portion and means providing bed means on said lower portion, upper and lower slides, means on said lower portion of said frame means supporting said slides for reciprocation vertically along a slide axis toward and away from said bed means between corresponding first and second positions, said slides having opposite sides and opposite ends transverse to said slide axis, drive means in said lower portion of said frame means for reciprocating said slides, a plurality of pairs of opposed tooling supported on said slides and bed means in offset relationship to one another in the direction between said ends of said slides, the tooling of each said pair being axially spaced apart in said first positions of said slides and being cooperable in said second positions of said slides to partially form a can end from sheet material interposed therebetween, means to feed sheet material between the tooling of said pairs along a horizontal feed path in the direction between said sides of said slides, the tooling of said pairs on said bed means including means to position a partially formed can end in a horizontal plane above said feed path, kicker member means supported by said frame means on each said opposite sides of said slide and provided one for each said pair of tooling, said kicker member means being reciprocable in said horizontal plane and in the direction between said sides of said slides to propel partially formed can ends positioned in said horizontal plane toward said opposite sides of said slides, means to reciprocate said kicker member means, means including first and second conveyor means for receiving partially formed can ends propelled by said kicker member means, each said conveyor means being supported outwardly of a different one of said opposite sides of said slides and extending in the direction between said ends of said slides to convey partially formed can ends along a corresponding conveyor path in the direction from one of said slide ends toward the other, and curling means for each said conveyor means including entrance means positioned along said conveyor path for receiving partially formed can ends conveyed by the corresponding one of said conveyor means.

36. Apparatus according to claim 35, wherein said means for receiving partially formed can ends further includes guide chute means between each said pairs of tooling and the corresponding one of said first and second conveyor means, each said guide chute means having an entrance end in said horizontal plane and adjacent the corresponding tooling and an exit end for delivering a partially formed can end onto said corresponding conveyor means.

37. Apparatus according to claim 35, wherein each said first and second conveyor means includes an endless conveyor belt having upper and lower runs providing for said corresponding conveyor path to be in opposite directions with respect to said ends of said slide, and said curling means includes a curling machine for each run of each said belts and having an entrance positioned to receive partially formed can ends conveyed by the corresponding belt run.

38. Apparatus according to claim 35, wherein each said kicker member means includes a reciprocable kicker rod, means biasing said rod to a first position in the direction to propel a partially formed can end toward the corresponding one of said opposite sides of said slide, and kicker rod actuating means to displace said kicker rod against said bias to a second position in the direction opposite said first direction and to release said kicker rod for said biasing means to displace said kicker rod from said second position to said first position.

39. Apparatus according to claim 38, wherein said actuating means includes cam follower means on said kicker rod and cam means rotatable relative to said follower means and including a first circumferential portion to engage said follower means and displace said kicker rod to said second position and a second circumferential portion releasing said follower means for said biasing means to displace said kicker rod to said first position.

40. Apparatus according to claim 35, wherein said frame means has opposite sides corresponding to said sides of said slide, said means to feed sheet material including feed table means on one of said opposite sides of said frame means, bracket means on each said opposite sides of said frame means supporting the kicker member means on the corresponding side of said slides, means on said one side releasably supporting said feed table means and the corresponding bracket means for displacement outwardly from said one side, and means releasably supporting said bracket means on the other of said opposite sides of said frame means for displacement outwardly from said other side.

41. Apparatus according to claim 35, wherein each said first and second conveyor means includes an endless conveyor belt having upper and lower runs providing for said corresponding conveyor path to be in opposite directions with respect to said ends of said slide, and said curling means includes a curling machine for each run of each said belts and having an entrance positioned to receive partially formed can ends conveyed by the corresponding belt run, said means for receiving partially formed can ends further including a guide chute between each said pairs of tooling and the corresponding one of said endless belts, each of said guide chutes having an entrance end in said horizontal plane and adjacent the corresponding tooling and an exit end for delivering partially formed can ends onto one of said upper and lower runs of the corresponding belt, the exit ends of adjacent ones of said guide chutes associated with each said belt delivering can ends to a different one of said upper and lower runs of the corresponding belt.

42. Apparatus according to claim 41, wherein each said kicker member means includes a reciprocable kicker rod, means biasing said rod to a first position in the direction to propel a partially formed can end toward the corresponding one of said opposite sides of said slide, and kicker rod actuating means to displace said kicker rod against said bias to a second position in the direction opposite said first direction and to release said kicker rod for said biasing means to displace said kicker rod from said second position to said first position.

43. Apparatus according to claim 42, wherein said actuating means includes cam follower means on said kicker rod and cam means rotatable relative to said follower means and including a first circumferential portion to engage said follower means and displace said kicker rod to said second position and a second circumferential portion releasing said follower means for said biasing means to displace said kicker rod to said first position.

44. Apparatus according to claim 43, wherein said frame means has opposite sides corresponding to said sides of said slide, said means to feed sheet material including feed table means on one of said opposite sides of said frame means, scrap discharge means on the other of said opposite sides of said frame means, means releaseably supporting said feed table means for displacement outwardly of said one side, first bracket means on said feed table means and displaceable therewith, said bracket means on said other side of said frame means, means releaseably supporting said second bracket means for displacement outwardly of said other side of said frame means, said first and second bracket means including means supporting the kicker means on the corresponding side of said slides and the guide chutes forthe kicker means on the other side of said slides, and said second bracket means supporting said scrap discharge means.

45. Can end making apparatus comprising a press having frame means including upper and lower portions and means providing bed means on said lower portion, a slide, means on said bed means supporting said slide for reciprocation vertically along a slide axis toward and away from said bed means and between first and second slide positions, drive means for said slide including drive shaft means above said slide and having opposite ends rotatably supported by corresponding sealed cartridge bearing means interposed between said drive shaft ends and said upper portion of said frame means, said slide having opposite sides and opposite ends transverse to said slide axis, a plurality of pairs of opposed tooling supported on said slide and bed means in offset relationship to one another in the direction between said ends of said slide, the tooling of each pair being axially spaced apart in said first position of said slide and being cooperable in said second position of said slide to partially form a can end from sheet material interposed therebetween, means to feed sheet material between the tooling of said pairs along a horizontal feed path in the direction between said ends of said slide, the tooling of said pairs on said slide means each including means to displace a partially formed can end to a horizontal plane above said feed line, kicker member means for each said pair of tooling supported on one of said opposite sides of said slide for reciprocation therewith, said kicker member means being reciprocable in said horizontal plane in the direction between said opposite sides of said slide to propel a partially formed can end in said horizontal plane toward the other of said opposite sides, means to reciprocate said kicker member means, a curling machine for each said pair of tooling mounted on said frame means on the side of said slide opposite said kicker member means, said curling machines having entrance means facing the corresponding pair of tooling, and guide chute means for each said pair of tooling and having an entrance end in said horizontal plane and adjacent the tooling and a discharge end at said entrance means of the corresponding curling machine.

46. Apparatus according to claim 45, wherein the tooling of said pairs on said slide includes knockout means to displace a partially formed can end to said horizontal plane during movement of said slide from said second toward said first position, and interengaging means on said slide and frame means to actuate said knockout means in response to reciprocation of said slide.

47. Apparatus according to claim 45, wherein each said kicker member means includes a kicker rod and means on said slide supporting said kicker rod, said means to reciprocate said kicker member means including interengaging means on said slide and frame means to reciprocate said kicker rod in response to reciprocation of said slide.

48. Apparatus according to claim 47, wherein said interengaging means includes actuating lever means pivotally supported on said slide and cam means supported on said frame means for pivoting said lever means in response to reciprocation of said slide.

49. Apparatus according to claim 48, wherein said tooling of said pairs on said slide includes knockout means to displace a partially formed can end to said horizontal plane during movement of said slide from said second toward said first position, said knockout means including means interengaging said lever means to actuate said knockout means in response to said pivoting of said lever means.

50. Apparatus according to claim 45, wherein said entrance means of each said curling machine is in a vertical plane, and said guide chute means are contoured between said entrance and discharge ends thereof for each said discharge end to be in the vertical plane for the entrance means of the corresponding curling machine.

51. Apparatus according to claim 50, wherein each said kicker member means includes a kicker rod and means on said slide supporting said kicker rod, said means to reciprocate said kicker member means including interengaging means on said slide and frame means to reciprocate said kicker rod in response to reciprocation of said slide.

52. Apparatus according to claim 51, wherein said interengaging means includes actuating lever means pivotally supported on said slide and cam means supported on said frame means for pivoting said lever means in response to reciprocation of said slide.

53. Apparatus according to claim 52, wherein said tooling of said pairs on said slide includes knockout means to displace a partially formed can end to said horizontal plane during movement of said slide from said second toward said first position, said knockout means including means interengaging said lever means to actuate said knockout means in response to said pivoting of said lever means.

54. Apparatus according to claim 45, wherein said frame means includes upright end plate members with respect to said opposite ends of said slide, said end plate members having upper and lower portions and front and rear sides with respect to said opposite sides of said slide, said end plate members further having openings in said front sides between said upper and lower portions, said openings having lower edges, means including bolster plate means extending between said end plate members and supported on said lower edges to provide said bed means.

55. Apparatus according to claim 54, wherein said means on said bed means supporting said slide includes upright guide pins having lower ends mounted on said bolster plate means and upper ends extending through corresponding guide pin openings in said slide.

56. Apparatus according to claim 54, wherein said cartridge bearing means are mounted on said upper portions of said end plate members, said drive shaft having slide driving cam means thereon intermediate said opposite ends thereof, said drive means for said slide further including connecting rod means having upper and lower ends, means pivotally connecting said lower end of said connecting rod means to said slide, and cam follower means on said upper end of said connecting rod interengaged with said slide driving cam means on said drive shaft.

57. Apparatus according to claim 56, wherein said cam follower means includes follower rollers on said upper end of said connecting rod means engaging said slide driving cam means below the axis of said drive shaft, and pneumatic piston and cylinder means including cylinders mounted on said lower portions of said end plate members and piston rods extending upwardly from said cylinders and engaging said slide to bias said follower rollers upwardly against said slide driving cam means.

58. Apparatus according to claim 57, wherein said means on said bed means supporting said slide include upright guide pins having lower ends mounted on said bolster plate means and upper ends extending through corresponding guide pin openings in said slide.

59. Apparatus according to claim 58, wherein said curling machines are mounted between said end plate members adjacent said rear sides thereof.

60. Apparatus according to claim 58, wherein each said kicker member means includes a kicker rod and means on said slide suppporting said kicker rod, said means to reciprocate said kicker member means including interengaging means on said slide and frame means to reciprocate said kicker rod in response to reciprocation of said slide.

61. Apparatus according to claim 60, wherein said interengagine means includes actuating lever means pivotally supported on said slide and cam means supported on said frame means for pivoting said lever means in response to reciprocation of said slide.

62. Apparatus according to claim 61, wherein said tooling of said pairs on said slide includes knockout means to displace a partially formed can end to said horizontal plane during movement of said slide from said second toward said first position, said knockout means including means interengaging said lever means to actuate said knockout means in response to said pivoting of said lever means.

63. Apparatus according to claim 62, wherein said curling machines are mounted between said end plate members adjacent said rear sides thereof.

64. Apparatus according to claim 63, wherein said entrance means of each said curling machine is in a vertical plane, and said guide chute means are contoured between said entrance and discharge ends thereof for each said discharge end to be in the vertical plane for the entrance means of the corresponding curling machine.

* * * * *